US010802412B2

(12) United States Patent
Aoyama et al.

(10) Patent No.: US 10,802,412 B2
(45) Date of Patent: Oct. 13, 2020

(54) IMAGE FORMING APPARATUS AND IMAGE FORMING METHOD

(71) Applicants: Yuka Aoyama, Kanagawa (JP); Keiichiro Juri, Kanagawa (JP); Shinya Nakayama, Shizuoka (JP); Hiroshi Yamada, Shizuoka (JP)

(72) Inventors: Yuka Aoyama, Kanagawa (JP); Keiichiro Juri, Kanagawa (JP); Shinya Nakayama, Shizuoka (JP); Hiroshi Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/812,964

(22) Filed: Mar. 9, 2020

(65) Prior Publication Data

US 2020/0292954 A1 Sep. 17, 2020

(30) Foreign Application Priority Data

Mar. 13, 2019 (JP) ..... 2019-046020

(51) Int. Cl.
*G03G 9/087* (2006.01)
*G03G 15/08* (2006.01)
*G03G 21/00* (2006.01)

(52) U.S. Cl.
CPC ..... *G03G 9/08764* (2013.01); *G03G 15/08* (2013.01); *G03G 21/0005* (2013.01)

(58) Field of Classification Search
CPC ..... G03G 9/08764; G03G 15/08; G03G 21/0005; G03G 21/0011; G03G 21/0017
See application file for complete search history.

(56) References Cited

U.S. PATENT DOCUMENTS 5,450,184 A 9/1995 Yanai et al.
9,625,858 B2 4/2017 Izutani et al.
(Continued)

FOREIGN PATENT DOCUMENTS

JP 2962843 8/1999
JP 2004-233818 8/2004
(Continued)

OTHER PUBLICATIONS

U.S. Appl. No. 16/583,861 dated Sep. 26, 2019.

*Primary Examiner* — Sandra Brase
(74) *Attorney, Agent, or Firm* — Oblon, McClelland, Maier & Neustadt, L.L.P.

(57) ABSTRACT

An image forming apparatus including developing unit to develop electrostatic latent image with toner to form visible image, and cleaning unit including elastic member including surface layer and configured to remove the toner, wherein Martens hardness A and Martens hardness B of the surface layer measured by applying load of 1 μN and load of 1,000 μN, respectively, to position of the surface layer in thickness direction thereof using nanoindenter are both 2.5 N/mm$^2$ or greater but 32.5 N/mm$^2$ or less, and Martens hardness A and Martens hardness B satisfy inequality, Martens hardness A>Martens hardness B wherein coefficient of dynamic friction of the surface layer against polycarbonate is 0.5 or less, and the toner includes polyester resin insoluble to THF and Tg of THF-insoluble component of the toner determined from DSC curve of first heating of DSC is −60° C. or higher but 20° C. or lower.

13 Claims, 8 Drawing Sheets

(56) References Cited

U.S. PATENT DOCUMENTS

| | | | | |
|---|---|---|---|---|
| 9,778,602 | B2 | 10/2017 | Juri et al. | |
| 9,851,656 | B2 | 12/2017 | Juri et al. | |
| 9,851,682 | B2 | 12/2017 | Aoyama et al. | |
| 9,891,558 | B2 | 2/2018 | Matsushita et al. | |
| 9,921,526 | B2 | 3/2018 | Takahashi et al. | |
| 10,146,169 | B2 | 12/2018 | Aoyama et al. | |
| 2004/0240915 | A1* | 12/2004 | Nakayama | G03G 21/0017 399/345 |
| 2009/0311017 | A1 | 12/2009 | Ohmori et al. | |
| 2011/0217102 | A1* | 9/2011 | Ohmori | G03G 21/00 399/350 |
| 2013/0059247 | A1 | 3/2013 | Sugimoto et al. | |
| 2015/0014602 | A1 | 1/2015 | Matsushita et al. | |
| 2015/0139711 | A1 | 5/2015 | Gohda et al. | |
| 2016/0209766 | A1 | 7/2016 | Chiba et al. | |
| 2016/0231661 | A1 | 8/2016 | Nagai et al. | |
| 2016/0259257 | A1 | 9/2016 | Sugimoto et al. | |
| 2016/0274527 | A1 | 9/2016 | Gohda et al. | |
| 2016/0320740 | A1 | 11/2016 | Toyama et al. | |
| 2016/0334726 | A1 | 11/2016 | Sakashita et al. | |
| 2016/0370720 | A1 | 12/2016 | Yamashita et al. | |
| 2017/0010550 | A1* | 1/2017 | Nagata | G03G 9/08793 |
| 2017/0017175 | A1* | 1/2017 | Yamada | G03G 9/0904 |
| 2017/0108791 | A1 | 4/2017 | Hashida et al. | |
| 2017/0363980 | A1 | 12/2017 | Nagata et al. | |
| 2018/0224763 | A1 | 8/2018 | Tanaka et al. | |
| 2018/0239297 | A1 | 8/2018 | Juri et al. | |
| 2018/0253022 | A1 | 9/2018 | Takeda et al. | |
| 2018/0321606 | A1 | 11/2018 | Ohnuma et al. | |
| 2019/0171122 | A1 | 6/2019 | Ukigaya et al. | |

FOREIGN PATENT DOCUMENTS

| | | |
|---|---|---|
| JP | 3602898 | 10/2004 |
| JP | 2010-134310 | 6/2010 |
| JP | 2011-164377 | 8/2011 |
| JP | 5408210 | 11/2013 |
| JP | 5532378 | 5/2014 |
| JP | 2015-014744 | 1/2015 |
| JP | 2015-052698 | 3/2015 |
| JP | 2015-096890 | 5/2015 |
| JP | 5884797 | 2/2016 |
| JP | 6273726 | 1/2018 |

* cited by examiner

IMAGE FORMING APPARATUS AND IMAGE FORMING METHOD

CROSS-REFERENCE TO RELATED APPLICATIONS

The present application claims priority under 35 U.S.C. § 119 to Japanese Patent Application No. 2019-046020 filed Mar. 13, 2019. The contents of which are incorporated herein by reference in their entirety.

BACKGROUND OF THE INVENTION

Field of the Invention

The present disclosure relates to an image forming apparatus and an image forming method.

Description of the Related Art

In the art, it has been known that a deposition, such as unnecessary transfer residual toner particles, deposited on a surface of an image bearer, such as a photoconductor, in an image forming apparatus of an electrophotography system has been removed by a cleaning unit after transferring a toner image to transfer member or an intermediate transfer member.

As a cleaning unit, a cleaning unit using a strip-shaped cleaning blade has been know because a structure of the cleaning unit can be made simple and excellent cleaning performance can be achieved. The cleaning unit is configured to remove the toner remained on the surface of the image bearer, for example, by supporting a proximal end of the cleaning blade with a supporting member to press an abutment (tip ridgeline part) against a surface of the image bearer to hold up and scrape the toner remained on the image bearer.

As a cleaning blade, proposed is a cleaning blade where a surface layer formed of a resin having film hardness of pencil hardness B to 6H is arranged on an abutment of an elastic member formed of a polyurethane elastomer (see, for example, Japanese Patent No. 3602898).

Moreover, proposed is a cleaning blade where an abutment of an elastic member is impregnated with at least one selected from the group consisting of an isocyanate compound, a fluorine compound, and a silicone compound, and a surface layer harder than the elastic member is arranged on a surface of the elastic member including the abutment (see, for example, Unexamined Japanese Patent Application Publication No. 2004-233818).

Proposed is a cleaning blade where an abutment of an elastic member is impregnated with at least one selected from the group consisting of an isocyanate compound, a fluorine compound, and a silicone compound, and a surface layer harder than the elastic member is arranged on a surface of the elastic member including the abutment (see, for example, Japanese Patent No. 5532378).

Moreover, proposed is a cleaning blade that includes a surface layer including lubricating particles and a binder resin (see, for example, Japanese Patent No. 2962843).

As a toner for use, proposed is, for example, a toner that has a glass transition temperature (Tg) of 0° C. or lower and includes urethane-modified polyester for achieving excellent low-temperature fixability and heat resistant storage stability (see, for example, Japanese Patent Nos. 5408210, 5884797, and 6273726).

However, such a toner often has high chargeability and tends to deposit on an abutment of a cleaning blade with an image bearer or block the abutment with aggregates of the toner.

SUMMARY OF THE INVENTION

According to one aspect of the present disclosure, an image forming apparatus includes a developing unit configured to develop an electrostatic latent image formed on a surface of an image bearer with a toner to form a visible image, and a cleaning unit which includes an elastic member including a surface layer to be in contact with the surface of the image bearer, and is configured to remove the toner deposited on the surface of the image bearer with the elastic member. Martens hardness A of the surface layer measured by applying a load of 1 μN to a predetermined position of the surface layer in a thickness direction of the surface layer using a nanoindenter and Martens hardness B of the surface layer measured by applying a load of 1,000 μN to the predetermined position of the surface layer in the thickness direction of the surface layer using the nanoindenter are both 2.5 $N/mm^2$ or greater but 32.5 $N/mm^2$ or less, and Martens hardness A and Martens hardness B satisfy an inequality below.

$$\text{Martens hardness A} > \text{Martens hardness B}$$

A coefficient of dynamic friction of polycarbonate of the surface layer is 0.5 or less. The toner includes a polyester resin insoluble to tetrahydrofuran (THF) and a glass transition temperature (Tg) of a THF-insoluble component of the toner determined from a DSC curve of first heating of differential scanning calorimetry (DSC) is −60° C. or higher but 20° C. or lower.

Figure 1:
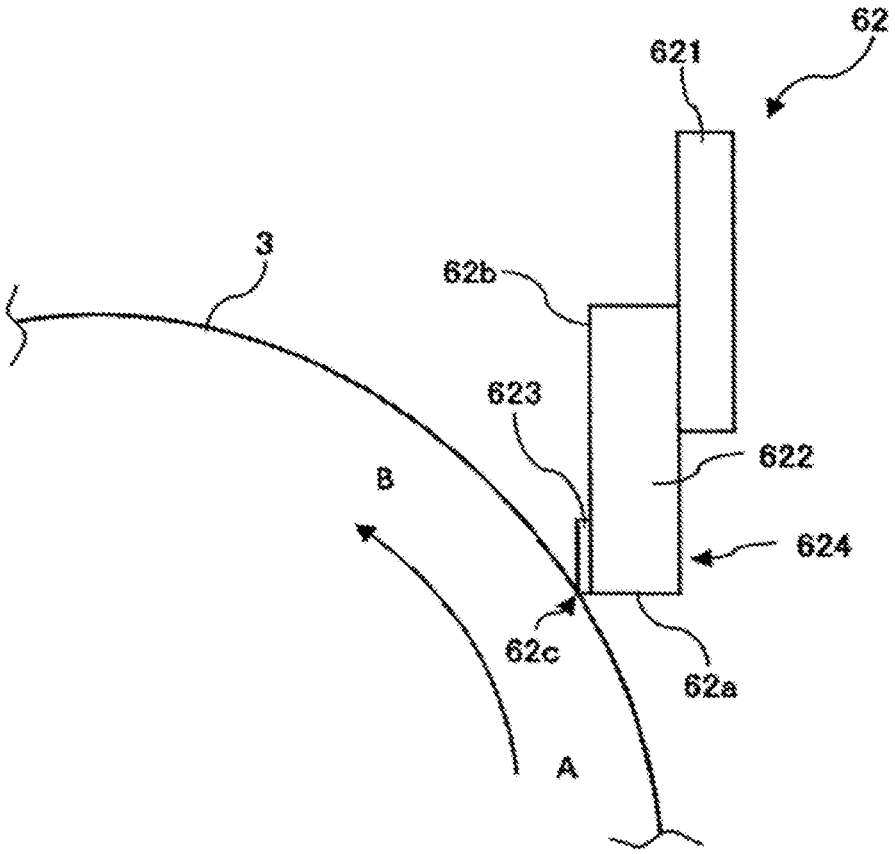
FIG. 1 is an enlarged cross-sectional view illustrating an example of a state where an example of a cleaning blade of an image forming apparatus of the present disclosure is in contact with a surface of an image bearer.

DESCRIPTION OF THE EMBODIMENTS (Image Forming Apparatus and Image Forming Method)

The image forming apparatus of the present disclosure includes a developing unit configured to develop an electrostatic latent image formed on a surface of an image bearer with a toner to form a visible image, and a cleaning unit configured to remove the toner deposited on the surface of the image bearer with an elastic member including a surface layer to be in contact with the surface of the image bearer. The image forming apparatus preferably includes at least one selected from the group consisting of a charging unit, an exposure unit, a transfer unit, and a fixing unit, and may further include other units according to the necessity.

Martens hardness A of the surface layer of the image forming apparatus of the present disclosure measured by applying a load of 1 μN to a predetermined position of the surface layer in a thickness direction of the surface layer using a nanoindenter and Martens hardness B of the surface layer measured by applying a load of 1,000 μN to the predetermined position of the surface layer in the thickness direction of the surface layer using the nanoindenter are both 2.5 $N/mm^2$ or greater but 32.5 $N/mm^2$ or less, and Martens hardness A and Martens hardness B satisfy an inequality [Martens hardness A>Martens hardness B].

Moreover, a coefficient of dynamic friction of the surface layer of the cleaning unit of the image forming apparatus of the present disclosure against polycarbonate is 0.5 or less.

In addition, the toner used in the image forming apparatus of the present disclosure includes a polyester resin insoluble to tetrahydrofuran (THF), and a glass transition temperature (Tg) of a THF-insoluble component of the toner determined from a DSC curve of first heating of differential scanning calorimetry (DSC) is −60° C. or higher but 20° C. or lower.

The present disclosure has an object to provide an image forming apparatus, which can prevent damages of a cleaning unit to maintain cleaning performance against an image bearer even when a toner having excellent low temperature fixability and heat resistant storage stability is used.

The present invention can provide an image forming apparatus, which can prevent damages of a cleaning unit to maintain cleaning performance against an image bearer even when a toner having excellent low temperature fixability and heat resistant storage stability is used.

The image forming method of the present invention includes a developing step including developing an electrostatic latent image formed on a surface of an image bearer with a toner to form a visible image, and a cleaning step including removing the toner deposited on the surface of the image bearer with an elastic member including a surface layer to be in contact with the surface of the image bearer. The image forming method preferably includes at least one selected from the group consisting of an exposing step, a transferring step, and a fixing step, and may further include other steps according to the necessity.

Moreover, the surface layer used in the cleaning step of the image forming method of the present disclosure has the following Martens hardness A and Martens hardness B. Namely, Martens hardness A of the surface layer measured by applying a load of 1 μN to a predetermined position of the surface layer in a thickness direction of the surface layer using a nanoindenter and Martens hardness B of the surface layer measured by applying a load of 1,000 μN to the predetermined position of the surface layer in the thickness direction of the surface layer using the nanoindenter are both 2.5 $N/mm^2$ or greater but 32.5 $N/mm^2$ or less, and Martens hardness A and Martens hardness B satisfy an inequality below:

Martens hardness A>Martens hardness B

Moreover, a coefficient of dynamic friction of the surface layer used in the cleaning step of the image forming method of the present disclosure against polycarbonate is 0.5 or less.

In addition, the toner used in the image forming method of the present disclosure includes a polyester resin insoluble to tetrahydrofuran (THF) and a glass transition temperature (Tg) of a THF-insoluble component of the toner determined from a DSC curve of first heating of differential scanning calorimetry (DSC) is −60° C. or higher but 20° C. or lower.

The image forming method of the present disclosure is suitably performed by the image forming apparatus of the present disclosure. The developing step is suitably performed by the developing unit. The cleaning step is suitably performed by the cleaning unit. The charging step is suitably performed by the charging unit. The exposing step is suitably performed by the exposing unit. The transferring step is suitably performed by the transferring unit. The fixing step is suitably performed by the fixing unit. Other steps are suitably performed by other units.

Specifically, the image forming apparatus of the present disclosure means identical to perform the image forming method of the present disclosure. Accordingly, the details of the image forming method of the present disclosure will be clarified through descriptions related to the image forming apparatus of the present disclosure.

Moreover, the image forming apparatus of the present disclosure has been accomplished based on the insight that a cleaning unit of an image forming apparatus according to the related art is damaged to decrease cleaning performance against an image bearer when a toner having excellent low temperature fixability and heat resistant storage stability is used.

The image forming apparatus of the related art has a problem that cleaning failures occur because a toner is deposited on an image bearer and an abutment of a cleaning blade, or aggregates of particles of the toner block the space between the image bearer and the abutment of the cleaning blade. Moreover, there has been also a problem that a portion of a cleaning blade is chipped by the toner scraped through the space between the image bearer and the cleaning blade due to a cleaning failure.

Figure 8A:
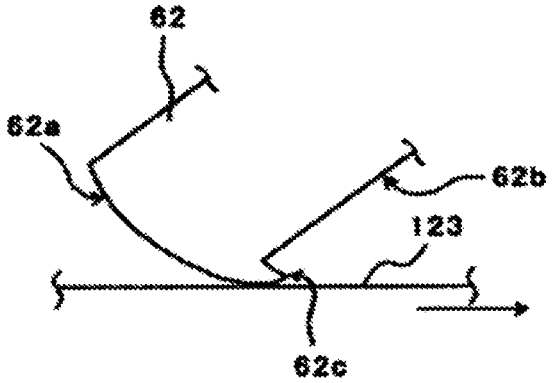
FIG. 8A is a view for describing an example of a state where a tip ridgeline part of a cleaning blade known in the art is turned up.
Figure 8B:
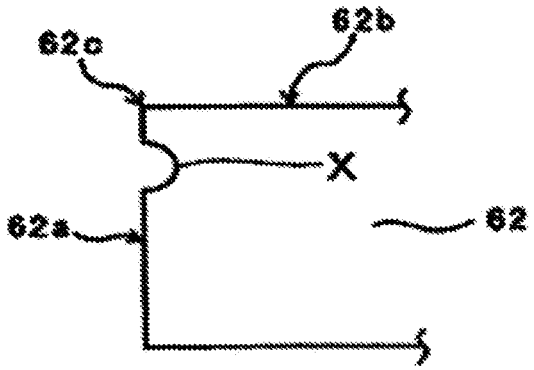
FIG. 8B is a view describing an example of local abrasion of an edge surface of a cleaning blade.
Figure 8C:
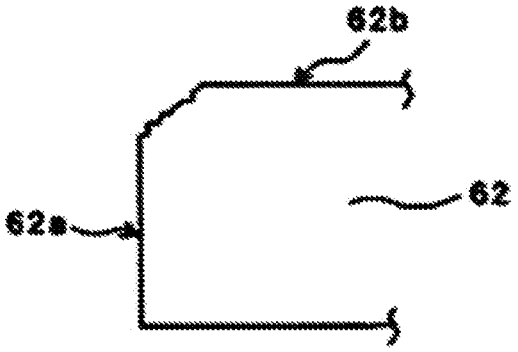
FIG. 8C is a view illustrating an example of a state where the tip ridgeline part of the cleaning blade is chipped.

When the contact pressure between the image bearer and the cleaning blade is increased for the purpose of preventing the toner from scraping through as described above, curling of the cleaning blade may occur as illustrated in FIG. 8A. When the cleaning blade is continued to be used in the curled state, moreover, local friction is generated in the cleaning blade as illustrated in FIG. 8B, and eventually the tip ridgeline part thereof is chipped as illustrated in FIG. 8C.

Moreover, there is also a problem that a cleaning blade known in the art generates a noise because torque with the image bearer is increased due to the abrasion of the abutment.

When a surface layer of a cleaning blade is formed by spray coating and the surface layer is formed in the area including an abutment, in addition, it is difficult to make a film thickness of the surface layer at the abutment thick, and therefore the surface layer is abraded early. Therefore, there is a problem that torque of the image bearer increases as the base material of the elastic member is brought into contact with the image bearer. When the torque increases, load is applied to rotations of the image bearer. As a result, a color shift may be caused, for example, in an image forming apparatus.

As disclosed in Japanese Patent No. 2962843, for example, a blade, on which a surface layer including lubricity particles is formed, has impaired edge precision of an abutment because of the presence of the lubricity particles on the surface thereof, and cannot maintain a cleaning performance with a current high-speed image forming apparatus or a spherical toner.

The above-described problem becomes particularly significant when a toner having excellent low temperature fixability and heat resistant storage stability. In order to improve low temperature fixability of the tone, it is important to make viscoelasticity or a softening temperature of the toner low. When the viscoelasticity or softening temperature of the toner is low, however, chargeability tends to be large, and therefore aggregations of particles of the toner due to mechanical or thermal stress, or deposition of the toner on members of the device tend to occur. Therefore, cleaning performance on the image bearer may decrease.

Examples of the toner with which the above-described problems tend to occur include toners having a glass transition temperature (Tg) of 0° C. or lower, including a urethane-modified polyester having a crosslink structure, having excellent low temperature fixability and heat resistant storage stability, and having high chargeability, as described in Japanese Patent Nos. 5408210, 5884797, and 6273726. When such a toner is used, the cleaning blade is curled when cleaning of the image bearer is performed. Therefore, the toner tends to be retained at the abutment with the image bearer, and the toner tends to enter a nip of the cleaning blade. Therefore, the particles of the toner in the nip are deformed by pressure and heat, and the aggregated toner particles are scraped through the cleaning blade. As a result, an edge of the cleaning blade is chipped and a cleaning failure tends to occur.

Meanwhile, the surface layer of the cleaning unit of the image forming apparatus of the present disclosure has the following Martens hardness A and Martens hardness B. Namely, Martens hardness A of the surface layer measured by applying a load of 1 μN to a predetermined position of the surface layer in a thickness direction of the surface layer using a nanoindenter and Martens hardness B of the surface layer measured by applying a load of 1,000 μN to the predetermined position of the surface layer in the thickness direction of the surface layer using the nanoindenter are both 2.5 $N/mm^2$ or greater but 32.5 $N/mm^2$ or less, and Martens hardness A and Martens hardness B satisfy an inequality below:

Martens hardness A>Martens hardness B

Moreover, a coefficient of dynamic friction of the surface layer of the cleaning unit in the image forming apparatus of the present disclosure against polycarbonate is 0.5 or less. In addition, the toner used in the image forming apparatus of the present disclosure includes a polyester resin insoluble to tetrahydrofuran (THF) and a glass transition temperature (Tg) of a THF-insoluble component of the toner determined from a DSC curve of first heating of differential scanning calorimetry (DSC) is −60° C. or higher but 20° C. or lower. In other words, the image forming apparatus of the present disclosure includes the cleaning unit satisfying the inequality [Martens hardness A>Martens hardness B] and having a coefficient of dynamic friction of 0.5 or less against polycarbonate, and uses the toner satisfying the conditions described above.

As a result of the characteristics described above, the image forming apparatus of the present disclosure can prevents an edge of a cleaning blade from being chipped as a toner is prevented from entering a nip of the cleaning blade, even when the toner that has the above-described characteristics and has excellent low-temperature fixability and heat resistant storage stability is used.

Specifically, the image forming apparatus of the present disclosure includes a cleaning unit including a surface layer having characteristics (hardness distribution and coefficient of dynamic friction) suitable for removing the toner having the above-described characteristics from an image bearer. Even in the case where a toner having excellent low-temperature fixability and heat resistant storage stability is used, therefore, the image forming apparatus of the present disclosure can prevent damages on the cleaning unit, and can maintain cleaning performance against an image bearer.

Hereinafter, the image forming apparatus of the present disclosure will be described with reference to drawings. Note that, the present disclosure is not limited to embodiments described below. Another embodiments may be used or addition, correction, or elimination may be made to the following embodiments within the scope the person skilled in the art can arrive. Any of these embodiments are included within the scope of the present disclosure as long as a function and an effect of the present disclosure are exhibited.

<Cleaning Unit (Cleaning Blade)>

First, a problem associated with a cleaning unit known in the art will be more specifically described.

There has been a problem that toner particles are scraped through a minute space formed between a cleaning blade and an image bearer when a polymerization toner having a small particle diameter and having excellent sphericity. In order to prevent the toner particles from scraping through, it is important to increase contact pressure between the image bearer and the cleaning blade to enhance cleaning performance. When contact pressure of the cleaning blade is increased, however, friction force between the image bearer 123 and the cleaning blade 62. As a result, the cleaning blade 62 is pulled in the travelling direction of the image bearer 123 and the tip ridgeline part 62*c* of the cleaning blade 62 may be curled in as illustrated in FIG. 8A. In this case, noise may be generated when the curled cleaning blade 62 recovers the original state against force working on the cleaning blade to be curled.

When cleaning is continued further in the state where the tip ridgeline part 62*c* of the cleaning blade is curled, as illustrated in FIG. 8B, local friction X is generated in a position that is several micrometers away from the tip ridgeline part 62*c* of the blade edge surface 62*a* of the cleaning blade 62. When cleaning is continued further in such a state, the local friction increases. Ultimately, the tip ridgeline part 62*c* is chipped as illustrated in FIG. 8C. When the tip ridgeline part 62*c* is chipped as described above, there is a problem that the toner cannot be collectively cleaned and a cleaning failure occurs. In FIGS. 8A to 8C, 62*b* is a bottom surface of the cleaning blade.

The cleaning unit (may be referred to as a cleaning blade or a blade) of the image forming apparatus of the present disclosure is configured to remove the toner deposited on the surface of the image bearer with an elastic member including a surface layer to be in contact with the surface of the image bearer. The details of the surface layer will be described later.

According to one embodiment of the cleaning unit of the image forming apparatus of the present disclosure, the cleaning unit includes an elastic member configured to be in contact with the surface of the image bearer and remove deposit matter deposited on the surface of the image bearer. The elastic member includes a base material and a surface layer.

According to one embodiment of the surface layer of the present disclosure, the surface layer is formed at least at part of a bottom surface of the base material including an abutment, when a surface of the base material facing the side of downstream of the traveling direction of the image bearer relative to the abutment to be in contact with the image bearer is determined as the bottom surface of the base material.

Figure 2:
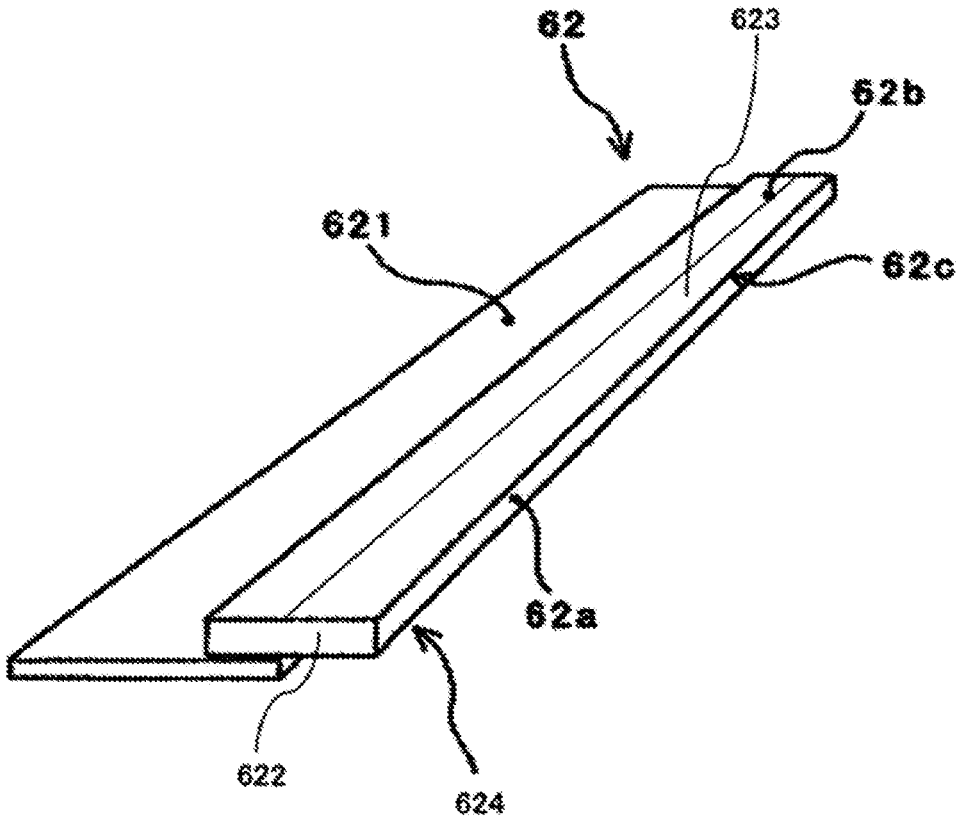
FIG. 2 is a perspective view illustrating an example of a cleaning blade of the image forming apparatus of the present disclosure.

One embodiment of the cleaning unit of the image forming apparatus of the present disclosure will be described with reference to FIGS. 1 and 2. FIG. 1 is an exemplary view of a state where a cleaning blade 62 is in contact with a surface of a photoconductor 3 that is an example of an image bearer. FIG. 2 is a perspective view of the cleaning blade 62. The cleaning blade 62 includes a supporting member 621, an elastic member 624, a base material 622, and a surface layer 623, and the base material 622 of the present embodiment is in the shape of a strip. Moreover, a blade edge surface 62*a*, a blade bottom surface 62*b*, and a tip ridgeline part 62*c* (may be also referred to as an abutment, an edge part, etc.) are illustrated.

In the present disclosure, a bottom surface of the base material of the elastic member is a surface of the base material along the longitudinal direction and is a surface facing the downstream side of the traveling direction (the rotational direction in the present embodiment) of the image bearer, and an edge surface of the base material is an surface including a tip ridgeling part of the base material, and an surface of an edge thereof facing the upstream side relative to a rotational direction of the image bearer.

Moreover, a bottom surface of the blade is a surface of the elastic member along the longitudinal direction and is a surface facing the downstream side of the rotational direction of the image bearer, and a blade edge surface is a surface including a tip ridgeline part of the elastic member and is a surface of an edge thereof facing the upstream side of the rotational direction of the image bearer.

In FIG. 1, the surface 62*b* facing the downstream side B of the traveling direction of the image bearer is a bottom surface of the blade, and the surface 62*a* of the edge facing the upstream side A of the traveling direction of the image bearer is an edge surface of the blade.

Moreover, the abutment of the elastic member to be in contact with the surface of the image bearer includes the tip ridgeline part of the elastic member. In the case where the tip ridgeline part is curled or linear pressure, moreover, part of the edge surface of the blade is included in the abutment.

<<Supporting Member>>

The cleaning blade of the present embodiment preferably includes a supporting member, and a flat-plate-shaped elastic member one end of which is linked to the supporting member and the other end of which is a free end having a predetermined length. The cleaning blade is disposed in the manner that an abutment including the tip ridgeline part that is an end of the elastic member at the side of the free end is to be in contact with the surface of the image bearer along the longitudinal direction.

A shape, size, material, etc. of the supporting member are not particularly limited and may be appropriately selected depending on the intended purpose. Examples of the shape of the supporting member include a flat plate shape, a strip shape, and a sheet shape. The size of the supporting member is not particularly limited and may be appropriately selected depending on the size of the image bearer.

The material of the supporting member is not particularly limited and may be appropriately selected depending on the intended purpose. Examples of the material thereof include metals, plastics, and ceramics. Among the above-listed examples, a metal plate is preferable in view of strength, and a steel plate (e.g., a stainless steel plate), an aluminium plate, and a phosphor bronze plate are particularly preferable.

<<Base Material>>

A shape, material, size, structure, etc. of a base material of the elastic member are not particularly limited and may be appropriately selected depending on the intended purpose.

Examples of the shape of the base material include a flat plate shape, a strip shape, and a sheet shape.

The size of the base material is not particularly limited and may be appropriately selected depending on the size of the image bearer.

The material of the base material is not particularly limited and may be appropriately selected depending on the intended purpose. Polyurethane rubber, polyurethane elastomers, etc. are preferable because high elasticity is easily obtained.

A production method of the base material of the elastic member is not particularly limited and may be appropriately selected depending on the intended purpose. For example, a polyurethane prepolymer is prepared using a polyol compound and a polyisocyanate compound, a curing agent and optionally a curing catalyst are added to the polyurethane prepolymer to crosslink inside a predetermined mold, the crosslinked product is subjected to post-crosslinking in a furnace, the post-crosslinked product is formed into a sheet by centrifugal forming, the resultant is left to stand at a room temperature to mature, and the matured product is cut into a plate shape of the predetermined size, to thereby produce the base material.

The polyol compound is not particularly limited and may be appropriately selected depending on the intended purpose. Examples thereof include high molecular weight polyol and low molecular weight polyol.

Examples of the high molecular weight polyol include: polyester polyol that is a condensate between alkylene glycol and aliphatic dibasic acid; polyester-based polyol, such as polyester polyol between alkylene glycol and adipic acid (e.g., ethylene adipate ester polyol, butylene adipate ester polyol, hexylene adipate ester polyol, ethylene propylene adipate ester polyol, ethylene butylene adipate ester polyol, and ethylene neopentylene adipate ester polyol); polycaprolactone-based polyol, such as polycaprolactone ester polyol obtained through ring-opening polymerization of caprolactone; and polyether-based polyol, such as poly (oxytetramethylene)glycol, and poly(oxypropylene)glycol. The above-listed examples may be used alone or in combination.

Examples of the low molecular weight polyol include: divalent alcohols, such as 1,4-butanediol, ethylene glycol, neopentyl glycol, hydroquinone-bis(2-hydroxyethyl)ether, 3,3'-dichloro-4,4'-diaminodiphenylmethane, and 4,4'-diaminodiphenylmethane; and trivalent or higher polyvalent alcohols, such as 1,1,1-trimethylolpropane, glycerin, 1,2,6-hexanetriol, 1,2,4-butanetriol, trimethylolethane, 1,1,1-tris(hydroxyethoxymethyl)propane, diglycerin, and pentaerythritol. The above-listed examples may be used alone or in combination.

The polyisocyanate compound is not particularly limited and may be appropriately selected depending on the intended purpose. Examples thereof include methylene diphenyl diisocyanate (MDI), tolylene diisocyanate (TDI), xylylene diisocyanate (XDI), naphthylene 1,5-diisocyanate (NDI), tetramethylxylene diisocyanate (TMXDI), isophorone diisocyanate (IPDI), hydrogenated xylylene diisocyanate (H6XDI), dicyclohexylmethane diisocyanate (H12MDI), hexamethylene diisocyanate (HDI), dimeric acid diisocyanate (DDI), norbornene diisocyanate (NBDI), and trimethylhexamethylene diisocyanate (TMDI). The above-listed examples may be used alone or in combination.

The curing catalyst is not particularly limited and may be appropriately selected depending on the intended purpose. Examples thereof include amine-based compounds, such as tertiary amine, and organic metal compounds, such as organic tin compounds. Examples of the tertiary amine include: trialkyl amine, such as trimethylamine; tetraalkyl diamine, such as N,N,N',N'-tetramethyl-1,3-butanediamine; amino alcohols, such as dimethylethanolamine; ester amine, such as ethoxylated amine, ethoxylated diamine, and bis(diethylethanolamine)adipate; cyclohexylamine derivatives, such as triethylene diamine (TEDA), and N,N-dimethylcyclohexylamine; morpholine derivatives, such as N-methylmorpholine, and N-(2-hydroxypropyl)-dim ethylmorpholine; and piperazine derivatives, such as N,N'-diethyl-2-methylpiperazine, and N,N'-bis-(2-hydroxypropyl)-2-methylpiperazine. Moreover, examples of the organic tin compound include dialkyl tin compound (e.g., dibutyltin dilaurate, and dibutyltin bis(2-ethylhexonate)), stannous 2-ethylcapronate, and stannous oleate. The above-listed examples may be used alone or in combination.

An amount of the curing catalyst is not particularly limited and may be appropriately selected depending on the intended purpose. The amount thereof is preferably 0.01% by mass or greater but 0.5% by mass or less, and more preferably 0.05% by mass or greater but 0.3% by mass or less.

The JIS-A hardness of the base material is not particularly limited and may be appropriately selected depending on the intended purpose. The JIS-A hardness thereof is preferably 60 degrees or greater, and more preferably 65 degrees or greater but 80 degrees or less. When the JIS-A hardness is 60 degrees or greater, linear pressure of the blead is easily obtained and an area of the abutment with the image bearer is not easily expand, and therefore a cleaning failure is unlikely to occur.

The JIS-A hardness of the base material can be measured, for example, by means of Micro durometer MD-1 available from KOBUNSHI KEIKI CO., LTD.

The rebound resilience of the base material according to the JIS K6255 standard is not particularly limited and may be appropriately selected depending on the intended purpose. The rebound resilience coefficient can be measured, for example, by means of No. 221 resilience tester available from TOYO SEIKI SEISAKU-SHO, LTD. at 23° C. according to the JIS K6255 standard.

The average thickness of the base material is not particularly limited and may be appropriately selected depending on the intended purpose. The average thickness thereof is preferably 1.0 mm or greater but 3.0 mm or less.

The Martens hardness of the base material is not particularly limited and may be appropriately selected depending on the intended purpose.

A preferable range of the Martens hardness of the base material is 0.8 $N/mm^2$ or greater but 3.0 $N/mm^2$ or less. When the Martens hardness of the base material is 0.8 $N/mm^2$ or greater but 3.0 $N/mm^2$ or less, formation of cracks in the surface layer can be prevented, and a cleaning failure is unlikely to occur even after use of a long term.

Since the Martens hardness of the base material is 0.8 $N/mm^2$ or greater, moreover, the base material is not too soft, deformation due to vibrations caused by axial runout of the image bearer can be prevented, the surface layer easily tracks deformation of the base material to prevent formation of cracks, and therefore excellent cleaning performance is achieved.

A measurement method of the Martens hardness (HM) of the base material is as follows.

The Martens hardness (HM) is measured according to ISO 14577 by pressing Berkovich indenter with load of 1,000 μN for 10 seconds, maintaining the pressure for 5 seconds, and releasing the pressure for 10 seconds with the same loading rate by means of a nanoindenter ENT-3100 available from ELIONIX INC. The measuring site is a position that is 100 μm from the tip ridgeline part of the edge surface of the blade.

Figure 9:
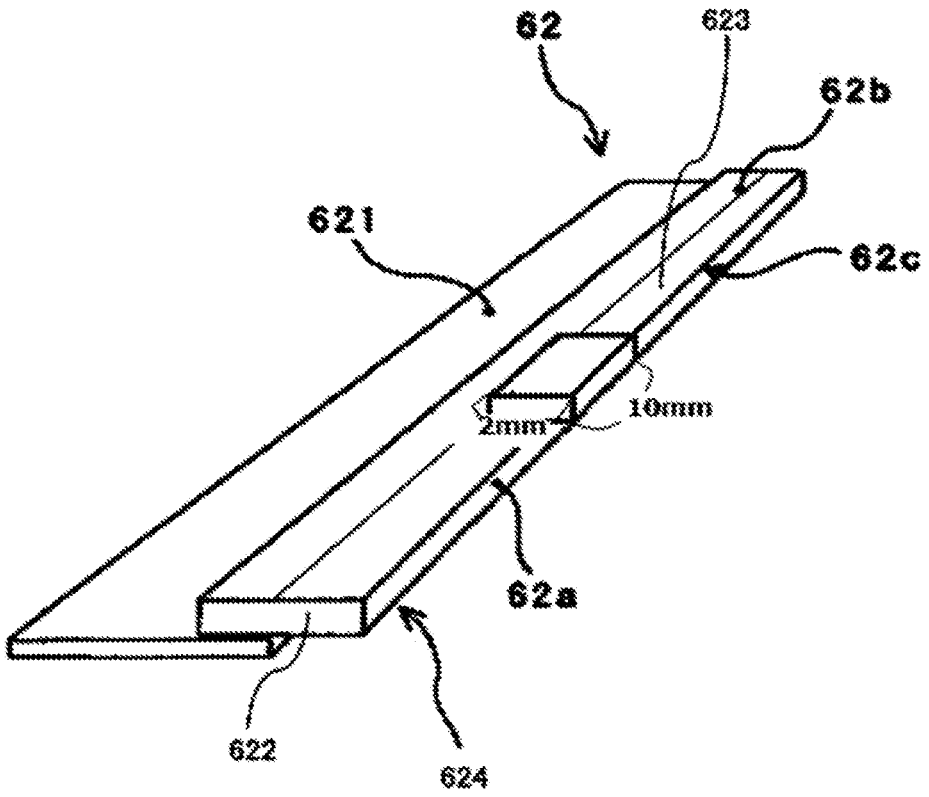
FIG. 9 is a view describing an example of a cutout section of the base material when Martens hardness (HM) of the base material is measured.
Figure 10A:
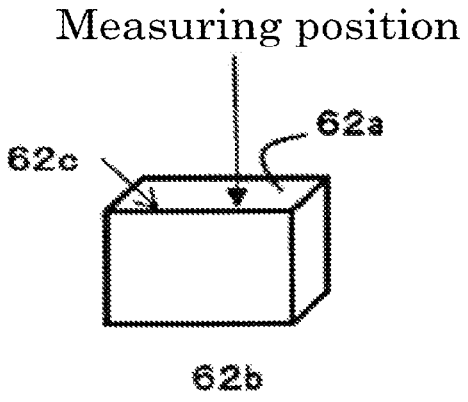
FIG. 10A is a schematic perspective view for describing an example of a measuring position of Martens hardness (HM) on the bae material.
Figure 10B:
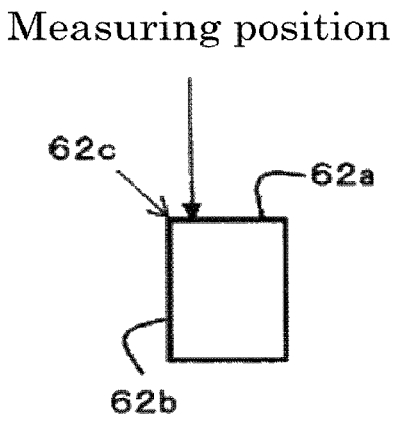
FIG. 10B is a schematic side view for describing an example of a measuring position of Martens hardness (HM) on the base material.
Figure 10C:
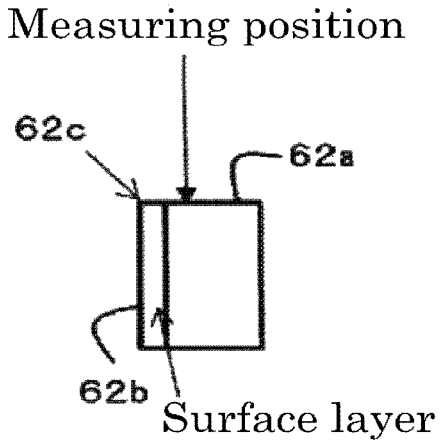
FIG. 10C is a schematic side view for describing another example of a measuring position of Martens hardness (HM) on the base material.

A method for measuring the Martens hardness (HM) of the base material is as follows. As illustrated in FIG. 9, first, the base material 622 is cut out into a rectangle that is 2 mm from the blade edge surface 62*a* of the base material 622 towards the depth direction of the base material 622 (the orthogonal direction of the longitudinal direction of the base material 622) and 10 mm towards the longitudinal direction. As illustrated in the perspective view of the base material of FIG. 10A and the front view of the base material of FIG. 10B, the base material cut out is fixed on a glass slide with an adhesive or a double-sided tape in a manner that the blade edge surface 62*a* faces upwards, and the Martens hardness (HM) can be measured at the position that is 100 μm in the depth direction from the tip ridgeline part 62*c*, as a measuring position. As illustrated in FIG. 10C, the Martens hardness (HM) can be similarly measured in the state where the surface layer is formed on the bottom surface of the base material.

Alternatively, the Martens hardness (HM) may be measured by curing the surface layer using a razor etc. to expose the edge surface of the base material.

<<Surface Layer>>

The surface layer is disposed in the elastic member and is to be in contact with a surface of an image bearer.

The surface layer may cover the entire surface of the base material. The surface layer is preferably formed over a region that is 1 mm or greater from the abutment along a planer direction of the bottom surface of the base material, and is more preferably formed over a region that is 1 mm or greater but 7 mm or less. Specifically, the surface layer preferably has a length of 1 mm or greater, more preferably 1 mm or greater but 7 mm or less where the length is a length from an edge of the surface layer to be in contact with the image bearer towards a direction substantially perpendicular to a direction along the length direction of the edge. Since the length of the surface layer along the direction substantially orthogonal to the length direction of the edge is 1 mm or greater, a contact state with the image bearer can be stabilized.

The average film thickness of the surface layer is not particularly limited and may be appropriately selected depending on the intended purpose. The average thickness is preferably 10 μm or greater but 500 μm or less. Since the average film thickness of the surface layer is 10 μm or greater but 500 μm or less, exposure of the base material of the elastic member can be prevented because the thickness of the surface layer is sufficiently thick even when the elastic member is abraded after use of a long period, an increase in torque or noise can be prevented, and these effects can be maintained. As a result, both reduction in curling and blade abrasion resistance can be achieved and excellent cleaning performance can be maintained over a long period. Since the blade material of the elastic member is prevented from being in contact with the image bearer, moreover, increase in torque or increase of load applied to rotations of the image bearer can be prevented. Even in the case where the image forming apparatus is a tandem system image forming apparatus, for example, an occurrence of color shift can be prevented. Note that, the image forming apparatus of the present disclosure is not limited to a tandem system.

Since the average film thickness of the surface layer of the abutment is 500 μm or less, flexibility of the elastic member of the base material is maintained, trackability against vibrations due to the axial runout of the image bearer or fine undulations of the surface of the image bearer, and therefore a cleaning failure can be prevented. Since the average thickness is 10 μm or greater, moreover, noise generated by abnormal abrasion etc. can be prevented.

The average film thickness of the surface layer at the abutment of the cleaning blade is more preferably 50 μm or greater but 200 μm or less. Since the average film thickness of the surface layer is 50 μm or greater but 200 μm or less, curl of an abutment does not easily occur at an initial stage, and abrasion can be kept within the surface layer even when the abrasion is progressed. Since exposure of the base material of the elastic member can be suppressed, therefore, curling, noise, or a cleaning failure does not easily occur even after usage of a long period.

The average film thickness of the surface layer of the abutment can be determined by an arithmetic mean value of values obtained by measuring the predetermined 10 points on the surface layer of the abutment. A measurement method of the film thickness of the surface layer is not particularly limited and may be appropriately selected depending on the intended purpose. Examples thereof include a method where a cross-section including the surface layer of the abutment is measured by means of a microscope. Specifically, for example, a thickness of the surface layer at the position that is from 50 μm through 200 μm from the tip of the abutment (abutted side). In addition, the measurement is typically performed on a position excluding the area that is 2 cm from each of the both edges along longitudinal direction (the direction of the abutted side).

<<<Martens Hardness (HM) of Surface Layer>>>

The Martens hardness A of the surface layer in the image forming apparatus of the present disclosure measured by applying a load of 1 μN to a predetermined position of the surface layer in a thickness direction of the surface layer using a nanoindenter and the Martens hardness B of the surface layer measured by applying a load of 1,000 μN to the predetermined position of the surface layer in the thickness direction of the surface layer using the nanoindenter are both 2.5 N/mm$^2$ or greater but 32.5 N/mm$^2$ or less, and Martens hardness A and Martens hardness B satisfy an inequality [Martens hardness A>Martens hardness B]. Specifically, the Martens hardness A under the conditions with which the load is to be 1 μN is larger than the Martens hardness B under the conditions with which the load is to be 1,000 μN, and the Martens hardness A and the Martens hardness B are both in the range of 2.5 N/mm$^2$ or greater but 32.5 N/mm$^2$ or less. Therefore, curling of the tip ridgeline part to be in contact with the image bearer and abrasion of the tip ridgeline part of the elastic member during usage can be suppressed, and excellent cleaning performance can be maintained over a long period.

Moreover, the surface layer preferably has inclination of hardness (hardness gradient) between a region which can be measured under the conditions that the load is to be 1 μN and a region which can be measured under the conditions that the load is to be 1,000 μN. Among the region which can be measured under the conditions that the load is to be 1 μN and the region which can be measured under the conditions that the load is to be 1,000 μN, the region which can be measured under the conditions that the load is to be 1,000 μN is at the back side (the side close to the base material) relative to a thickness direction of the surface layer.

The hardness gradient in the surface layer is not limited to a continuous hardness gradient along the thickness direction of the surface layer, and may be a discontinuous hardness gradient. For example, the discontinuous hardness gradient in the surface layer can be realized by forming a surface layer with a plurality of layers each having different Martens hardness.

When the Martens hardness of the surface layer measured by applying 50 μN of load to a predetermined position of the surface layer in a thickness direction of the surface layer using a nanoindenter is determined as Martens hardness C, the following inequality [Martens hardness A>Martens hardness C>Martens hardness B] is preferably satisfied. The formation of the hardness gradient in the surface layer can be surely confirmed by that the Martens hardness of the surface layer satisfies the inequality above.

For example, the Martens hardness of the surface layer can be measured in the following manner.

The Martens hardness is measured by means of a nanoindenter ENT-3100 available from ELIONIX INC. according to ISO14577 by pressing Berkovich indenter for 10 seconds at the predetermined load, retaining the pressure for 5 seconds, and releasing for 10 second at the same loading rate. The predetermined lead is at least one selected from the group consisting of 1 μN, 50 μN, and 1,000 μN.

As illustrated in FIG. 9, for example, the base material 622 is cut out into a rectangle that is 2 mm from the blade edge surface 62*a* of the base material 622 towards the depth direction of the base material 622 (the orthogonal direction of the longitudinal direction of the base material 622) and 10 mm towards the longitudinal direction. As illustrated in FIG. 10C, the base material is cut out in the state where a surface layer is formed on the bottom surface of the bae material, and the base material is fixed on a glass slide with an adhesive or a double-sided tape in a manner that the surface layer 623 faces upwards, and the measurement is performed. Note that, the measuring position is a position that is 20 μm along the depth direction from the tip ridgeline part. Note that, the measuring position is a position excluding an area that is 2 cm from each of the both ends.

Under the conditions that the load is 1 μN or greater but 1,000 μN or less, the Martens hardness of the surface layer of the present disclosure is 2.5 N/mm$^2$ or greater but 32.5 N/mm$^2$ or less, and preferably 4.0 N/mm$^2$ or greater but 21.0 N/mm$^2$ or less.

The Martens hardness A under the conditions that the load is 1 μN is preferably 7.5 $N/mm^2$ or greater but 32.5 $N/mm^2$ or less, and more preferably 17.0 $N/mm^2$ or greater but 21.0 $N/mm^2$ or less.

The Martens hardness B under the conditions that the load is 1,000 μN is preferably 2.5 $N/mm^2$ or greater but 9.5 $N/mm^2$ or less, and more preferably 3.5 $N/mm^2$ or greater but 5.0 $N/mm^2$ or less.

The Martens hardness C under the conditions that the load is 50 μN is preferably 4.0 $N/mm^2$ or greater but 18.0 $N/mm^2$ or less, and more preferably 7.0 $N/mm^2$ or greater but 12.0 $N/mm^2$ or less.

In view of improvement of the effect obtainable by the present disclosure, it is preferable that creep A of the surface layer of the present disclosure measured by applying a load of 1 μN to the predetermined position of the surface layer in the thickness direction of the surface layer using the nanoindenter and creep B measured by applying a load of 1,000 μN to the predetermined position of the surface layer in the thickness direction of the surface layer using the nanoindenter be both 3.0% or greater but 13.5% or less, and creep A and creep B satisfy the following inequality [creep A>creep B].

Under the conditions that the load is 1 μN or greater but 1,000 μN or less, the creep of the surface layer of the present disclosure is preferably 3.0% or greater but 13.5% or less, and more preferably 4.0% or greater but 21.0% or less.

The creep A under the conditions that the load is 1 μN is preferably 9.5% or greater but 13.5% or less, and more preferably 9.5% or greater but 12.0% or less.

The creep B under the conditions that the load is 1,000 μN is preferably 3.0% or greater but 7.5% or less, and more preferably 3.0% or greater but 6.5% or less.

The creep C under the conditions that the load is 50 μN is preferably 6.0% or greater but 11.0% or less, and more preferably 6.0% or greater but 9.5% or less.

The creep (CIT) of the surface layer can be measured in the same manner as the measurement of the Martens hardness (HM). Specifically, the creep can be measured by means of a nanoindenter ENT-3100 available from ELIONIX INC. according to ISO14577 by pressing Berkovich indenter for 10 seconds at a load of 1,000 μN, retaining the pressure for 5 seconds, and releasing for 10 second at the same loading rate.

As illustrated in FIG. 10C, for example, the base material is cut out in the state where the surface layer is formed on the bottom surface of the base material, and the base material is fixed onto a glass slide in a manner that the surface layer 623 faces upwards with an adhesive or a double-sided tape. Note that, the measuring position is set to a position that is 20 μm from the tip ridgeline part in the depth direction. Note that, the measuring position is the position excluding an area that is 2 cm from each of the both ends.

The Martens hardness of the surface layer is preferably harder than that of the base material. Since the surface layer is a member having the higher hardness than that of the base material of the elastic member and is rigid, the surface layer does not easily deform and can suppress curling of a tip ridgeline part of the cleaning blade.

A method for curing the curable composition of the surface layer formed at the abutment of the cleaning blade is not particularly limited and may be appropriately selected depending on the intended purpose. Examples thereof include a heating treatment.

The elastic power of the cleaning blade is preferably 60% or greater but 90% or less. The elastic power is a characteristic value determined from the integrated stress at the time of the measurement of the Martens hardness in the following manner. The Martens hardness is measured, for example, by means of a micro hardness meter with pressing the Berkovich indenter with the constant force for 30 seconds, retaining the force for 5 seconds, and releasing the Berkovich indenter with the constant force for 30 seconds.

Figure 4:
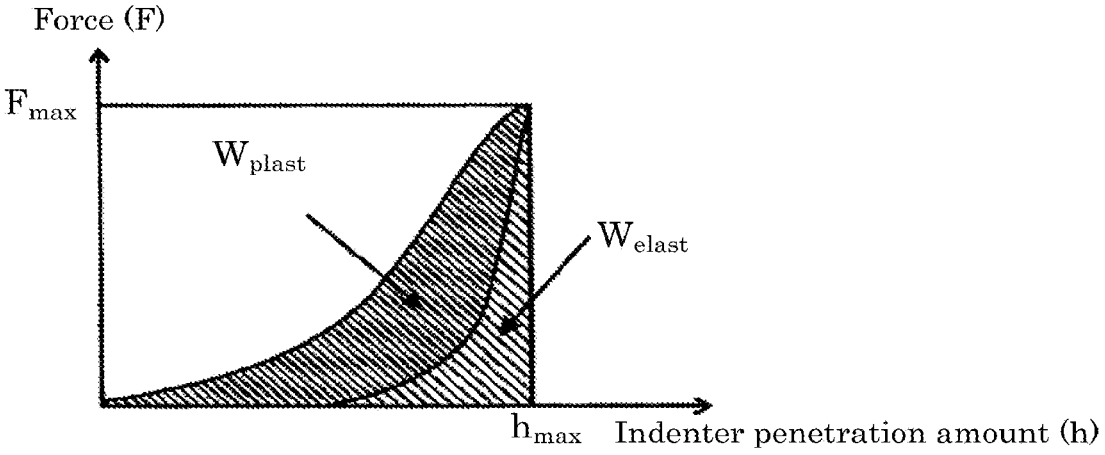
FIG. 4 is an exemplary view illustrating an example of a relationship between force for pressing an indenter and an amount of the indenter pressed when elastic power is calculated.

When the integrated stress for pressing the Berkovich indenter is determined as Wplast, and the integrated stress at the time when the test load is released is determined as Welast, elastic power is a characteristic value represented by the formula: Welast/Wplast×100[%] (see FIG. 4). The higher the elastic power is the less plastic deformation is, i.e., the higher rubber characteristics are. When the elastic power is 60% or greater, the movement of the abutment is not suppressed, and excellent abrasion resistance is obtained.

<<<Coefficient of Dynamic Friction (μk) of Surface Layer>>>

The coefficient of dynamic friction of the surface layer against polycarbonate is 0.5 or less. When the coefficient of dynamic friction thereof is 0.5 or less, curling of the edge of the cleaning blade can be prevented, and chipping of the blade caused by the toner entered the nip can be prevented.

For example, the coefficient of dynamic friction of the surface layer against the polycarbonate can be measured in the following manner.

The cleaning blade is pressed (cleaning angle: 79°, linear pressure: 20 g/cm) against a metal plate member on a surface of which a polycarbonate sheet having an average thickness of 150 μm is arranged. The cleaning blade is moved at the speed of 20 mm/s to measure a coefficient of dynamic friction (μk) by means of a load-variable friction and abrasion test system (TYPE: HHS2000, available from SHINTO Scientific Co., Ltd.).

The surface layer is preferably formed to include a curable composition.

<Curable Composition>

The curable composition used for the surface layer is a material that forms a cured product (solid polymer) through polymerization curing of monomers or oligomers upon application of light of heat. An energy source varies depending on a type of an initiator or stimuli (electron beam) for generating active species (e.g., radicals, ions, acids, and bases) to initiate polymerization. Examples of the curable composition include a UV-curable composition, a heat-curable composition, and an electron beam-curable composition.

The UV-curable composition and electron beam-curable composition each use a photopolymerization initiator and carry out a curable reaction, such as radical polymerization, cation polymerization, and anion polymerization, upon irradiation of UV rays or electron beams, to thereby produce a cured product through a polymerization reaction, such as vinyl polymerization, vinyl copolymerization, ring-opening polymerization, and addition polymerization.

The heat-curable composition includes a thermal polymerization initiator and initiates a curable reaction upon heating. The heat-curable composition generates a cured product through a polymerization reaction, such as an isocyanate reaction, radical polymerization, epoxy ring-opening polymerization, and melamine-based condensation.

The cured product generated by such a reaction is not particularly limited and may be appropriately selected depending on the intended purpose. Examples thereof include an acrylic resin, a phenol resin, a urethane resin, an epoxy resin, a silicone resin, an amino resin, and a resin composition having a polyethylene skeleton. However, a polyurethane-based compound, such as a urethane resin, is preferable because excellent abrasion resistance is obtained, affinity or adhesion of the base material to urethane rubber is excellent, and moreover, physical properties, such as hardness and elastic power, can be easily adjusted by controlling NCO groups and OH groups.

Specifically, the surface layer preferably further includes a polyurethane-based compound. Since the surface layer includes a polyurethane-based compound, abrasion resistance, and affinity or adhesion of the base material to urethane rubber can be improved, and physical properties, such as hardness and elastic power, can be easily adjusted by controlling NCO groups and OH groups.

The urethane resin is not particularly limited and may be appropriately selected depending on the intended purpose. The urethane resin is preferably a combination of prepolymer including a NCO group at both terminals, and a curing agent (compound including a $NH_2$ group or an OH group). The prepolymer including a NCO group at both terminals is more preferably a prepolymer in which polyfunctional isocyanate is bonded to each of both ends of polytetramethylene ether glycol (PTMG).

The polyfunctional isocyanate of the prepolymer is not particularly limited and may be appropriately selected depending on the intended purpose. Examples thereof include methylene diphenyl diisocyanate (MDI), tolylene diisocyanate (TDI), xylylene diisocyanate (XDI), naphthylene 1,5-diisocyanate (NDI), tetramethylxylene diisocyanate (TMXDI), isophorone diisocyanate (IPDI), hydrogenated xylylene diisocyanate (H6XDI), dicyclohexylmethane diisocyanate (H12MDI), hexamethylene diisocyanate (HDI), dimer diisocyanate (DDI), norbornene diisocyanate (NBDI), and trimethylhexamethylene diisocyanate (TMDI). The above-listed examples may be used alone by bonding to PTMG, or may be formed into isocyanurate for use.

The curing agent is a compound reactive with the prepolymer, such as diol, triol, diamine, and triamine. Examples of the curing agent include trimethylolpropane (TMP), and diaminodiphenylmethane (DDM). The above-listed examples may be used alone or in combination.

The degree of polymerization of PTMG of the prepolymer is not particularly limited and may be appropriately selected depending on the intended purpose.

For example, continuous gradient of hardness of the surface layer can be formed in the following manner. The hardness of the surface layer can be increased by making an equivalent ratio (equivalent of NCO groups in the prepolymer/equivalent of $NH_2$ groups or OH groups in the curing agent) of the curable composition higher than 1 to increase isocyanurate bonds in the curable resin using excess NCO groups, to thereby increase crosslink density. When the number of isocyanurate bonds are homogeneously increased over the entire curable composition, the surface layer becomes too hard entirely, and may become brittle. In the present disclosure, therefore, an amount of isocyanurate bonds in the curable composition at the side of the surface of the surface layer is preferably larger than an amount of isocyanurate bonds in the curable composition at the side of the bottom surface of the base material. A hardness gradient where the hardness is decreased from the surface of the surface layer towards the bottom surface of the base material along the film thickness direction by forming the surface layer in the above-described manner. The surface layer at the side of the bottom surface of the base material has hardness close to the hardness of the soft base material, and therefore a quality as a blade, such as trackability, is stabilized. In order to increase an amount of isocyanurate bonds in the curable composition at the surface side of the surface layer, for example, after applying the curable composition onto the base material, the resultant is left to stand a high temperature and high humidity environment, such as 45° C./90% RH for a few days to complete reactions of excess NCO groups, in this manner, generation of cyanurate can be progressed more at the surface side of the surface layer than the curable composition at the side of the bottom surface of the base material.

The surface layer preferably includes a siloxane-based compound. The siloxane-based compound is not particularly limited and may be appropriately selected depending on the intended purpose. The siloxane-based compound is preferably modified silicone oil. Use of the modified silicone oil decreases a coefficient of friction of the blade to decrease friction force at the time of sliding to thereby reduce abrasion of the blade, and stabilizes the behavior of the blade tip at the time of sliding. In an embodiment where the polyurethane-based compound is used, moreover, use of the modified silicone oil can accelerate stabilization of behavior of the blade tip because the polyurethane-based compound is typically hard.

Examples of the modified silicone oil include polyether-modified silicone oil, and alkyl-modified silicone oil. As the modified silicone oil, commercial products can be used. Examples thereof include SH8400 (polyether-modified silicone oil, available from Dow Corning Toray Co., Ltd.), FZ-2110 (polyether-modified silicone oil, available from Dow Corning Toray Co., Ltd.), SF8416 (alkyl-modified silicone oil, available from Dow Corning Toray Co., Ltd.), SH3773M (polyether-modified silicone oil, available from Dow Corning Toray Co., Ltd.), and X-22-4272 (polyether-modified silicone oil, available from Shin-Etsu Chemical Co., Ltd.).

An amount of the siloxane-based compound in the surface layer is not particularly limited and may be appropriately selected depending on the intended purpose. The amount thereof is preferably 4 parts by mass or greater but 15 parts by mass or less, and more preferably 8 parts by mass or greater but 10 parts by mass. Specifically, the surface layer includes a siloxane-based compound, and an amount of the siloxane-based compound relative to 100 parts by mass of the surface layer is preferably 4 parts by mass or greater but 15 parts by mass or less, and more preferably 8 parts by mass or greater but 10 parts by mass or less.

Since the amount of the siloxane-based compound in the surface layer is 4 parts by mass or greater, the coefficient of dynamic friction can be kept small. Since the amount thereof is 15 parts by mass or less, bleeding to the surface can be prevented.

The cleaning blade 62 of the present embodiment can suppress curling of the ridgeline part 62*c* of the elastic member to be in contact with the surface of the image bearer, has little abrasion of the tip ridgeline part 62*c* of the elastic member at the time of use, and can maintain excellent cleaning performance over a long period. Therefore, the cleaning blade 62 can be widely used in various fields. The cleaning blade 62 is particularly suitably used in a process cartridge and image forming apparatus described below.

<Production Method of Cleaning Blade>

In the art, a known blade produced by spray coating or dip coating may have difficulty to form a thick film of a surface layer at an abutment thereof. Even when there is a film having a thickness of 10 μm near the abutment, a film at the abutment only has a thickness of from 1 μm through 3 μm. Because of the above-described deposition of the film, the abutment is rounded, and edge precision is poor. This is likely a reason why cleaning performance becomes poor.

Moreover, Japanese Patent No. 5515865, which is an example of the related art, discloses a production method of a cleaning blade. The production method includes, after dipping a long sheet material formed of polyurethane rubber with a dipping agent, cutting the resultant, further applying a coating agent including a resin, and curing the coating agent to form a coating film. In this case, a film thickness at the edge is thin because the coating film is applied later, and therefore there is a possibility that torque may increase over time. In Japanese Patent No. 2962843, moreover, a cleaning blade having a coating layer including lubricity particles is produced by cutting an edge after forming the coating layer. According to the technology disclosed in Japanese Patent No. 2962843, however, surface roughness of the coating layer is large as the lubricity particles are dispersed therein. Therefore, edge precision is poor even through the edge is cut after forming the coating layer, and cleaning performance may be deteriorated.

On the other hand, the cleaning blade 62 of the present embodiment is formed, for example, by applying a curable composition for forming a surface layer 623 onto a base material 622 formed of urethane rubber, and curing the curable composition with heat. Thereafter, an abutment is cut to form into a blade shape.

The surface layer 623 can be formed by covering at least the tip ridgeline part 62*c* of the cleaning blade 62 with the curable composition through spray coating, dip coating, die coating, etc.

The surface layer of the bottom surface of the base material can be formed by bar coating, spray coating, dip coating, brush coating, screen printing, etc. A film thickness of the surface layer can be controlled by appropriately changing conditions, such as a solid content of a coating liquid, coating conditions (bar coating: gap, spray coating: ejection amount, distance, traveling speed, dip coating: drawing speed), the number of coatings, etc.

Figure 3A:
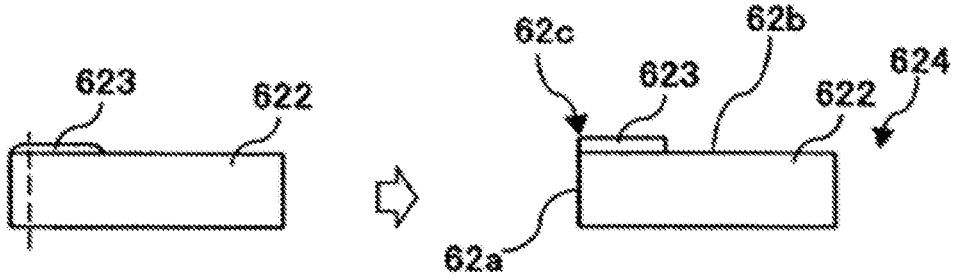
FIG. 3A is a view for describing an example of a production method of the cleaning blade of the image forming apparatus of the present disclosure.
Figure 3B:
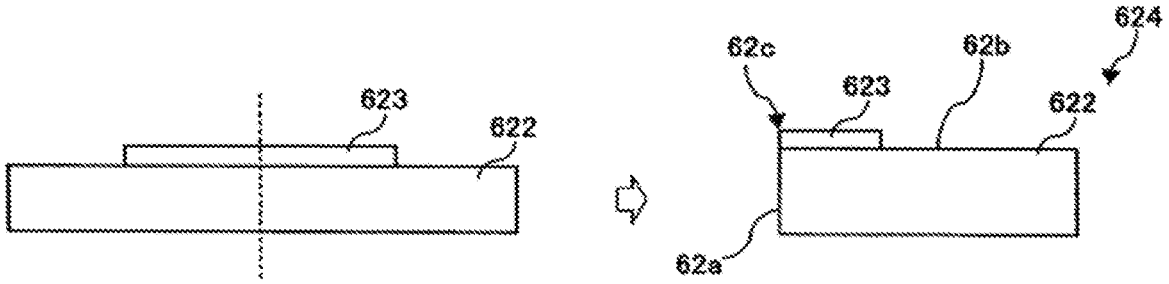
FIG. 3B is a view for describing another example of the production method of the cleaning blade of the image forming apparatus of the present disclosure.

Part of the production method of the cleaning blade of the present embodiment is illustrated in FIGS. 3A and 3B. FIGS. 3A and 3B are views where the elastic member of the cleaning blade is observed from the side. The view on the left side of FIG. 3A illustrates a state where a curable composition is applied and cured on the base material 622, and an edge surface of the base material 622 is sliced as illustrated with a dashed line to thereby produce an elastic member 624 illustrated at the right side of FIG. 3A. A portion to be sliced can be appropriately changed. For example, the base material is sliced at the position that is 1 mm from the edge.

Moreover, another example of the production method of the cleaning blade of the present disclosure is illustrated in FIG. 3B. Similarly to FIG. 3A, the view on the left side of FIG. 3B illustrates a state where a curable composition is applied and cured on the base material 622. According to the method illustrated in FIG. 3B, the base material 622 is sliced at a position around a center thereof without cutting the edge surface of the base material 622 as in FIG. 3A. In this case, two cleaning blades can be produced at once.

Note that, other than the methods described above, a method where a curable composition is cured using a mold to form a perpendicular abutment may be used.

A method for slicing the base material 622 and the surface layer 623 can be appropriately changed. For example, a vertical slicer etc. can be used.

Moreover, the direction for slicing may be appropriately changed. The base material 622 is preferably sliced from the side of the surface layer 623 to the side of the base material 622. In this case, the edge precision can be improved.

In the present embodiment, after forming a thick film of the surface layer 623 on the bottom surface of the base material, the edge is cut off to obtain both a thick film of the abutment and the edge precision.

<Image Bearer>

The image bearer bears an electrostatic latent image on a surface thereof. Note that, the image bearer may be referred to as a photoconductor hereinafter.

A material, shape, structure, size, etc. of the image bearer are not particularly limited and may be appropriately selected depending on the intended purpose. Examples of the shape of the image bearer include a drum shape, a belt shape, a flat plate shape, and sheet shape. The size of the image bearer is not particularly limited and may be appropriately selected depending on the intended purpose. The size is preferably a size typically used.

The material of the image bearer is not particularly limited and may be appropriately selected depending on the intended purpose. Examples thereof include metals, plastics, and ceramics.

<Toner>

The toner used in the image forming apparatus of the present disclosure includes a polyester resin insoluble to tetrahydrofuran (THF). A glass transition temperature (Tg) of the THF-insoluble component of the toner determined from a DSC curve of first heating of differential scanning calorimetry (DSC) is −60° C. or higher but 20° C. or lower.

In order to improve low-temperature fixability of the toner, a glass transition temperature of a binder resin of the toner can be lowered. However, it is easily expected that heat resistant storage stability of the toner is deteriorated when the glass transition temperature of the binder resin is low. When the glass transition temperature of the polyester resin that is a polymer insoluble to THF or a three-dimensional crosslinked product, namely, a gel component, is reduced, the toner exhibits rubber-like behaviors. Therefore, excessive flow of the toner can be suppressed while the toner can be deformed in a low-temperature range. When the glass transition temperature of the THF-insoluble component is lower than −60° C., however, the glass transition temperature of the toner becomes too low, and therefore it is not preferable in view of heat resistant storage stability. When the glass transition temperature of the THF-insoluble component is higher than 20° C., on the other hand, low-temperature fixability tends to be deteriorated. The glass transition temperature of the THF-insoluble component is more preferably −50° C. or higher but 10° C. or lower, and particularly preferably −40° C. or higher but 0° C. or lower.

Moreover, the glass transition temperature of the toner is preferably 40° C. or higher but 65° C. or lower, and particularly preferably 45° C. or higher but 60° C. or lower.

When a glass transition temperature of the polyester resin included in the toner is room temperature or lower, the glass transition temperature of the toner can be controlled to 40° C. or higher but 65° C. or lower by using another polyester resin having a glass transition temperature of room temperature or higher in combination. When the glass transition temperature of the toner is 40° C. or higher, heat resistant storage stability can be improved. When the glass transition temperature of the toner is 65° C. or less, low-temperature fixability can be improved.

A gel component in the toner preferably maintains a rubber state in a temperature environment in which the toner is usable. Specifically, the storage elastic modulus (G') of the THF-insoluble component of the toner at a temperature of 40° C. or higher but 120° C. or lower as measured by dynamic viscoelasticity measurement is preferably $1\times10^5$ Pa or greater but $3\times10^7$ Pa or less. As a result, the toner exhibits rubber-like behaviors even when the glass transition temperature of the polyester resin is room temperature or lower, and therefore desirable heat resistant storage stability and mechanical durability can be exhibited. Moreover, a preferable numerical value range is $3\times10^5$ Pa or greater but $5\times10^6$ Pa or less.

As a method for obtaining the THF-insoluble component of the toner, there are a dissolution filtration method, and a method for obtaining extraction residues using a typical Soxhlet extraction method. The method is appropriately selected depending on the intended purpose. In the present embodiment, a THF-insoluble component is obtained according to a dissolution filtration method described below.

First, the toner is weighed by 1 g, and the toner is added to 100 mL of THF. The resultant mixture is stirred by a stirrer for 6 hours in an environment of 25° C., to thereby obtain a solution in which a soluble component of the toner is dissolved. Subsequently, the solution is filtered through a membrane filter having an opening size of 0.2 μm. The filtration residues are again added to 50 mL of THF, and the resultant mixture is stirred by a stirrer for 10 minutes. This operation is repeated twice or three times. The obtained filtration residues are dried in an environment of 120° C. and 10 kPa to thereby obtain a THF-insoluble component.

In the case where the Soxhlet extraction method is used, it is desirable that reflux be performed for 6 hours or longer using 100 parts of THF relative to 1 part of the toner, to separate a THF-insoluble component and a THF-soluble component.

Glass transition temperatures of the toner used in the image forming apparatus of the present disclosure, the THF-insoluble component of the toner, and the resin can be measured by means of a differential scanning calorimeter (DSC) (e.g., Q-200, available from TA Instruments Japan Inc.).

Specifically, a sample pan formed of aluminium is charged with 5.0 mg of a target sample, the sample pan is placed on a holder unit, and the holder unit is set in an electric furnace. As a reference, 10 mg of alumina is used. Similarly to the sample, a sample pan formed of aluminium is charged with 10 mg of alumina. A measurement is performed in the following manner. The sample is heated in a nitrogen atmosphere from −80° C. to 150° C. at a heating rate of 10° C./min (this process is referred to as first heating). Subsequently, the sample is cooled from 150° C. to −80° C. at a cooling rate of 10° C./min (cooling process), followed by heating again to 150° C. at a heating rate of 10° C./min (this process is referred to as second heating). A change in generation and absorption of heat during the above-mentioned processes is measured, and a graph plotting a temperature and an endothermic or exothermic value is drawn to obtain DSC curves.

The obtained DSC curves are analyzed using an analysis program installed in the Q-200 system to select a DSC curve for first heating. A glass transition temperature of the target sample is determined from an intersection point of an extended line of a base line of the DSC curve of the temperature lower than enthalpy relaxation of an endothermic value, and a tangent of the maximum angle of inclination at enthalpy relaxation. When the sample has a melting point, a peak top temperature of the endothermic value of the DSC curve of the first heating is determined as a melting point.

Storage elastic moduli of the toner used in the image forming apparatus of the present disclosure, the THF-insoluble component of the toner, and the resin can be measured by means of a dynamic viscoelasticity measuring device (e.g., ARES, available from TA Instruments Japan Inc.).

Specifically, first, a target sample is formed into a pellet having a diameter of 8 mm and a thickness of from 1 mm through 2 mm. In case of pressure molding, the sample is sufficiently pressed no to form voids inside a pellet. Moreover, molding is performed optionally with heating and melting the sample. The obtained sample is fixed onto a parallel plate having a diameter of 8 mm set inside the device, and is adhered to the parallel plate at a temperature equal to or higher than the glass transition temperature of the sample. Thereafter, the sample is stabilized at 30° C. The measurement is performed by heating from 30° C. to 200° C. at a heating rate of 2.0° C./min at a frequency of 1 Hz (6.28 rad/s), and a strain amount of 0.1% (strain amount controlling mode).

The weight average particle diameter (Dv) of the toner is not particularly limited and may be appropriately selected depending on the intended purpose. In order to obtain a high quality image having excellent granularity, sharpness, and fine line reproducibility, the weight average particle diameter is preferably 3 μm or greater but 10 μm or less, and more preferably 4 μm or greater but 7 μm or less. When the weight average particle diameter is less than 3 μm, excellent sharpness and fine line reproducibility of an image can be obtained, but flowability and transfer properties of the toner are poor.

Moreover, the ratio (Dv/Dn) of the weight average particle diameter (Dv) to the number average particle diameter (Dn) represents a particle size distribution of the toner. When the value of the ratio is closer to 1, the particle size distribution is sharper. The Dv/Dn is preferably 1.20 or less, and more preferably 1.15 or less in view of sharpness and fine-line reproducibility.

The weight average particle diameter (Dv) and number average particle diameter (Dn) of the toner of the present disclosure can be measured, for example, by means of Coulter Multisizer III (aperture diameter: 100 μm) (available from Beckman Coulter, Inc.) with analysis software, Beckman Coulter Multisizer 3 (version 3.51) (available from Beckman Coulter, Inc.).

Specifically, first, 10 mg of a measurement sample is added to 5 mL of a 10% by mass surfactant (alkyl benzene sulfonate, NEOGEN SC-A, available from DKS Co., Ltd.), and the mixture is dispersed for 1 minute by means of an ultrasonic disperser. Thereafter, 25 mL of ISOTON III (available from Beckman Coulter, Inc.) that is an electrolytic solution, is added. The resultant mixture is dispersed for 1 minute by means of an ultrasonic disperser, to thereby prepare a sample dispersion liquid. Subsequently, a beaker is charged with 100 mL of the electrolytic solution and an appropriate amount of the sample dispersion liquid, to measure particle diameters of 30,000 particles at a concentration with which particle diameters of the 30,000 particles can be measured for 20 seconds. From the obtained particle size distribution, a weight average particle diameter (Dv) and a number average particle diameter (Dn) are determined.

<<Polyester Resin>>

The toner used for the image forming apparatus of the present disclosure includes a polyester resin insoluble to tetrahydrofuran (THF). The polyester resin insoluble to tetrahydrofuran (THF) may be referred to as a polyester resin (A) hereinafter.

The polyester resin (A) is not particularly limited and may be appropriately selected depending on the intended purpose, as long as the polyester resin (A) is a resin insoluble to THF. The polyester resin (A) is preferably a resin exhibiting rubber-like behaviors in a usable temperature environment for the toner. Therefore, the polyester resin (A) is preferably a polyester resin that has a cross-link structure, has a glass transition temperature in a low-temperature region of 20° C. or lower, and exhibits viscoelastic behaviors, such as having a rubber-like flat region, in an environment of a room temperature or higher.

Moreover, the polyester resin (A) preferably includes a urethane bond, or a urea bond, or both. Since the polyester resin (A) includes a urethane bond, or a urea bond, or both, a resin having excellent rubber elasticity is obtained owing to intermolecular cohesive force, and a toner having excellent heat resistant storage stability and mechanical durability can be obtained. Moreover, a storage elastic modulus of the THF-insoluble component of the toner can be controlled by adjusting a concentration of a urethane bond or a urea bond in the polyester resin (A).

The polyester resin (A) can be obtained by any method. For example, the polyester resin (A) can be obtained by allowing a reactive precursor (may be referred to as a "prepolymer" hereinafter) and a curing agent to react.

A method for introducing the polyester resin (A) into the toner is not particularly limited and may be appropriately selected depending on the intended purpose. For example, the polyester resin (A) having a crosslink structure obtained by a reaction may be introduced into the toner. Alternatively, the polyester resin (A) having a crosslink structure may be introduced into the toner while a reactive precursor and a curing agent are allowed to react within particles of the toner during the production of the toner. Among the above-listed examples, to introduce the polyester resin (A) having a crosslink structure into the toner while the reactive precursor and the curing agent are allowed to react within the particles of the toner is preferable because the polyester resin (A) is uniformly introduced into the toner, and uniform quality of the toner can be obtained.

The reactive precursor is not particularly limited and may be appropriately selected depending on the intended purpose, as long as the reactive precursor is a polyester resin having a group reactive with the curing agent.

Examples of the group reactive with the curing agent in the precursor include groups reactive with an active hydrogen group.

Examples of the groups reactive with an active hydrogen group include an isocyanate group, an epoxy group, carboxylic acid, and an acid chloride group. Among the above-listed examples, an isocyanate group is preferable because a urethane bond or a urea bond can be introduced into the amorphous polyester resin.

The reactive precursor may have a branched structure that is formed by trivalent or higher alcohol, or trivalent or higher carboxylic acid, or both.

Examples of the polyester resin including an isocyanate group include a reaction product between a polyester resin having an active hydrogen group and polyisocyanate.

The polyester resin having an active hydrogen group can be obtained, for example, through polycondensation between diol, dicarboxylic acid, and trivalent or higher alcohol and/or trivalent or higher carboxylic acid.

The trivalent or higher alcohol and the trivalent or higher carboxylic acid give a branched structure to a polyester resin including an isocyanate group.

Examples of the diol include: aliphatic diols, such as ethylene glycol, 1,2-propyleneglycol, 1,3-propyleneglycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; diol having an oxyalkylene group, such as diethylene glycol, triethylene glycol, dipropyleneglycol, polyethylene glycol, polypropylene glycol, and polytetramethylene glycol; alicyclic diol, such as 1,4-cyclohexane dimethanol, and hydrogenated bisphenol A; alkylene oxide (e.g., ethylene oxide, propylene oxide, and butylene oxide) adducts of alicyclic diol; bisphenols, such as bisphenol A, bisphenol F, and bisphenol S; and alkylene oxide adducts of bisphenols, such as alkylene oxide (e.g., ethylene oxide, propylene oxide, and butylene oxide) adducts of bisphenols. Among the above-listed examples, for the purpose of controlling a glass transition temperature of the polyester resin (A) to 20° C. or lower, aliphatic diol having 3 or more but 10 or less carbon atoms, such as 1,2-propyleneglycol, 1,3-propyleneglycol, 1,4-butanediol, 2-methyl-1,3-propanediol, 1,5-pentanediol, and 3-methyl-1,5-pentanediol, is preferably used, and the diol is more preferably used in the amount of 50 mol % or greater relative to the alcohol component in the resin. The above-listed diols may be used alone or in combination.

The polyester resin (A) is preferably an amorphous resin. When steric hindrance is given to a resin chain, moreover, melt viscosity during fixing decreases, and low-temperature fixability is easily exhibited. Therefore, the principal chain of the aliphatic diol preferably has a structure represented by General Formula (1) below.

$$HO\text{-}(\text{-}CR_1R_2\text{-})_n\text{-}OH \qquad \text{General Formula (1)}$$

[In General Formula (1), $R_1$ and $R_2$ are each independently a hydrogen atom or an alkyl group having from 1 through 3 carbon atoms, and n is an odd number of from 3 through 9, with the proviso that $R_1$ and $R_2$ may be identical or different in the repeating units in the number of n.]

Specifically, the polyester resin is preferably a polyester resin including an alcohol component that includes 50 mol % or greater of aliphatic diol having from 3 through 10 carbon atoms, and includes a structure represented by General Formula (1) in the principal chain of the aliphatic diol.

The principal chain of the aliphatic diol is a carbon chain linking two hydroxyl groups included in the aliphatic diol with the minimum number of carbon atoms.

When the number of carbon atoms of the principal chain is an odd number, it is preferable because crystallinity reduces due to parity. In the case where a side chain includes at least one alkyl group having from 1 through 3 carbon atoms, it is preferable because interaction energy between molecules of the principal chain decreases due to a steric effect.

Examples of the dicarboxylic acid include: aliphatic dicarboxylic acid, such as succinic acid, adipic acid, sebacic acid, dodecanedioic acid, maleic acid, and fumaric acid; and aromatic dicarboxylic acid, such as phthalic acid, isophthalic acid, terephthalic acid, and naphthalene dicarboxylic acid. Moreover, anhydrides thereof, lower (the number of carbon atoms: from 1 through 3) alkyl esters thereof, and halogenated products thereof may be used. Among the above-listed examples, aliphatic dicarboxylic acid having 4 or more but 12 or less carbon atoms is preferable for the purpose of controlling Tg of the polyester resin (A) to 20° C. or lower. It is more preferable that the aliphatic dicarboxylic acid be used in the amount of 50% by mass or greater of the carboxylic acid component in the resin. The above-listed dicarboxylic acids may be used alone or in combination.

Examples of the trivalent or higher alcohol include: trivalent or higher aliphatic alcohols, such as glycerin, trimethylolethane, trimethylolpropane, pentaerythritol, and sorbitol; trivalent or higher polyphenols, such as trisphenol PA, phenol novolac, and cresol novolac; and alkylene oxide adducts of trivalent or higher polyphenols, such as alkylene oxide (e.g., ethylene oxide, propylene oxide, and butylene oxide) adducts of trivalent or higher polyphenols.

Examples of the trivalent or higher carboxylic acid include trivalent or higher aromatic carboxylic acid. Trivalent or higher aromatic carboxylic acid having 9 or more but 20 or less carbon atoms, such as trimellitic acid and pyromellitic acid, are particularly preferable. Moreover, anhydrides thereof, lower (the number of carbon atoms: from 1 through 3) alkyl esters thereof, and halogenated products thereof may be used.

The polyisocyanate is not particularly limited and may be appropriately selected depending on the intended purpose. Examples thereof include: aromatic diisocyanate, such as 1,3- and/or 1,4-phenylenediisocyanate, 2,4- and/or 2,6-tolylene diisocyanate (TDI), crude TDI, 2,4'- and/or 4,4'-diphenylmethane diisocyanate (MDI), crude MDI [a phosgenation product of crude diaminophenylmethane [condensation product of formaldehyde and aromatic amine (aniline) or a mixture thereof; a mixture of diaminodiphenylmethane and a small amount (e.g., from 5% by mass through 20% by mass) of trifunctional or higher polyamine]: polyallyl polyisocyanate (PAPI)], 1,5-naphthylenediisocyanate, 4,4',4"-triphenylmethanetriisocyanate, and m- and p-isocyanatephenylsulfonylisocyanate; aliphatic diisocyanate, such as ethylene diisocyanate, tetramethylene diisocyanate, hexamethylene diisocyanate (HDI), dodecamethylene diisocyanate, 1,6,11-undecanetriisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-diisocyanatohexanoate; alicyclic diisocyanate, such as isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, and 2,5- or 2,6-norbornane diisocyanate; aromatic aliphatic diisocyanate, such as m- or p-xylylene diisocyanate (XDI), α,α,α',α'-tetramethylxylylenediisocyanate (TMXDI); trivalent or higher polyisocyanate, such as lysine triisocyanate, and diisocyanate modified products of trivalent or higher alcohol; and modified products of the above-listed isocyanates. The above-listed examples may be used as a mixture of two or more. Examples of the modified products of the above-listed isocyanates include modified products including a group, such as a urethane group, a carbodiimide group, an allophanate group, a urea group, a biuret group, an uretdione group, an uretoimine group, an isocyanurate group, and an oxazolidone group.

The curing agent is not particularly limited and may be appropriately selected depending on the intended purpose. Examples thereof include an active hydrogen group-containing compound.

Examples of the active hydrogen group in the active hydrogen group-containing compound include a hydroxyl group (an alcoholic hydroxyl group and a phenolic hydroxyl group), an amino group, a carboxyl group, and a mercapto group. The above-listed examples may be used alone or in combination.

The active hydrogen group-containing compound is preferably amines because a urea bond can be formed.

Examples of the amines include: aromatic diamine, such as phenylenediamine, diethyltoluenediamine, and 4,4'-diaminodiphenylmethane; alicyclic diamine, such as 4,4'-diamino-3,3'-dimethyldicyclohexylmethane, diaminocyclohexane, and isophoronediamine; aliphatic diamine, such as ethylene diamine, tetramethylene diamine, and hexamethylene diamine; trivalent or higher amine, such as diethylene triamine, and triethylene tetramine; amino alcohol, such as ethanol amine, and hydroxyethyl aniline; aminomercaptan, such as aminoethylmercaptan, and aminopropylmercaptan; amino acid, such as amino propionic acid, and amino caproic acid; ketamine compounds obtained by blocking amino groups of the above-listed amines with ketones (e.g., acetone, methyl ethyl ketone, and methyl isobutyl ketone); and oxazoline compounds. The above-listed examples may be used alone or in combination. Among the above-listed examples, diamine, and a mixture of diamine and a small amount of trivalent or higher amine are preferable.

A glass transition temperature of the polyester resin (A) determined from a DSC curve of first heating in differential scanning calorimetry (DSC) is largely influenced by a glass transition temperature of a THF-insoluble component of the toner. Therefore, the glass transition temperature of the polyester resin (A) determined from a DSC curve of first heating in differential scanning calorimetry (DSC) is preferably −60° C. or higher but 20° C. or lower, more preferably −50° C. or higher but 10° C. or lower, and particularly preferably −40° C. or higher but 0° C. or lower.

When the glass transition temperature of the polyester resin (A) is −60° C. or higher, a glass transition temperature of the toner is not too low, and heat resistant storage stability can be improved. When the glass transition temperature of the polyester resin (A) is 20° C. or lower, low-temperature fixability can be improved.

The storage elastic module (G') of the polyester resin (A) determined by dynamic viscoelasticity measurement at a temperature of 40° C. or higher but 120° C. or lower is preferably $1\times10^5$ Pa or greater but $3\times10^7$ Pa or less, and more preferably $3\times10^5$ Pa or greater but $5\times10^6$ Pa or less. When the storage elastic modulus (G') of the polyester resin (A) is $1\times10^5$ Pa or greater, abrasion resistance or heat resistant storage stability can be improved. When the storage elastic modulus (G') of the polyester resin (A) is $3\times10^7$ Pa or less, low-temperature fixability can be improved.

A weight average molecular weight (Mw) of the polyester resin (A) is not particularly limited. The weight average molecular weight (Mw) thereof as measured by gel permeation chromatography (GPC) is preferably 20,000 or greater but 1,000,000 or less. When the weight average molecular weight of the polyester resin (A) is 20,000 or greater, charging ability and heat resistant storage stability of the toner can be improved. When the weight average molecular weight of the polyester resin (A) is 1,000,000 or less, low-temperature fixability can be improved.

The molecular weight distribution or weight average molecular weight (Mw) of the resin can be measured by means of a gel permeation chromatometer (GPC) (e.g., HLC-8220GPC (available from Tosoh Corporation)). As columns, TSKgel SuperHZM-H 15 cm 3-stranded (available from Tosoh Corporation) can be used. The resin to be measured is formed into a 0.15% by mass solution using tetrahydrofuran (THF) (including a stabilizer, available from Wako Pure Chemical Industries, Ltd.), the solution is filtered with a 0.2 μm-filter, and the resultant filtrate can be used as a sample. Then, the measuring device is injected with 100 μL of the THF sample solution, and a measurement can be performed at a flow rate of 0.35 mL/min in an environment having a temperature of 40° C.

The molecular weight can be calculated using a calibration curve prepared using monodisperse polystyrene standard samples. As the standard polystyrene samples, Showdex STANDARD series available from SHOWA DENKO K.K. and toluene can be used.

More specifically, a THF solution of the following three monodisperse polystyrene standard samples is prepared, a measurement is performed under the conditions mentioned above, and a calibration curve can be prepared by determining a retention time of a peak top as a light scattering molecular weight of the monodisperse polystyrene standard sample.

Solution A: S-7450 (2.5 mg), S-678 (2.5 mg), S-46.5 (2.5 mg), S-2.90 (2.5 mg), THF (50 mL)

Solution B: S-3730 (2.5 mg), S-257 (2.5 mg), S-19.8 (2.5 mg), S-0.580 (2.5 mg), THF (50 mL)

Solution C: S-1470 (2.5 mg), S-112 (2.5 mg), S-6.93 (2.5 mg), toluene (2.5 mg), THF (50 mL)

Note that, a refractive index (RI) detector can be used as a detector.

Moreover, the toner used in the image forming apparatus of the present disclosure may further include other components, such as other resins, a colorant, a release agent, a charge-controlling agent, external additives, a flowability-improving agent, a cleaning-improving agent, and a magnetic material, according to the necessity.

Other resins are not particularly limited and may be appropriately selected from resins known in the art according to the necessity. Examples thereof include: homopolymers of styrene or substituted styrene, such as polystyrene, poly(p-styrene), and polyvinyl toluene; styrene-based copolymers, such as styrene-p-chlorostyrene copolymer, styrene-propylene copolymer, styrene-vinyl toluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-methyl vinyl ketone copolymer, styrene-butadiene copolymer, styrene-isopropyl copolymer, and styrene-maleic acid ester copolymer; a polymethyl methacrylate resin; a polybutyl methacrylate resin; a polyvinyl chloride resin; a polyvinyl acetate resin; a polyethylene resin; a polyester resin; a polyurethane resin; an epoxy resin; a polyvinyl butyral resin; a polyacrylic acid resin; a rosin resin; a modified rosin resin; a terpene resin; a phenol resin; an aliphatic or aromatic hydrocarbon resin; an aromatic-based petroleum resin, and resins modified to have a functional group reactive with an active hydrogen group. The above-listed examples may be used alone or in combination.

Other resins are particularly preferably any of resins compatible with the polyester resin (A) for controlling a glass transition temperature of the toner of the present disclosure, and a storage elastic modulus of the toner to particularly preferable values. Note that, the polyester resin compatible with the polyester resin (A) may be referred to as a polyester resin (B) hereinafter.

Since the resin compatible with the polyester resin (A) is present between the polyester resin (A) and the crosslink structure of the polyester resin (A) having high elasticity, a toner having extremely excellent melting ability in a fixing temperature region can be obtained even through there is a crosslink structure of high order.

A glass transition temperature of the compatible polyester resin (B) is 30° C. or higher but 80° C. or lower, and more preferably 40° C. or higher but 75° C. or lower in view of control of a glass transition temperature of the toner.

The compatible polyester resin (B) is preferably a linear or non-linear polyester resin that can be dissolved in THF and is preferably an unmodified polyester resin.

The unmodified polyester resin is a polyester resin obtained using polyvalent alcohol and polyvalent carboxylic acid (e.g., polyvalent carboxylic acid, polyvalent carboxylic acid anhydride, and polyvalent carboxylic acid ester) or a derivative thereof, and is a polyester resin that is not modified with an isocyanate compound.

Examples of the polyvalent alcohol include: alkylene (the number of carbon atoms: from 2 through 3) oxide adduct (the average number of moles added: from 1 through 10) of bisphenol (A) (e.g., polyoxypropylene(2.2)-2,2-bis(4-hydroxyphenyl)propane, and polyoxyethylene(2.2)-2,2-bis(4-hydroxyphenyl)propane; ethylene glycol, propylene glycol; diol, such as hydrogenated bisphenol A, and alkylene (the number of carbon atoms: from 2 through 3) oxide adduct (the average number of moles added: from 1 through 10) of hydrogenated bisphenol A; and trivalent or higher alcohol, such as glycerin, pentaerythritol, and trimethylolpropane. The above-listed examples may be used alone or in combination.

Examples of the polyvalent carboxylic acid include: dicarboxylic acid, such as adipic acid, phthalic acid, isophthalic acid, terephthalic acid, fumaric acid, maleic acid, and succinic acid substituted with an alkyl group having from 1 through 20 carbon atoms or an alkenyl group having from 2 through 20 carbon atoms (e.g., dodecenylsuccinic acid and octylsuccinic acid); and trivalent or higher carboxylic acid, such as trimellitic acid, pyromellitic acid, and acid anhydrides thereof. The above-listed examples may be used alone or in combination.

A molecular weight of the polyester resin (B) is not particularly limited and may be appropriately selected depending on the intended purpose. The weight average molecular weight (Mw) of the polyester resin (B) as measured by gel permeation chromatography (GPC) is preferably from 5,000 through 20,000, and more preferably from 7,000 through 12,000. Moreover, the number average molecular weight (Mn) is preferably from 1,000 through 4,000, and more preferably from 1,500 through 3,000. Moreover, Mw/Mn is preferably from 1.0 through 4.0, and more preferably from 1.0 through 3.5.

The acid value of the polyester resin is not particularly limited and may be appropriately selected depending on the intended purpose. The acid value thereof is preferably from 1 mgKOH/g through 50 mgKOH/g, and more preferably from 5 mgKOH/g through 30 mgKOH/g. Since the acid value thereof is 1 mgKOH/g or greater, the toner tends to be negatively charged, and moreover affinity between paper and the toner is improved to achieve excellent fixability. Since the acid value thereof is 50 mgKOH/g or less, charging stability, particularly charging stability against fluctuations of the environment, can be improved.

The hydroxyl value of the polyester resin is not particularly limited. The hydroxyl value thereof is preferably 5 mgKOH/g or greater.

Moreover, other resins may include a crystalline resin.

The crystalline resin is preferably a crystalline resin that melts at a temperature near a fixing temperature. Since such a crystalline resin is included in the toner, the crystalline resin becomes compatible to the binder resin as the crystalline resin is melted at a fixing temperature, sharp melt properties of the toner are improved, and an excellent effect of low-temperature fixability can be exhibited.

The crystalline resin is not particularly limited and may be appropriately selected depending on the intended purpose, as long as the crystalline resin is a resin having crystallinity. Examples thereof include a polyester resin, a polyurethane resin, a polyurea resin, a polyamide resin, a polyether resin, a vinyl resin, and a modified crystalline resin. The above-listed examples may be used alone or in combination.

A melting point of the crystalline resin is not particularly limited. The melting point thereof is preferably 60° C. or higher but 100° C. or lower. When the melting point of the crystalline resin is 60° C. or higher, the crystalline resin is not easily melted at a low temperature, and therefore heat resistant storage stability of the toner can be improved. When the melting point of the crystalline resin is 100° C. or lower, low-temperature fixability can be improved.

A molecular weight of the crystalline polyester resin is not particularly limited. The orthodichlorobenzene-soluble component of the crystalline polyester resin as determined in GPC preferably has a weight average molecular weight (Mw) of from 3,000 through 30,000, a number average molecular weight (Mn) of from 1,000 through 10,000, and Mw/Mn of from 1.0 through 10. The weight average molecular weight (Mw) is more preferably from 5,000 through 15,000, the number average molecular weight (Mn) is more preferably from 2,000 through 10,000, and Mw/Mn is more preferably from 1.0 through 5.0.

The acid value of the crystalline polyester resin is not particularly limited. The acid value thereof is preferably 5 mgKOH/g or greater, and more preferably 10 mgKOH/g or greater to achieve desired low-temperature fixability in view of affinity between paper and the resin. In order to improve hot offset resistance, on the other hand, the acid value of the crystalline polyester resin is preferably 45 mgKOH/g or less.

The hydroxyl value of the crystalline polyester resin is not particularly limited. In order to achieve desired low-temperature fixability and excellent charging ability, the hydroxyl value thereof is preferably from 0 mgKOH/g through 50 mgKOH/g, and more preferably from 5 mgKOH/g through 50 mgKOH/g.

An amount of the crystalline polyester resin in the toner is not particularly limited. The amount thereof is preferably 3 parts by mass or greater but 20 parts by mass or less, and more preferably 5 parts by mass or greater but 15 parts by mass or less relative to 100 parts by mass of the toner. When the amount of the crystalline polyester resin in the toner is 3 parts by mass or greater, low-temperature fixability can be improved. When the amount of the crystalline polyester resin is 20 parts by mass or less, heat resistant storage stability, mechanical durability, and abrasion resistance can be improved.

The colorant is not particularly limited and may be appropriately selected from dyes and pigments known in the art depending on the intended purpose. Examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, red iron oxide, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine GB, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. The above-listed examples may be used alone or in combination.

An amount of the colorant is not particularly limited. The amount thereof is preferably from 1% by mass through 15% by mass, and more preferably from 3% by mass through 10% by mass.

The colorant may be also used as a master batch in which the colorant forms a composite with a resin. The resin is not particularly limited and may be appropriately selected from resins known in the art depending on the intended purpose. Examples of the resin include polymers of styrene or substituted styrene, styrene-based copolymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylic acid resins, rosin, modified rosin, terpene resins, aliphatic hydrocarbon resins, alicyclic hydrocarbon resins, aromatic-based petroleum resins, chlorinated paraffin, and paraffin. The above-listed examples may be used alone or in combination.

The release agent is not particularly limited and may be appropriately selected from release agents known in the art depending on the intended purpose. Examples thereof include wax, such as carbonyl group-containing wax, polyolefin wax, and long-chain hydrocarbon. The above-listed examples may be used alone or in combination. Among the above-listed examples, carbonyl group-containing wax is preferable.

Examples of the carbonyl group-containing wax include: polyalkanoic acid esters, such as carnauba wax, montan wax, trimethylolpropane tribehenate, pentaerythritol tetrabehenate, pentaerythritol diacetate dibehenate, glycerin tribehenate, and 1,18-octadecanediol distearate; polyalkanol esters, such as tristearyl trimellitate, and distearyl maleate; polyalkanoic acid amide, such as dibehenyl amide; polyalkyl amide, such as tristearylamide trimellitate; and dialkyl ketone, such as distearyl ketone.

Examples of the polyolefin wax include polyethylene wax, and polypropylene wax.

Examples of the long-chain hydrocarbon include paraffin wax, and Sasol wax.

A melting point of the release agent is not particularly limited and may be appropriately selected depending on the intended purpose. The melting point thereof is preferably from 40° C. through 160° C., more preferably from 50° C. through 120° C., and particularly preferably from 60° C. through 90° C.

An amount of the release agent in the toner is not particularly limited. The amount thereof is preferably from 1% by mass through 20% by mass, more preferably from 3% by mass through 15% by mass, and particularly preferably from 3% by mass through 7% by mass.

The charge-controlling agent is not particularly limited and may be appropriately selected depending on the intended purpose. Examples thereof include a nigrosine-based dye, a triphenylmethane-based dye, a chrome-containing metal complex dye, a molybdic acid chelate pigment, a rhodamine-based dye, an alkoxy-based amine, a quaternary ammonium salt (including fluorine-modified quaternary ammonium), alkylamide, phosphorus or a compound thereof, tungsten or a compound thereof, a fluorosurfactant, a metal salt of salicylic acid, and a metal salt of a salicylic acid derivative. Specific examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all available from ORIENT CHEMICAL INDUSTRIES CO., LTD.); quaternary ammonium salt molybdenum complex TP-302 and TP-415 (both available from Hodogaya Chemical Co., Ltd.); LRA-901, and boron complex LR-147 (both available from Japan Carlit Co., Ltd.); copper phthalocyanine; perylene; quinacridone; azo pigments; and polymeric compounds having, as a functional group, such as a sulfonic acid group, a carboxyl group, and a quaternary ammonium salt.

An amount of the charge-controlling agent is not particularly limited. The amount thereof is preferably from 0.1 parts by mass through 10 parts by mass, and more preferably from 0.2 parts by mass through 5 parts by mass relative to 100 parts by mass of the toner. The charge-controlling agent may be dispersed in particles of the toner for use, or may be fixed on surfaces of particles of the toner through physical adsorption or chemical adsorption for use.

The external additives are not particularly limited and may be appropriately selected from external additives known in the art depending on the intended purpose. Examples thereof include silica particles, hydrophobicity-treated silica particles, fatty acid metal salt (e.g., zinc stearate and aluminium stearate), metal oxide (e.g., titanium oxide, alumina, tin oxide, and antimony oxide), hydrophobicity-treated metal oxide particles, and fluoropolymer. Among the above-listed examples, hydrophobicity-treated silica particles, hydrophobicity-treated titanium oxide particles, and hydrophobicity-treated alumina particles are preferable.

Examples of the silica particles include: HDK H 2000, HDK H 2000/4, HDK H 2050EP, HVK21, and HDK H1303 (all available from Hoechst AG); and R972, R974, RX200, RY200, R202, R805, and R812 (all available from NIPPON AEROSIL CO., LTD.).

Examples of the titanium oxide particles include: P-25 (available from NIPPON AEROSIL CO., LTD.); STT-30, and STT-65C-S (both available from Titan Kogyo, Ltd.); TAF-140 (available from Fuji Titanium Industry Co., Ltd.); MT-150W, MT-500B, MT-600B, and MT-150A (all available from TAYCA CORPORATION); T-805 (available from NIPPON AEROSIL CO., LTD.); STT-30A and STT-65S-S (available from Titan Kogyo, Ltd.); TAF-500T and TAF-1500T (both available from Fuji Titanium Industry Co., Ltd.); MT-100S and MT-100T (both available from TAYCA CORPORATION); and IT-S (available from ISHIHARA SANGYO KAISHA, LTD.).

The hydrophobicity-treated silica particles, the hydrophobicity-treated titanium oxide particles, and the hydrophobicity-treated alumina particles can be obtained by treating hydrophilic particles (e.g., silica particles, titanium oxide particles, and alumina particles) with silane-coupling agents (e.g., methyl trimethoxy silane, methyl triethoxy silane, and octyl trimethoxy silane).

Moreover, silicone oil-treated inorganic particles obtained by treating inorganic particles with silicone oil, optionally with heating, are also preferable.

An amount of the external additives to be added is preferably from 0.1% by mass through 5% by mass, and is more preferably from 0.3% by mass through 3% by mass, relative to the toner.

Resin particles may be also added as the external additives. Examples of the resin particles include: polystyrene obtained by soap-free emulsion polymerization, suspension polymerization, or dispersion polymerization; copolymers of methacrylic acid esters or acrylic acid esters; polycondensation-based polymer particles, such as silicone, benzoguanamine, and nylon; and polymer particles of thermoset resins. Use of such resin particles in combination can enhance charging ability of a toner, and reduces reverse-charge of the toner to thereby suppress background fog. An amount of the resin particles to be added is preferably from 0.01% by mass through 5% by mass, and more preferably from 0.1% by mass through 2% by mass relative to the toner.

The flowability-improving agent is an agent used to perform a surface treatment of the toner to increase hydrophobicity to thereby prevent deterioration of flowability and charging properties even in a high humidity environment. Examples of the flowability-improving agent include a silane coupling agent, a silylation agent, a silane-coupling agent containing a fluoroalkyl group, an organic titanate-based coupling agent, an aluminum-based coupling agent, silicone oil, and modified-silicone oil.

The cleaning-improving agent is added to the toner for the purpose of removing a developer remained on an electrostatic latent image bearer or an intermediate transfer member after transferring. Examples thereof include: fatty acid (e.g. stearic acid) metal salts, such as zinc stearate, and calcium stearate; and polymer particles produced by soap-free emulsion polymerization, such as polymethyl methacrylate particles, and polystyrene particles. The polymer particles are preferably polymer particles having a relatively narrow particle size distribution, and are suitably polymer particles having a weight average particle diameter of from 0.01 μm through 1 μm.

The magnetic material is not particularly limited and may be appropriately selected from magnetic materials known in the art depending on the intended purpose. Examples thereof include iron powder, magnetite, and ferrite. Among the above-listed examples, white magnetic materials are preferable in view of color tone.

<<Production Method of Toner>>

A method for producing the toner used in the image forming apparatus of the present disclosure is not particularly limited and may be appropriately selected depending on the intended purpose. Examples thereof include a kneading pulverization method, and a chemical method where toner particles are granulated in an aqueous medium.

Examples of the chemical method where toner particles are granulated in an aqueous medium include: a method for producing a toner using a monomer as a starting material, such as a suspension polymerization method, an emulsion polymerization method, a seed polymerization method, and a dispersion polymerization method; a dissolution suspension method where a resin or a resin precursor is dissolved in an organic solvent, and the resultant is dispersed or emulsified in an aqueous medium; a phase-transfer emulsification method where water is added to a solution including a resin or a resin precursor and an appropriate emulsifier to perform phase transfer; and an aggregation method where resin particles obtained any of the above-described methods are aggregated in a state where the resin particles are dispersed in an aqueous medium, and particles of a desired size are granulated by heating and melting the resin particles. In the present disclosure, particularly, it is preferable that the polyester resin (A) having high rubber elasticity be uniformly blended in the toner. Therefore, more preferable as the production method is a method where a toner composition including a reactive precursor and the curing agent is dissolved or dispersed in an organic solvent to prepare an oil phase, and the oil phase is dispersed or emulsified in an aqueous medium to granulate the toner base particles.

At the time of the emulsification or dispersion in the aqueous medium, a surfactant or a polymer-based protective colloid may be optionally used.

The surfactant is not particularly limited and may be appropriately selected depending on the intended purpose. Examples thereof include: anionic surfactants, such as alkyl benzene sulfonic acid salt, α-olefin sulfonic acid salt, and phosphoric acid ester; cationic surfactants, such as amine salts (e.g., alkyl amine salt, amino alcohol fatty acid derivatives, polyamine fatty acid derivatives, and imidazoline), and quaternary ammonium salts (e.g., alkyl trimethyl ammonium salt, dialkyldimethyl ammonium salt, alkyl dimethylbenzyl ammonium salt, pyridinium salt, alkyl isoquinolinium salt, and benzethonium chloride); nonionic surfactants, such as fatty acid amide derivatives, and polyvalent alcohol derivatives; and amphoteric surfactants, such as alanine, dodecyl di(aminoethyl)glycine, di(octylaminoethyl)glycine, and N-alkyl-N,N-dimethylammoniumbetaine. Moreover, a surfactant having a fluoroalkyl group can exhibit an effect thereof with an extremely small usage amount. Examples of the surfactant having a fluoroalkyl group include anionic surfactants having a fluoroalkyl group, and cationic surfactants having a fluoroalkyl group.

The polymer-based protective colloid is not particularly limited and may be appropriately selected depending on the intended purpose. Examples of the polymer-based protective colloid include: acids, such as acrylic acid, methacrylic acid, α-cyanoacrylic acid, α-cyanomethacrylic acid, itaconic acid, crotonic acid, fumaric acid, maleic acid, and maleic anhydride; (meth)acryl-based monomers having a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerin monoacrylic acid ester, glycerin monomethacrylic acid ester, N-methylolacrylamide, and N-methylolmethacrylamide; vinyl alcohols; ethers of vinyl alcohols, such as vinyl methyl ether, vinyl ethyl ether, and vinyl propyl ether; esters of vinyl alcohol and a compound having a carboxyl group, such as vinyl acetate, vinyl propionate, and vinyl butyrate; acryl amide, methacryl amide, diacetone acryl amide, and methylol compounds thereof; acid chlorides, such as acrylic acid chloride, and methacrylic acid chloride; homopolymers or copolymers of compounds having a nitrogen atom or a heterocycle thereof, such as vinyl pyridine, vinyl pyrrolidone, vinyl imidazole, and ethylene imine; polyoxyethylene-based compounds, such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonylphenyl ether, polyoxyethylene lurylphenyl ether, polyoxyethylene stearylphenyl ester, and polyoxyethylene nonylphenyl ester; and cellulose, such as methyl cellulose, hydroxyethyl cellulose, and hydroxypropyl cellulose.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. The above-listed examples may be used alone or in combination. Among the above-listed examples, an ester-based solvent (e.g., methyl acetate and ethyl acetate), an aromatic-based solvent (e.g., toluene and xylene), and halogenated hydrocarbon (e.g., methylene chloride, 1,2-dichloroethane, chloroform, and carbon tetrachloride) are preferable.

The solid content of the oil phase obtained by dissolving or dispersing the toner composition is preferably from 30% by mass through 80% by mass. When the solid content is too high, it is difficult to dissolve or disperse the toner composition, and the viscosity of the oil phase becomes high hence difficult to handle. When the solid content is too low, a production amount of the toner becomes small.

As the aqueous medium, water alone may be used, or water may be used in combination with a solvent miscible with water. Examples of the solvent miscible with water include alcohol (e.g., methanol, isopropanol, and ethylene glycol), dimethylformamide, tetrahydrofuran, cellosolves (e.g., methyl cellosolve), and lower ketones (e.g., acetone, and methyl ethyl ketone).

An amount of the aqueous medium for use relative to 100 parts by mass of the toner composition is not particularly limited and may be appropriately selected depending on the intended purpose. The amount thereof is typically from 50 parts by mass through 2,000 parts by mass, and preferably from 100 parts by mass through 1,000 parts by mass.

An inorganic dispersant or organic resin particles may be dispersed in the aqueous medium in advance. Such an addition of the inorganic dispersant or the organic resin particles is preferable in view of a sharp particle size distribution and dispersion stability.

Examples of the inorganic dispersant include tricalcium phosphate, calcium carbonate, titanium oxide, colloidal silica, and hydroxyapatite.

The resin for forming the organic resin particles may be any of resins known in the art as long as the resin is a resin that can be formed into aqueous dispersed element. The resin may be a thermoplastic resin or a thermoset resin. Examples of the resin include a vinyl-based resin, a polyurethane resin, an epoxy resin, a polyester resin, a polyamide resin, a polyimide resin, a silica-based resin, a phenol resin, a melamine resin, a urea resin, an aniline resin, an ionomer resin, and a polycarbonate resin. The above-listed resins may be used alone or in combination.

A method for emulsifying or dispersing in the aqueous medium is not particularly limited. Any of facilities known in the art, such as low-speed sharing, high-speed shearing, abrasion, high-pressure jet, and ultrasonic waves, can be used. Among them, high-speed shearing is preferable in view of downsizing of diameters of the particles. When a high-speed shearing disperser is used, a rotational speed is not particularly limited, but the rotational speed is typically from 1,000 rpm through 30,000 rpm, and preferably from 5,000 rpm through 20,000 rpm. The temperature at the time of dispersing is typically from 0° C. through 150° C. (under pressure), and is preferably from 20° C. through 80° C.

In the case where the toner composition includes the reactive precursor, a compound including an active hydrogen group that is used for an elongation or crosslink reaction of the reactive precursor may be added to the toner composition before dispersing the toner composition in the aqueous medium. Alternatively, the reactive precursor may be added into the aqueous medium.

In order to remove the organic solvent from the obtained emulsified dispersed elements, any of methods known in the art can be used. For example, employed can be a method where an entire system is gradually heated at atmospheric pressure or under reduced pressure to completely evaporate and remove the organic solvent in droplets.

In the case where the aggregation method is used in the aqueous medium, the resin particle dispersion liquid obtained by the method above, and optionally a dispersion liquid, such as a colorant dispersion liquid and a dispersion liquid of a release agent, are mixed to aggregate together to form particles. A single type of the resin particle dispersion liquid may be used alone. Alternatively, two or more types of the resin particle dispersion liquid may be added. In this case, the addition may be performed at once or step by step. The above-described single use of the resin dispersion liquid or use thereof in combination is the same with other dispersion liquids.

In order to control the aggregation state, a method, such as heating, addition of a metal salt, and adjustment of pH, can be preferably used.

The metal salt is not particularly limited. Examples thereof include: monovalent metal constituting a salt, such as sodium and potassium; divalent metal constituting a salt, such as calcium and magnesium; and a trivalent metal constituting a salt, such as aluminium.

Examples of the anion constituting the salt include a chloride ion, a bromide ion, an iodide ion, a carbonic acid ion, and a sulfuric acid ion. Among the above-listed examples, magnesium chloride, aluminium chloride, a composite thereof, or a multimer thereof is preferable.

Moreover, fusion of resin particles to each other can be accelerated by heating during aggregation or after completing aggregation, and therefore heating is preferable in view of uniformity of the toner. Moreover, shapes of particles of the toner can be controlled by heating. Typically, the shapes of the particles of the toner become close to spheres as heated.

Any of techniques known in the art can be used for washing and drying base particles of the toner dispersed in the aqueous medium. Specifically, the solids and the liquid are separated from each other by centrifugal separator or a filter press, and then the obtained toner cake is again dispersed in an ion-exchanged water of from room temperature through about 40° C. After optionally adjusting the pH with an acid or alkali, solid-liquid separation is performed again. This series of steps are repeated to remove impurities, a surfactant, etc., and then the resultant is dried by a flash dryer, an air-circulation dryer, a vacuum drier, or a vibrating fluidized bed dryer to thereby obtain a toner powder. At the time of drying, a fine particle component of the toner may be removed by centrifugal separation. Alternatively, a desired particle size distribution may be optionally obtained by performing classification using a classifier known in the art after drying.

In the present disclosure, moreover, the toner may be used for image formation as a form of a developer including at least the toner used for the image forming apparatus of the present disclosure and an appropriately selected carrier.

The developer may be a one-component developer or a two-component developer. In the case where the developer is used for a high-speed printer corresponding to improved current information processing speed, a two-component developer is preferably in view of an improvement of service life.

In the case of the one-component developer including the toner used in the image forming apparatus of the present disclosure, there is little variation in the particle size of the toner even when the toner is consumed and supplied repeatedly. Also, there is either filming of the toner to a developing roller nor fusion of the toner to a layer thickness regulating member such as a blade for thinning the toner. Moreover, excellent and stable developing properties and images can be obtained even after a long-term usage (stirring) of the developing unit.

In the case of the two-component developer including the toner used in the image forming apparatus of the present disclosure, there is little variation in the particle size of the toner in the developer when the toner is consumed and supplied repeatedly over a long period. Moreover, excellent and stable developing properties and images can be obtained even after a long-term usage (stirring) of the developing unit.

The carrier is not particularly limited and may be appropriately selected depending on the intended purpose. The carrier is preferably a carrier including carrier particles where each carrier particle includes a core and a resin layer covering the core.

Moreover, the image forming apparatus of the present disclosure may include a process cartridge detachably mounted in the image forming apparatus, where the process cartridge includes at least an image bearer, and a cleaning unit that includes an elastic member including a surface layer to be in contact with a surface of the image bearer and is configured to remove a toner deposited on the surface of the image bearer with the elastic member. The cleaning unit included in the process cartridge is preferably identical to the cleaning unit in the image forming apparatus of the present disclosure.

Moreover, the process cartridge may include a system for applying a lubricant onto the surface of the image bearer as a cleaning aiding member.

As an image forming apparatus to which the present disclosure has been applied, an embodiment (may be referred to as a present embodiment hereinafter) of a printer of an electrophotographic system (may be merely referred to as a printer 500 hereinafter) will be described hereinafter. First, a basic structure of the printer 500 according to the present embodiment will be described.

Figure 5:
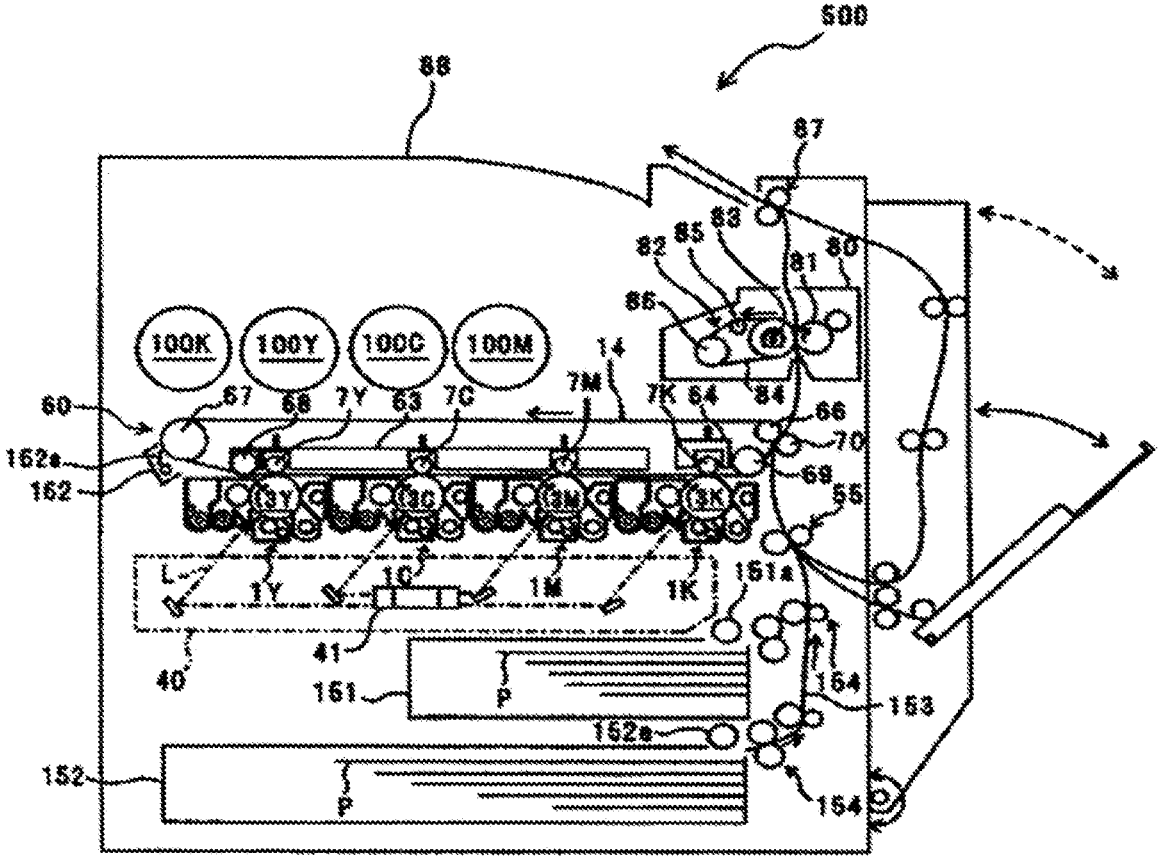
FIG. 5 is a schematic structural view illustrating an example of the image forming apparatus of the present disclosure.

FIG. 5 is a schematic structural view illustrating the printer 500. The printer 500 includes four image forming units 1Y, C, M, and K for yellow, magenta, cyan, and black (referred to as Y, C, M, and K hereinafter). The image forming units use mutually different color toners, i.e., Y toner, C toner, M toner, and K toner, as an image forming material for forming an image, but other than the toner used, the image forming units have the same structure.

Above the four image forming units 1, a transfer unit 60 including an intermediate transfer belt 14 as an intermediate transfer member is arranged. The transfer unit 60 has a structure where toner images of all of the colors formed on surfaces of the photoconductors 3Y, C, M, and K included in the image forming units 1Y, C, M, and K, the details of which will be described later, are overlapped and transferred onto a surface of the intermediate transfer belt 14.

Moreover, a light writing unit 40 is arranged below the four image forming units 1. The light writing unit 40 serving as an exposing unit is configured to apply laser light L emitted based on image information to a photoconductor 3Y, C, M, or K of the image forming unit 1Y, C, M, or K. As a result, an electrostatic latent image for Y, C, M, or K is formed on the photoconductor 3Y, C, M, or K. Note that, the light writing unit 40 is configured to irradiate the photoconductor 3Y, C, M, and K with laser light L emitted from a light source with deflecting using a rotatable driven polygon mirror 41 via a plurality of optical lenses or mirrors. Instead of the structure as described, a light writing unit that can perform photoscanning with an LED array may be employed.

Below the light writing unit 40, a first paper feeding cassette 151, and a second paper feeding cassette 152 are arranged to be overlapped with each other in the vertical direction. Inside each of the paper feeding cassettes, a bundle of paper sheets is stored in the state where a plurality of sheets of transfer paper P that is recording media are stacked, and a first paper feeding roller 151*a* and a second paper feeding roller 152*a* are in contact with transfer paper P placed on top. Once the first paper feeding roller 151*a* is rotationally driven in the anticlockwise direction in FIG. 5 by a driving unit, the transfer paper P placed on top inside the first paper feeding cassette 151 is ejected towards a paper feeding path 153 disposed to extend in a vertical direction at the right side of the cassette in FIG. 5. Once the second paper feeding roller 152*a* is rotationally driven in the anticlockwise direction in FIG. 5 by a driving unit, moreover, the transfer paper P placed on top inside the second paper feeding cassette 152 is ejected towards the paper feeding path 153.

A plurality of pairs of transfer rollers 154 are disposed inside the paper feeding path 153. The transfer paper P sent to the paper feeding path 153 is transported from the bottom side to the top side of the paper feeding path 153 in FIG. 5 with being nipped between the pairs of the rollers 154.

A pair of registration rollers 55 are disposed at the edge of the downstream of the conveying direction of the paper feeding path 153. As soon as the pair of the registration rollers 55 nip the transfer paper P sent from the pair of the transporting rollers 154, rotations of both rollers. Then, the transfer paper P is sent towards a secondary transfer nip described below at appropriate timing.

Figure 6:
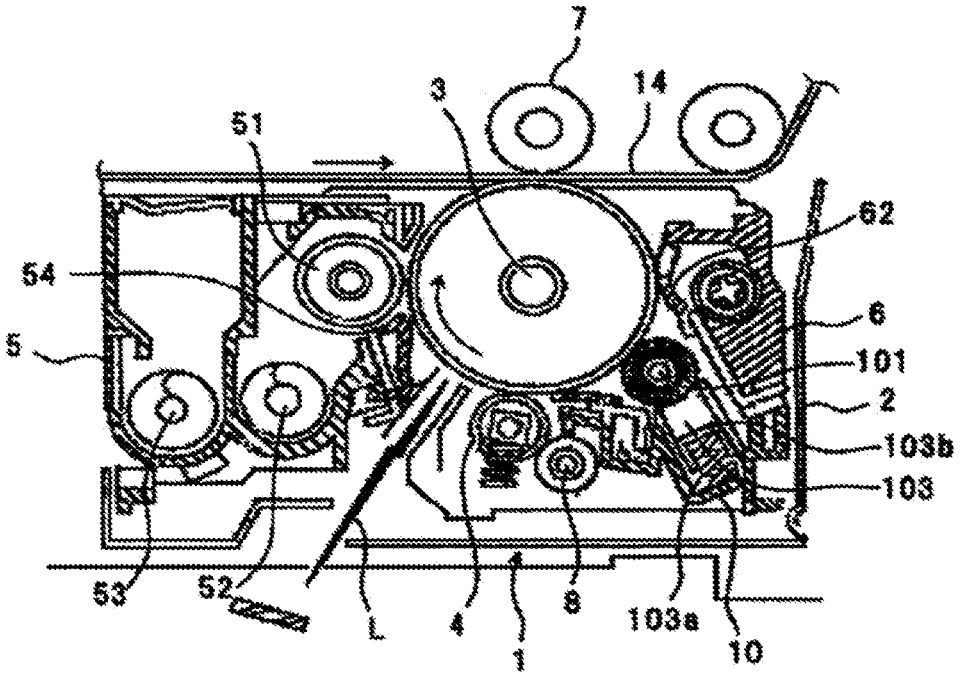
FIG. 6 is a schematic structural view illustrating an example of an image forming unit included in the image forming apparatus of the present disclosure.

FIG. 6 is a structural view illustrating one schematic structure among four image forming units 1.

As illustrated in FIG. 6, the image forming unit 1 includes a drum-shaped photoconductor 3 serving as an image bearer. The photoconductor 3 has a drum shape, but the photoconductor may be a sheet shaped, or an endless belt type.

At the periphery of photoconductor 3, a charging roller 4, a developing device 5, a primary transfer roller 7, a cleaning device 6, a lubricant applying device 10, a charge-eliminating lamp, etc. are disposed. The charging roller 4 is a charging member included in a charging device serving as a charging unit. The developing device 5 is a developing unit configured to form a toner image from a latent image formed on a surface of the photoconductor 3. The primary transfer roller 7, which is an example of a transferring unit, is a primary transfer member included in a primary transferring device that is configured to transfer the toner image on the surface of the photoconductor 3 to the intermediate transfer belt 14, and serves as a primary transferring unit. The cleaning device 6 is a cleaning unit configured to clean the toner remained on the photoconductor 3 after transferring the toner image to the intermediate transfer belt 14. The lubricant applying device 10 is a lubricant applying unit configured to apply a lubricant onto the surface of the photoconductor 3 after performing cleaning with the cleaning device 6. The charge-eliminating lamp is a charge-eliminating unit configured to eliminate surface potential of the photoconductor 3 after cleaning.

The charging roller 4 is disposed with a certain distance from the photoconductor 3 without being in contact with the photoconductor 3, and is configured to charge the photoconductor 3 with the predetermined polarity and the predetermined potential. The uniformly charged surface of the photoconductor 3 by the charging roller 4 is irradiated with laser light L emitted from the light writing unit 40 serving as an exposing unit based on image information to thereby form an electrostatic latent image.

The developing device 5 includes a developing roller 51 serving as a developer bearer. To the developing roller 51, developing bias is applied from a power source. Inside a casing of the developing device 5, a supply screw 52 and a stirring screw 53 that are configured to transport a developer stored in the casing in opposite directions to stir are disposed. Moreover, a doctor 54 for regulating the developer born the developer roller 51 is disposed. The toner included in the developer stirred and transported by the two screws, i.e., the supply screw 52 and the stirring screw 53 is charged with the predetermined polarity. Then, the developer is taken up onto a surface of the developing roller 51, the developer taken up is regulated with the doctor 54, and the toner is deposited onto a latent image on the photoconductor 3 in a developing region facing the photoconductor 3.

The cleaning device 6 includes a fur brush 101, a cleaning blade 62, etc. The cleaning blade 62 is brought into contact with the photoconductor 3 in the counter direction of the moving direction of the surface of the photoconductor 3. Note that, the cleaning blade 62 is the cleaning unit of the image forming apparatus of the present disclosure. The lubricant applying device 10 includes a solid lubricant 103, a lubricant press spring 103*a*, etc., and a fur brush 101 is used as an application brush configured to apply the solid lubricant 103 onto the photoconductor 3. The solid lubricant 103 is held with a bracket 103*b* and is pressed against the side of the fur brush 101 by the lubricant press spring 103*a*. Then, the solid lubricant 103 is scraped by the fur brush 101 rotated in the drag rotational direction of the rotational direction of the photoconductor 3 and is applied onto the photoconductor 3. It is preferable that a friction coefficient of the surface of the photoconductor 3 be maintained at 0.2 or less when image formation is not in progress, by applying the lubricant to the photoconductor.

The charging unit of the present embodiment is that of a non-contact proximity setting system where the charging roller 4 is disposed in the proximity of the photoconductor 3 without contact. As the charging unit, any of structures known in the art, such as a coroton, a scorotron, and a solid state charger, may be used. Among the above-listed charging systems, particularly, a contact charging system, or a non-contact proximity setting system are more desirable. The contact charging system or non-contact proximity setting system has advantages, such as a low amount of ozone generated with high charging efficiency, and a small size of a device.

As the light source of the laser light of the light writing unit 40 or the light source of the charge-eliminating lamp, etc., any of emitters, such as a fluorescent lamp, a tungsten lamp, a halogen lamp, a mercury lamp, a sodium-vapor lamp, a light emitting diode (LED), a semiconductor laser (LD), and electroluminescent light (EL).

In order to apply light of the only desired wavelength range, moreover, various filters, such as a sharp-cut filter, a band-pass filter, a near infrared ray-cut filter, a dichroic filter, an interference filter, and a color temperature conversion filter, can be used.

Among the above-listed light sources, a light emitting diode and a semiconductor laser are preferably used because irradiation energy is high and light of long wavelengths ranging from 600 nm through 800 nm is emitted.

The transfer unit 60 serving as the transferring unit includes, in addition to the intermediate transfer belt 14, a belt cleaning unit 162, a first bracket 63, a second bracket 64, etc. Moreover, the transfer unit 60 also includes four primary transfer rollers 7Y, C, M, and K, a secondary transfer back-up roller 66, a driving roller 67, an auxiliary roller 68, a tension roller 69, etc. The intermediate transfer belt 14 is supported by the above-mentioned eight rollers, and is endlessly driven in the anticlockwise direction in FIG. 6 by the rotations of the driving roller 67. The four primary transfer rollers 7Y, C, M, and K each form a primary transfer nip with the photoconductors 3Y, C, M, and K with nipping the intermediate transfer belt 14 endlessly driven. Then, transfer bias, which has reverse polarity (e.g., plus) to the polarity of the toner, is applied to the back surface (the inner circumferential surface of the loop) of the intermediate transfer belt 14. In the process that the intermediate transfer belt 14 sequentially passes through the primary transfer nips for Y, C, M, and K along the endless movement thereof, the Y, C, M, and K toner images on the photoconductors 3Y, C, M, and K are overlapped on the front surface of the intermediate transfer belt 14 to perform primary transfer. As a result, a 4 color-overlapped toner image (may be referred to as a 4-color toner image hereinafter) is formed on the intermediate transfer belt 14.

The secondary transfer backup roller 66 forms a secondary transfer nip with a secondary transfer roller 70 disposed at the outer side of the loop of the intermediate transfer belt 14 with nipping the intermediate transfer belt 14 therebetween. The previously-described pair of the registration rollers 55 send transfer paper P nipped between the registration rollers 55 to the secondary transfer nip at the timing synchronized with the r-color toner image on the intermediate transfer belt 14. The 4-color toner image on the intermediate transfer belt 14 is collectively secondary transferred onto transfer paper P at the secondary transfer nip with influence of a secondary transfer electric field formed between the secondary transfer roller 70 to which secondary transfer bias is applied and the secondary transfer backup roller 66 or nip pressure. Then, a full-color toner image is formed with white of the transfer paper P.

The transfer residual toner, which has not been transferred to the transfer paper P, is deposited on the intermediate transfer belt 14 after passing the secondary transfer nip. The residual toner is cleaned by the belt cleaning unit 162. Note that, the belt cleaning blade 162*a* of the belt cleaning unit 162 is brought into contact with a front surface of the intermediate transfer belt 14. The transfer residual toner on the intermediate transfer belt 14 is scraped and removed by the belt cleaning blade 162*a*.

The first bracket 63 of the transfer unit 60 is configured to rock at the predetermined rotational angle with the rotational axial line of the auxiliary roller 68 as a center depending on on- or off-of driving of a solenoid. In the case where the printer 500 forms a monochromic image, the first bracket 63 is slightly rotated in the anticlockwise in FIG. 5 by driving of the solenoid. By the rotation of the first bracket 63, the primary transfer rollers 7Y, C, and M for Y, C, and M in the anticlockwise in FIG. 6 with the rotational axial line of the auxiliary roller 68 as a center. As a result, the intermediate transfer belt 14 is separated from the photoconductors 3Y, C, and M for Y, C, and M. Then, only the image forming unit 1K for K is driven among the four image forming units 1Y, C, M, and K to form a monochromic image. As a result, consumption of each member constituting the image forming unit caused by unnecessarily driving the image forming units 1 for Y, C, and M can be avoided at the time of formation of the monochromic image.

The fixing unit 80 is disposed above the secondary transfer nip in FIG. 5. The fixing unit 80 includes a press heat roller 81 including therein a heat source, such as a halogen lamp, and a fixing belt unit 82. The fixing belt unit 82 that is an example of the fixing device includes a fixing belt 84 that is a fixing member, a heating roller 83 including therein a heat source, such as a halogen lamp, a tension roller 85, a driving roller 86, a temperature sensor, etc. Then, the endless fixing belt 84 is endlessly driven in the anticlockwise direction in FIG. 5 with supporting the fixing belt 84 with the heating roller 83, the tension roller 85, and the driving roller 86. In the process of the endless movement, the fixing belt 84 is heated from the back surface thereof by the heating roller 83. The press heat roller 81 rotationally driven in clockwise direction in FIG. 5 is brought into contact with the portion of the front surface of the fixing belt 84 that is supported by the heating roller 83 and heated in the above-described manner. In this manner, a fixing nip at which the press heat roller 81 and the fixing belt 84 are in contact with each other is formed.

At the outside of the loop of the fixing belt 84, a temperature sensor is disposed to face the front surface of the fixing belt 84 with a predetermined gap, and the temperature sensor is configured to detect the surface temperature of the fixing belt 84 just before entering the fixing nip. The detection result is transmitted to a fixing power source circuit. The fixing power source circuit is configured to control on and off of a supply of a power source of the heat source included inside the heating roller 83 or the heat source included inside the press heat roller 81.

The transfer paper P passed through the above-described secondary transfer nip is separated from the intermediate transfer belt 14, and the transfer paper P is sent into the fixing unit 80. In the process of transporting the transfer paper P from the bottom side to the upper side in FIG. 5 with being nipped with the fixing nip inside the fixing unit 80, the transfer paper P is heated and pressed by the fixing belt 84 to fix the full-color toner image onto the transfer paper P.

The transfer paper P subjected to the fixing treatment in the above-described manner is passed through a pair of paper ejection rollers 87, followed by being ejected to outside the apparatus. A stack unit 88 is formed on an upper surface of a housing of the main body of the printer 500, and sheets of the transfer paper P ejected outside the apparatus by the pair of the paper ejection rollers 87 are sequentially stacked in the stack unit 88.

Four toner cartridges 100Y, C, M, and Y including Y, C, M, and K toners respectively are disposed above the transfer unit 60. The Y, C, M, and K toners in the toner cartridges 100Y, C, M, and K are appropriately supplied to the developing devices 5Y, C, M, and K of the image forming units 1Y, C, M, and K. The toner cartridges 100Y, C, M, and K are each detachably mounted in the main body of the printer independent from the image forming units 1Y, C, M, and K.

Next, an image formation operation of the printer 500 will be described.

Once a signal for performing printing is received from an operation unit, the predetermined voltage or electric current is sequentially applied to the charging roller 4 and the developing roller 51 at the predetermined timing. Similarly, the predetermined voltage or electric current is sequentially applied to light sources of the light writing unit 40 and the charge-eliminating lamp at the predetermined timing. Synchronizing with the application of voltage or electric current, the photoconductor 3 is rotatably driven in the direction indicated with the arrow in FIG. 5 by a photoconductor driving motor.

As the photoconductor 3 rotates in the direction indicated with the arrow in FIG. 5, first, a surface of the photoconductor 3 is uniformly charged to the predetermined potential by the charging roller 4. Then, laser light L corresponding to image information is applied to the photoconductor 3 from the light writing unit 40, and the charge of the area of the surface of the photoconductor 3 to which the laser light L is applied is eliminated to form an electrostatic latent image.

The surface of the photoconductor 3 on which the electrostatic latent image is formed is rubbed with a magnetic brush of a developer, which is formed on the developing roller 51, at the position facing the developing device 5. The negatively charged toner on the developing roller 51 is moved to the side of the electrostatic latent image by the predetermined developing bias applied to the developing roller 51, to thereby form a toner image (to develop). The identical image formation process is performed in each image forming unit 1, and a toner image of each color is formed on a surface of each of the photoconductors 3Y, C, M, and K of each of the image forming units 1Y, C, M, and K.

In the manner as described above, the electrostatic latent image formed on the photoconductor 3 is reverse developed with a toner charged with negative polarity by the developing device 5 in the printer 500. In the present embodiment, an example where N/P (negative-positive: a toner is deposited on an area of low potential) non-contact charging roller system is employed has been described, but the present disclosure is not limited to the above-described embodiment.

The toner images of all of the colors formed on the photoconductors 3Y, C, M, and K are sequentially primary transferred to be overlapped on the surface of the intermediate transfer belt 14. As a result, a 4-color toner image is formed on the intermediate transfer belt 14.

The 4-color toner image formed on the intermediate transfer belt 14 is transferred onto transfer paper P fed from the first paper feeding cassette 151 or the second paper feeding cassette 152, and fed to the second transfer nip through the pair of the registration rollers 55. The movement of the transfer paper P is stopped once in the state that the transfer paper P is nipped between the pair of the registration rollers 55, and the transfer paper P is supplied to the secondary transfer nip synchronizing with the edge of the image of the intermediate transfer belt 14. The transfer paper P to which the toner image is transferred is separated from the intermediate transfer belt 14, and is transported to the fixing unit 80. Then, the toner image is fixed on the transfer paper P by the function of heat and pressure by passing the transfer paper P, to which the toner image is transferred, through the fixing unit 80. The transfer paper P to which the toner image is fixed is ejected from the device of the printer 500, and is stacked in the stack unit 88.

Meanwhile, the transfer residual toner on the surface of the intermediate transfer belt 14 from which the toner image has been transferred to the transfer paper P at the secondary transfer nip is removed by the belt cleaning unit 162. Moreover, the residual toner on the surface of the photoconductor 3, from which the toner image of each color has been transferred to the intermediate transfer belt 14 at the primary transfer nip, after transferring is removed by the cleaning device 6, a lubricant is applied to the surface of the photoconductor 3 by the lubricant applying device 10, and then the charge of the photoconductor is eliminated by the charge-eliminating lamp.

As illustrated in FIG. 6, the image forming unit 1 of the printer 500 includes the photoconductor 3, the charging roller 4 serving as a process unit, the developing device 5, the cleaning device 6, the lubricant applying device 10, etc. inside a frame 2. The image forming unit 1 is integratedly detachably mounted as a process cartridge in the main body of the printer 500. In the printer 500, the image forming unit 1 is configured in a manner that the photoconductor 3 and the process unit are integratedly replaceable as a process cartridge. However, the image forming unit 1 may has a configuration where each of the photoconductor 3, the charging roller 4, the developing device 5, the cleaning device 6, and the lubricant applying device 10 is individually replaceable with a new unit.

EXAMPLES

The present disclosure will be described more specifically below by way of Examples. The present disclosure should not be construed as being limited to these Examples.

<Production of Base Material>

First, urethane rubber having the following JIS-A hardness, rebound resilience at 23° C., and Martens hardness (HM) was produced as a base material of an elastic member of a cleaning unit by centrifugal forming. The measuring method is presented below.

JIS-A hardness: 75°

Rebound resilience at 23° C.: 45%

Martens hardness (HM): 0.9 N/mm$^2$

<<JIS-A Hardness of Base Material>>

The JIS-A hardness at the side of the bottom surface of the base material of the elastic member was measured by means of a microrubber hardness meter MD-1 available from KOBUNSHI KEIKI CO., LTD. according to JIS K6253 (23° C.).

<<Rebound Resilience of Base Material>>

The rebound resilience of the base material of the elastic member was measured at 23° C. by means of a No. 221 resilience tester available from TOYO SEIKI SEISAKU-SHO, LTD. according to JIS K6255. As a sample, prepared was a sample obtained by laminating sheets each having a thickness of 2 mm to give a thick of 4 mm or greater.

<<Martens Hardness of Base Material>>

The Martens hardness (HM) was measured by pressing Berkovich indenter for 10 seconds at a load of 1,000 μN, retaining the load for 5 seconds, and releasing for 10 seconds at the same loading rate by means of a nanoindenter ENT-3100 available from ELIONIX INC. according to ISO14577. The measuring position was a position that was 100 μm from the tip ridgeline part of the edge surface of the blade.

Specifically, the method for measuring the Martens hardness (HM) of the base material was as follows. As illustrated in FIG. 9, first, the base material 622 was cut out into a rectangle that is 2 mm from the blade edge surface 62*a* of the base material 622 towards the depth direction of the base material 622 (the orthogonal direction of the longitudinal direction of the base material 622) and 10 mm towards the longitudinal direction. As illustrated in the perspective view of the base material of FIG. 10A and the front view of the base material of FIG. 10B, the base material cut out was fixed on a glass slide with an adhesive or a double-sided tape in a manner that the blade edge surface 62*a* faced upwards, and the Martens hardness (HM) was measured at the position that was 100 μm in the depth direction from the tip ridgeline part 62*c*, as a measuring position.

<Production of Curable Composition Used for Surface Layer>

Materials used for a curable composition for forming a surface layer are presented below.

—Isocyanate—

MDI (4,4'-diphenylmethane diisocyanate): "MILLONATE MT" available from Tosoh Corporation Hydrogenated MDI (dicyclohexylmethane 4,4'-diisocyanate): available from Tokyo Chemical Industry Co., Ltd.

TDI (2,4-tolylene diisocyanate): "Coronate T-100" available from Tosoh Corporation —Polyol—

PTMG (polytetramethylene ether glycol): "PTMG1000," "PTMG2000," and "PTMG3000"

—Curing Agent—

DDM (4,4'-diaminodiphenylmethane): available from Tokyo Chemical Industry Co., Ltd.

TMP (trimethylolpropane): available from MITSUBISHI GAS CHEMICAL COMPANY, INC.

—Catalyst—

Dioctyl tin dilaurate: NEOSTANN U-810, available from NITTOH CHEMICAL CO., LTD.

—Siloxane-Based Compound—

SH8400: polyether-modified silicone oil, available from Dow Corning Toray Co., Ltd.

FZ-2110: polyether-modified silicone oil, available from Dow Corning Toray Co., Ltd.

SF8416: alkyl-modified silicone oil, available from Dow Corning Toray Co., Ltd.

—Synthesis of Prepolymer Having NCO Group at Both Terminals—

Prepolymers 1 to 4 each having a NCO group at both terminals were prepared by mixing isocyanate and polyol to achieve a desired value of NCO % as presented in Table 1 below, reacting the mixture for 180 minutes at 80° C. with stirring and purging with nitrogen.

TABLE 1

| | Isocyanate | Polyol | NCO (%) |
|---|---|---|---|
| Prepolymer 1 | MDI | PTMG3000 | 7.5 |
| Prepolymer 2 | Hydrogenated MDI | PTMG2000 | 3.9 |
| Prepolymer 3 | TDI | PTMG2000 | 2.4 |
| Prepolymer 4 | Hydrogenated MDI | PTMG1000 | 11.5 |

—Preparation of Curable Composition—

Curable compositions were each prepared by mixing (in parts by mass) each of Prepolymers 1 to 4 above, a curing agent, a catalyst, and a siloxane-based compound at a room temperature for 3 minutes to give a equivalence ratio (an equivalent of NCO groups in the prepolymer/an equivalent of $NH_2$ groups or OH groups in the curing agent) presented in Tables 2A and 2B in a vacuum atmosphere, to sufficiently remove air bubbles.

Among the curing agents, DDM was diluted with MEK to give a solid content of 40%, and TMP was diluted with MEK to give a solid content of 10%.

TABLE 2A

| Materials | | Blade 1 | Blade 2 | Blade 3 | Blade 4 | Blade 5 | Blade 6 |
|---|---|---|---|---|---|---|---|
| Prepolymer | 1 | — | — | — | — | — | — |
| | 2 | — | — | 100 | 100 | 100 | 100 |
| | 3 | 100 | — | — | — | — | — |
| | 4 | — | 100 | — | — | — | — |
| Curing agent | DDM 40% solution | 7.5 | 45 | 25.4 | 9 | 18.5 | 25.4 |
| | TMP 10% solution | 12 | — | — | 26 | 3.8 | — |
| Catalyst | Dioctyl tin dilaurate | 3 | 3 | 3 | 3 | 3 | 3 |
| Siloxane-based compound | SH8400 | — | — | — | — | — | — |
| | FZ-2110 | 15 | — | 20 | — | — | 5 |
| | SF8416 | — | 20 | — | 10 | 10 | — |
| Equivalent ratio | | 1 | 1.5 | 0.9 | 1 | 1.1 | 0.9 |
| Amont of siloxane-based compound in 100 parts by mass of surface layer | [mass parts] | 12 | 14 | 15 | 8 | 8 | 4 |

TABLE 2B

| Materials | | Blade 7 | Blade 8 | Blade 9 | Blade 10 | Blade 11 | Blade 12 |
|---|---|---|---|---|---|---|---|
| Prepolymer | 1 | 100 | — | — | — | — | 100 |
| | 2 | — | — | — | — | — | — |
| | 3 | — | — | — | 100 | — | — |
| | 4 | — | — | 100 | — | — | — |
| Curing agent | DDM 40% solution | 15.2 | — | 52 | 9 | — | 15.2 |

TABLE 2B-continued

| Materials | | Blade 7 | Blade 8 | Blade 9 | Blade 10 | Blade 11 | Blade 12 |
|---|---|---|---|---|---|---|---|
| | TMP 10% solution | 39 | — | — | 26 | — | 39 |
| Catalyst | Dioctyl tin dilaurate | 3 | — | 3 | 3 | — | 3 |
| Siloxane-based compound | SH8400 | — | — | — | — | — | — |
| | FZ-2110 | — | — | 15 | — | — | — |
| | SF8416 | — | — | — | 10 | — | 20 |
| Equivalent ratio | | 1.2 | — | 1.3 | 0.6 | — | 1.2 |
| Amount of siloxane-based compound in 100 parts by mass of surface layer | [mass parts] | 0 | 0 | 11 | 8 | 0 | 15 |

<Production of Cleaning Blade>

A bottom surface of the base material having a thickness of 1.8 mm in the shape of a strip was masked with leaving a 4 mm-width from the edge surface of the base material. The above-presented curable composition was applied onto the bottom surface of the base material to form a surface layer having various average film thicknesses.

Specifically, the entire surface of the bottom surface of the base material was overcoated from the edge surface of the base material by moving a spray gun at the spray gun traveling speed of 6 mm/s by spray coating. Thereafter, the masking was removed, and the resultant was heated for 1 hour in a constant-temperature chamber of 90° C., followed by leaving to stand in a constant-temperature chamber of 45° C./90% RH for 48 hours to complete a reaction. Thereafter, the resultant was cut at the position that was 1 mm from the edge surface to form an abutment.

Next, each elastic member in which the surface layer had been formed at the abutment thereof was fixed to a metal plate holder (supporting member) with an adhesive in order for the elastic member to be mountable in a color multi-function peripheral (IMAGIO MP C4500, available from Ricoh Company Limited). In the manner as described above, Cleaning Blades 1 to 12, in each of which the surface layer had been formed at the abutment thereof, was produced.

Note that, Cleaning Blade 11 is an equivalent to the cleaning blade of Example 1 of Unexamined Japanese Patent Application Publication No. 2015-96890.

Various properties of the produced cleaning blades were measured in the following manner. The results are presented in Tables 3A and 3B.

<Average Film Thickness of Surface Layer>

Figure 7:
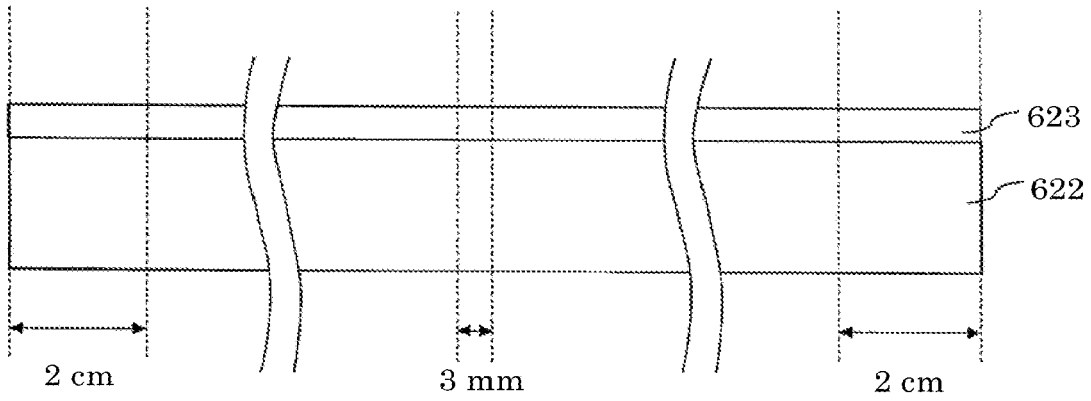
FIG. 7 is a view for describing an example of a measuring method of an average thickness of a surface layer.

FIG. 7 is a cross-sectional view illustrating a measuring position of the thickness of the abutment of the cleaning blade.

As illustrated in FIG. 7, the elastic member was sliced along a plane orthogonal to the longitudinal direction, and the cut cross-section was placed to face upwards and observed under a digital microscope VHX-2000 (available from KEYENCE CORPORATION). The measuring position was at the cross-section of the abutment of the blade (tip ridgeline part).

As a method for slicing the elastic member, the elastic member was cut vertically relative to the longitudinal direction of the elastic member using a razor in a manner that a thickness of the elastic member in the longitudinal direction was to be 3 mm. When the elastic member was cut, use of a vertical slicer could make a clean cross-section. The position at which the elastic member relative to the longitudinal direction was sliced was a position excluding a section that was 2 cm from the both edges.

<Martens Hardness of Surface Layer>

The Martens hardness (HM) of the surface layer was measured by means of a nanoindenter ENT-3100 available from ELIONIX INC. according to ISO 14577 by pressing the Berkovich indenter for 10 seconds with a load of 1,000 μN, retaining the pressure for 5 seconds, and releasing for 10 seconds at the same loading rate. Moreover, the Martens hardness of the surface layer was measured in the same manner except that the load was changed to 1 μN, and to 50 μN.

As illustrated in FIG. 10C, the base material was cut out in the state where the surface layer was formed on the bottom surface of the base material, and the base material was fixed onto a glass slide in a manner that the surface layer 623 faced upwards with an adhesive or a double-sided tape. Note that, the measuring position was set to a position that was 20 μm from the tip ridgeline part in the depth direction. Note that, the measuring position was the position excluding an area that was 2 cm from each of the both ends.

<Creep of Surface Layer>

In the same manner as in the measurement of the Martens hardness, the creep (CIT) of the surface layer was measured by means of a nanoindenter ENT-3100 available from ELIONIX INC. according to ISO14577 by pressing the Berkovich indenter for 10 seconds with a load of 1,000 μN, retaining the pressure for 5 seconds, and releasing for 10 seconds at the same loading rate. Moreover, the creep of the surface layer was measured in the same manner except that the load was changed to 1 μN, and to 50 μN.

As illustrated in FIG. 10C, the base material was cut out in the state where the surface layer was formed on the bottom surface of the base material, and the base material was fixed onto a glass slide in a manner that the surface layer 623 faced upwards with an adhesive or a double-sided tape. Note that, the measuring position was set to a position that was 20 μm from the tip ridgeline part in the depth direction. Note that, the measuring position was the position excluding an area that was 2 cm from each of the both ends.

<Coefficient of Dynamic Friction of Surface Layer>

The cleaning blade was pressed (cleaning angle: 79°, linear pressure: 20 g/cm) against a metal plate member on a surface of which a polycarbonate sheet having the average thickness of 150 μm was arranged. The cleaning blade was then moved at the rate of 20 mm/s, to measure a coefficient of dynamic friction (μk) by means of a load-variable friction and abrasion test system (TYPE: HHS2000, SHINTO Scientific Co., Ltd.).

TABLE 3A

| | | Blade 1 | Blade 2 | Blade 3 | Blade 4 | Blade 5 | Blade 6 |
|---|---|---|---|---|---|---|---|
| Average film thickness of surface layer [μm] | | 50 | 20 | 300 | 500 | 80 | 100 |
| Martens hardness HM [N/mm$^2$] | Load: 1 μN | 9.8 | 32.5 | 14.0 | 7.5 | 17.4 | 15.3 |
| | Load: 50 μN | 7.4 | 17.8 | 6.8 | 4.4 | 10.2 | 7.2 |
| | Load: 1,000 μN | 5.0 | 9.5 | 3.5 | 2.5 | 4.0 | 3.8 |
| Creep CIT [%] | Load: 1 μN | 11.2 | 10.0 | 13.5 | 12.4 | 11.6 | 12.8 |
| | Load: 50 μN | 8.8 | 6.2 | 10.8 | 9.0 | 9.1 | 9.6 |
| | Load: 1,000 μN | 6.4 | 3.0 | 7.5 | 6.5 | 5.0 | 7.0 |
| Coefficient of dynamic friction μk [−] | | 0.37 | 0.30 | 0.45 | 0.50 | 0.40 | 0.47 |
| Region of surface layer [mm] | | 3 | 3 | 6 | 3 | 3 | 1 |

TABLE 3B

| | | Blade 7 | Blade 8 | Blade 9 | Blade 10 | Blade 11 | Blade 12 |
|---|---|---|---|---|---|---|---|
| Average film thickness of surface layer [μm] | | 150 | — | 100 | 550 | — | 150 |
| Martens hardness HM [N/mm$^2$] | Load: 1 μN | 28.7 | 4.0 | 52.4 | 7.6 | 4.3 | 26.3 |
| | Load: 50 μN | 17.2 | 1.0 | 41.9 | 4.7 | 2.8 | 14.4 |
| | Load: 1,000 μN | 9.8 | 0.7 | 35.0 | 2.7 | 4.9 | 7.5 |
| Creep CIT [%] | Load: 1 μN | 10.2 | 3.8 | 9.3 | 7.7 | 4.3 | 10.4 |
| | Load: 50 μN | 6.7 | 1.1 | 6.8 | 5.0 | 5.2 | 7.3 |
| | Load: 1,000 μN | 3.3 | 0.7 | 2.8 | 3.3 | 4.7 | 4.5 |
| Coefficient of dynamic friction μk [−] | | 0.46 | 0.90 | 0.30 | 0.53 | 0.35 | 0.43 |
| Region of surface layer [mm] | | 3 | — | 3 | 3 | — | 5 |

<Production of Toner>

Production Example 1

<<<Production of Reactive Precursor (a1) of Polyester Resin (A)>>>

First, a reaction tank equipped with a cooling tube, a stirrer, and a nitrogen-inlet tube was charged with 3-methyl-1,5-pentanediol serving as a diol component, isophthalic acid/adipic acid (molar ratio: 30/70) serving as a dicarboxylic acid component, 0.5 mol % of trimellitic anhydride relative to a total amount of the monomers, in a manner that a molar ratio of the hydroxyl group to the carboxylic acid (OH/COOH) was to be 1.7. In addition, 1,000 ppm of tetrabutyl orthotitanate serving as a condensation catalyst relative to a total amount of the monomers was added. The resultant mixture was heated to 200° C. for 2 hours under a nitrogen flow, the temperature was further elevated to 230° C. for 2 hours, and the mixture was allowed to react for 3 hours with removing generated water. Thereafter, the resultant was allowed to react for 5 hours under the reduced pressure of from 5 mmHg through 15 mmHg, to thereby obtain [Intermediate Polyester 1] having a weight average molecular weight of 5,500.

Subsequently, a reaction tank equipped with a cooling tube, a stirrer, and a nitrogen-inlet tube was charged with [Intermediate Polyester 1] and isophorone diisocyanate (IPDI) in a manner that a molar ratio (NCO/OH) of the isocyanate groups of IPDI to the hydroxyl groups of [Intermediate Polyester 1] was to be 2.0. To the reaction tank, ethyl acetate was added to dissolve IPDI and [Intermediate Polyester 1] to form a 50% ethyl acetate solution. Thereafter, the resultant was heated to 80° C. under a nitrogen flow to react for 5 hours, to thereby obtain an ethyl acetate solution of [Reaction Precursor (a1)] that was a reactive precursor of Polyester Resin (A).

A glass transition temperature of an amine elongation product of the obtained [Reactive Precursor (a1)] determined from a DSC curve of first heating in DSC was −51° C.

The amine elongation product of [Reactive Precursor (a1)] was obtained by adding ethyl acetate to prepare a 20% ethyl acetate solution of [Reactive Precursor (a1)], dripping, with stirring, a 20% ethyl acetate solution of isophoronediamine (IPDA) in a manner that a molar ratio ($NH_2$/NCO) of isocyanate groups of [Reactive Precursor (a 1)] and the amino groups of IPDA was to be 1.1. The obtained ethyl acetate solution of the amine elongation product was casted onto a Teflon (registered trademark) petri dish, dried for 10 hours in the environment of 80° C., and further dried under the reduced pressure in the environment of 120° C. and kPa or less to sufficiently remove the solvent, to thereby obtain an amino elongation product of [Reactive Precursor (a1)].

Production Example 2

<<<Production of Reactive Precursor (a2) of Polyester Resin (A)>>>

A reaction tank equipped with a cooling tube, a stirrer, and a nitrogen-inlet tube was charged with 3-methyl-1,5-pentanediol/an ethylene oxide (2 mol) adduct of bisphenol A (molar ratio: 20/80) as a diol component, isophthalic acid/adipic acid (molar ratio: 60/40) as a dicarboxylic acid component, 0.5 mol % of trimellitic anhydride relative to a total amount of the monomer in a manner that a molar ratio (OH/COOH) of the hydroxyl groups and the carboxylic acid was to be 1.2. Moreover, 1,000 ppm of tetrabutyl orthtitanate serving as a condensation catalyst relative to a total amount of the monomers was added. The resultant mixture was heated to 200° C. for 2 hours under a nitrogen flow, the temperature was further elevated to 230° C. for 2 hours, and the mixture was allowed to react for 3 hours with removing generated water. Thereafter, the resultant was allowed to react for 5 hours under the reduced pressure of from 5 mmHg through 15 mmHg, to thereby obtain [Intermediate Polyester 2] having a weight average molecular weight of 18,000.

Subsequently, a reaction tank equipped with a cooling tube, a stirrer, and a nitrogen-inlet tube was charged with [Intermediate Polyester 2] and isophorone diisocyanate (IPDI) in a manner that a molar ratio (NCO/OH) of the isocyanate groups of IPDI to the hydroxyl groups of [Intermediate Polyester 2] was to be 2.0. To the reaction tank, ethyl acetate was added to dissolve IPDI and [Intermediate Polyester 2] to form a 50% ethyl acetate solution. Thereafter, the resultant was heated to 80° C. under a nitrogen flow to react for 5 hours, to thereby obtain an ethyl acetate solution of [Reaction Precursor (a2)] that was a reactive precursor of Polyester Resin (A).

A glass transition temperature of an amine elongation product of the obtained [Reactive Precursor (a2)] determined from a DSC curve of first heating in DSC was 8° C.

An amine elongation product of [Reactive Precursor (a2)] was obtained in the same manner as in Production Example 1.

Production Example 3

<<<Production of Reactive Precursor (a3) of Polyester Resin (A)>>>

A reaction tank equipped with a cooling tube, a stirrer, and a nitrogen-inlet tube was charged with 3-methyl-1,5-pentanediol as a diol component, and sebacic acid as a dicarboxylic acid component, 0.5 mol % of trimethylol propane relative to a total amount of the monomers, and 0.5 mol % of trimellitic anhydride relative to a total amount of the monomers in a manner that a molar ratio (OH/COOH) of the hydroxyl groups and the carboxylic acid was to be 1.2. Moreover, 1,000 ppm of tetrabutyl orthtitanate serving as a condensation catalyst relative to a total amount of the monomer was added. The resultant mixture was heated to 200° C. for 2 hours under a nitrogen flow, the temperature was further elevated to 230° C. for 2 hours, and the mixture was allowed to react for 3 hours with removing generated water. Thereafter, the resultant was allowed to react for 5 hours under the reduced pressure of from 5 mmHg through 15 mmHg, to thereby obtain [Intermediate Polyester 3] having a weight average molecular weight of 16,000.

Subsequently, a reaction tank equipped with a cooling tube, a stirrer, and a nitrogen-inlet tube was charged with [Intermediate Polyester 3] and isophorone diisocyanate (IPDI) in a manner that a molar ratio (NCO/OH) of the isocyanate groups of IPDI to the hydroxyl groups of [Intermediate Polyester 3] was to be 2.0. To the reaction tank, ethyl acetate was added to dissolve IPDI and [Intermediate Polyester 3] to form a 50% ethyl acetate solution. Thereafter, the resultant was heated to 80° C. under a nitrogen flow to react for 5 hours, to thereby obtain an ethyl acetate solution of [Reaction Precursor (a3)] that was a reactive precursor of Polyester Resin (A).

A glass transition temperature of an amine elongation product of the obtained [Reactive Precursor (a3)] determined from a DSC curve of first heating in DSC was −66° C.

An amine elongation product of [Reactive Precursor (a3)] was obtained in the same manner as in Production Example 1.

Production Example 4

<<<Production of Reactive Precursor (a4) of Polyester Resin (A)>>>

A reaction tank equipped with a cooling tube, a stirrer, and a nitrogen-inlet tube was charged with 3-methyl-1,5-pentanediol as a diol component, terephthalic acid/adipic acid (molar ratio: 55/45) as a dicarboxylic acid component, 1.0 mol % of trimethylolpropane relative to a total amount of the monomers, and 0.5 mol % of trimellitic anhydride relative to a total amount of the monomers in a manner that a molar ratio (OH/COOH) of the hydroxyl groups and the carboxylic acid was to be 1.5. Moreover, 1,000 ppm of tetrabutyl orthtitanate serving as a condensation catalyst relative to a total amount of the monomers was added. The resultant mixture was heated to 200° C. for 2 hours under a nitrogen flow, the temperature was further elevated to 230° C. for 2 hours, and the mixture was allowed to react for 3 hours with removing generated water. Thereafter, the resultant was allowed to react for 5 hours under the reduced pressure of from 5 mmHg through 15 mmHg, to thereby obtain [Intermediate Polyester 4] having a weight average molecular weight of 18,000.

Subsequently, a reaction tank equipped with a cooling tube, a stirrer, and a nitrogen-inlet tube was charged with [Intermediate Polyester 4] and isophorone diisocyanate (IPDI) in a manner that a molar ratio (NCO/OH) of the isocyanate groups of IPDI to the hydroxyl groups of [Intermediate Polyester 4] was to be 2.0. To the reaction tank, ethyl acetate was added to dissolve IPDI and [Intermediate Polyester 4] to form a 50% ethyl acetate solution. Thereafter, the resultant was heated to 80° C. under a nitrogen flow to react for 5 hours, to thereby obtain an ethyl acetate solution of [Reaction Precursor (a4)] that was a reactive precursor of Polyester Resin (A).

A glass transition temperature of an amine elongation product of the obtained [Reactive Precursor (a4)] determined from a DSC curve of first heating in DSC was −37° C.

An amine elongation product of [Reactive Precursor (a4)] was obtained in the same manner as in Production Example 1.

Production Example 5

<<<Production of Reactive Precursor (a5) of Polyester Resin (A)>>>

A reaction tank equipped with a cooling tube, a stirrer, and a nitrogen-inlet tube was charged with 3-methyl-1,5-pentanediol as a diol component, and sebacic acid as a dicarboxylic acid component, and 0.5 mol % of trimethylol propane relative to a total amount of the monomers in a manner that a molar ratio (OH/COOH) of the hydroxyl groups and the carboxylic acid was to be 1.6. Moreover, 1,000 ppm of tetrabutyl orthtitanate serving as a condensation catalyst relative to a total amount of the monomer was added. The resultant mixture was heated to 200° C. for 2 hours under a nitrogen flow, the temperature was further elevated to 230° C. for 2 hours, and the mixture was allowed to react for 3 hours with removing generated water. Thereafter, the resultant was allowed to react for 5 hours under the reduced pressure of from 5 mmHg through 15 mmHg, to thereby obtain [Intermediate Polyester 5] having a weight average molecular weight of 7,500.

Subsequently, a reaction tank equipped with a cooling tube, a stirrer, and a nitrogen-inlet tube was charged with [Intermediate Polyester 5] and isophorone diisocyanate (IPDI) in a manner that a molar ratio (NCO/OH) of the isocyanate groups of IPDI to the hydroxyl groups of [Intermediate Polyester 5] was to be 2.0. To the reaction tank, ethyl acetate was added to dissolve IPDI and [Intermediate Polyester 5] to form a 50% ethyl acetate solution. Thereafter, the resultant was heated to 80° C. under a nitrogen flow to react for 5 hours, to thereby obtain an ethyl acetate solution of [Reaction Precursor (a5)] that was a reactive precursor of Polyester Resin (A).

A glass transition temperature of an amine elongation product of the obtained [Reactive Precursor (a5)] determined from a DSC curve of first heating in DSC was −70° C.

An amine elongation product of [Reactive Precursor (a5)] was obtained in the same manner as in Production Example 1.

Production Example 6

<<<Production of Reactive Precursor (a6) of Polyester Resin (A)>>>

A reaction tank equipped with a cooling tube, a stirrer, and a nitrogen-inlet tube was charged with an ethylene oxide (2 mol) adduct of bisphenol A/a propylene oxide (2 mol) adduct of bisphenol A (molar ratio: 80/20) as a diol component, terephthalic acid/adipic acid (molar ratio: 85/15) as a dicarboxylic acid, and 1.0 mol % of trimellitic anhydride relative to a total amount of the monomers in a manner that a molar ratio (OH/COOH) of the hydroxyl groups and the carboxylic acid was to be 1.2. Moreover, 1,000 ppm of tetrabutyl orthtitanate serving as a condensation catalyst relative to a total amount of the monomers was added. The resultant mixture was heated to 200° C. for 2 hours under a nitrogen flow, the temperature was further elevated to 230° C. for 2 hours, and the mixture was allowed to react for 3 hours with removing generated water. Thereafter, the resultant was allowed to react for 5 hours under the reduced pressure of from 5 mmHg through 15 mmHg, to thereby obtain [Intermediate Polyester 6] having a weight average molecular weight of 10,000.

Subsequently, a reaction tank equipped with a cooling tube, a stirrer, and a nitrogen-inlet tube was charged with [Intermediate Polyester 6] and isophorone diisocyanate (IPDI) in a manner that a molar ratio (NCO/OH) of the isocyanate groups of IPDI to the hydroxyl groups of [Intermediate Polyester 6] was to be 2.0. To the reaction tank, ethyl acetate was added to dissolve IPDI and [Intermediate Polyester 6] to form a 50% ethyl acetate solution. Thereafter, the resultant was heated to 80° C. under a nitrogen flow to react for 5 hours, to thereby obtain an ethyl acetate solution of [Reaction Precursor (a6)] that was a reactive precursor of Polyester Resin (A).

A glass transition temperature of an amine elongation product of the obtained [Reactive Precursor (a6)] determined from a DSC curve of first heating in DSC was 55° C.

An amine elongation product of [Reactive Precursor (a6)] was obtained in the same manner as in Production Example 1.

Production Example 7

<<<Production of Polyester Resin (B1)>>>

A reaction tank equipped with a cooling tube, a stirrer, and a nitrogen-inlet tube was charged with an ethylene oxide (2 mol) adduct of bisphenol A/a propylene oxide (3 mol) adduct of bisphenol A (molar ratio: 40/60) as a diol component, terephthalic acid/adipic acid (molar ratio: 85/15) as a dicarboxylic acid component, and 3.5 mol % of trimethylolpropane relative to a total amount of the monomers in a manner that a molar ratio (OH/COOH) of the hydroxyl groups and the carboxylic acid was to be 1.2.

Moreover, 1,000 ppm of tetrabutyl orthtitanate serving as a condensation catalyst relative to a total amount of the monomers was added. The resultant mixture was heated to 230° C. for 2 hours under a nitrogen flow, and the mixture was allowed to react for 5 hours with removing generated water. Thereafter, the resultant was allowed to react for 4 hours under the reduced pressure of from 5 mmHg through 15 mmHg. After cooling the resultant to 180° C., 1.0 mol % of trimellitic anhydride relative to a total amount of the monomers, and 200 ppm of tetrabutyl orthotitanate relative to a total amount of the monomers were added, and the resultant mixture was allowed to react for 1 hour at 180° C. Thereafter, the resultant was further allowed to react for 3 hours under the reduced pressure of from 5 mmHg through 20 mmHg, to thereby obtain [Polyester Resin (B1)] having a glass transition temperature of 57° C. and a weight average molecular weight of 7,700 where the glass transition temperature was determined from a DSC curve of first heating in DSC.

Production Example 8

<<<Production of Polyester Resin (B2)>>>

A reaction tank equipped with a cooling tube, a stirrer, and a nitrogen-inlet tube was charged with an ethylene oxide (2 mol) adduct of bisphenol A/a propylene oxide (2 mol) adduct of bisphenol A (molar ratio: 85/15) as a diol component, and isophthalic acid/adipic acid (molar ratio: 80/20) as a dicarboxylic acid component in a manner that a molar ratio (OH/COOH) of the hydroxyl groups and the carboxylic acid was to be 1.2.

Moreover, 1,000 ppm of tetrabutyl orthtitanate serving as a condensation catalyst relative to a total amount of the monomers was added. The resultant mixture was heated to 230° C. for 2 hours under a nitrogen flow, and the mixture was allowed to react for 5 hours with removing generated water. Thereafter, the resultant was allowed to react for 4 hours under the reduced pressure of from 5 mmHg through 15 mmHg. After cooling the resultant to 180° C., 1.0 mol % of trimellitic anhydride relative to a total amount of the monomers, and 200 ppm of tetrabutyl orthotitanate relative to a total amount of the monomers were added, and the resultant mixture was allowed to react for 1 hour at 180° C. Thereafter, the resultant was further allowed to react for 3 hours under the reduced pressure of from 5 mmHg through 20 mmHg, to thereby obtain [Polyester Resin (B2)] having a glass transition temperature of 47° C. and a weight average molecular weight of 5,800 where the glass transition temperature was determined from a DSC curve of first heating in DSC.

Production Example 9

<<<Production of Polyester Resin (B3)>>>

A reaction tank equipped with a cooling tube, a stirrer, and a nitrogen-inlet tube was charged with an ethylene oxide (2 mol) adduct of bisphenol A/a propylene oxide (2 mol) adduct of bisphenol A (molar ratio: 20/80) as a diol component, and terephthalic acid/adipic acid (molar ratio: 90/10) as a dicarboxylic acid component in a manner that the molar ratio (OH/COOH) of the hydroxyl groups and the carboxylic acid was to be 1.2.

Moreover, 1,000 ppm of tetrabutyl orthtitanate serving as a condensation catalyst relative to a total amount of the monomers was added. The resultant mixture was heated to 230° C. for 2 hours under a nitrogen flow, and the mixture was allowed to react for 5 hours with removing generated water. Thereafter, the resultant was allowed to react for 4 hours under the reduced pressure of from 5 mmHg through 15 mmHg. After cooling the resultant to 180° C., 1.0 mol % of trimellitic anhydride relative to a total amount of the monomers, and 200 ppm of tetrabutyl orthotitanate relative to a total amount of the monomers were added, and the resultant mixture was allowed to react for 1 hour at 180° C. Thereafter, the resultant was further allowed to react for 3 hours under the reduced pressure of from 5 mmHg through 20 mmHg, to thereby obtain [Polyester Resin (B3)] having a glass transition temperature of 67° C. and a weight average molecular weight of 8,900 where the glass transition temperature was determined from a DSC curve of first heating in DSC.

Production Example 10

<<<Production of Crystalline Polyester Resin Dispersion Liquid>>>

A reaction tank equipped with a cooling tube, a stirrer, and a nitrogen-inlet tube was charged with 1,6-hexanediol as a diol component, and sebasic acid as a dicarboxylic acid in a manner that a molar ratio (OH/COOH) of the hydroxyl groups and the carboxylic acid was to be 1.2. Moreover, 500 ppm of titanium dihydroxybis(triethanolaminate) serving as a condensation catalyst relative to a total amount of the monomers was added. The resultant mixture was heated to 180° C. for 2 hours under a nitrogen flow, and the mixture was allowed to react for 8 hours with removing generated water. While the temperature was gradually elevated to 220° C., the resultant was allowed to react for 4 hours under a nitrogen flow with removing generated water. Furthermore, [Crystalline Polyester Resin] having a melting point of 67° C. and a weight average molecular weight of 20,000 was obtained under the reduced pressure of from 5 mmHg through 20 mmHg.

Subsequently, a reaction vessel equipped with a cooling tube, a thermometer, and a stirrer was charged with 10 parts by mass of [Crystalline Polyester Resin] and 90 parts by mass of ethyl acetate. The resultant mixture was heated to 78° C. to sufficiently dissolve, and the resultant was sufficiently cooled to 30° C. for 1 hour with stirring. Thereafter, wet pulverization was performed on the resultant by means of ULTRA VISCOMILL (available from AIMEX CO., Ltd.) under the conditions that a liquid feeding rate was 1 kg/hr, a disk circumferential velocity was 10 m/sec, zirconia beads each having a diameter of 0.5 mm were packed in the amount of 80% by volume, and the number of passes was 6. To the resultant, ethyl acetate was added to adjust a solid content, to thereby obtain [Crystalline Polyester Resin Dispersion Liquid] having a solid content of 10%.

Production Example 11

<<<Production of Colorant Master Batch (P1)>>>

[Polyester Resin (B1)] (100 parts by mass), 100 parts by mass of a black pigment (carbon black), and 50 parts by mass of ion-exchanged water were sufficiently mixed, and kneaded by means of an open-roll kneader (Kneadex, available from NIPPON COKE & ENGINEERING CO., LTD.). The kneading was performed at a temperature of 80° C. Thereafter, the temperature was increased to 120° C. to remove water, to thereby obtain [Colorant Master Batch (P1)] having a ratio (mass ratio) of the resin to the pigment being 1:1.

Production Example 12

<<<Production of Colorant Master Batch (P2)>>>

[Polyester Resin (B2)] (100 parts by mass), 100 parts by mass of a black pigment (carbon black), and 50 parts by mass of ion-exchanged water were sufficiently mixed, and kneaded by means of an open-roll kneader (Kneadex, available from NIPPON COKE & ENGINEERING CO., LTD.). The kneading was performed at a temperature of 80° C. Thereafter, the temperature was increased to 120° C. to remove water, to thereby obtain [Colorant Master Batch (P2)] having a ratio (mass ratio) of the resin to the pigment being 1:1.

Production Example 13

<<<Production of Colorant Master Batch (P3)>>>

[Polyester Resin (B3)] (100 parts by mass), 100 parts by mass of a black pigment (carbon black), and 50 parts by mass of ion-exchanged water were sufficiently mixed, and kneaded by means of an open-roll kneader (Kneadex, available from NIPPON COKE & ENGINEERING CO., LTD.). The kneading was performed at a temperature of 80° C. Thereafter, the temperature was increased to 120° C. to remove water, to thereby obtain [Colorant Master Batch (P3)] having a ratio (mass ratio) of the resin to the pigment being 1:1.

Production Example 14

<<<Production of Wax Dispersion Liquid>>>

A reaction vessel equipped with a cooling tube, a thermometer, and a stirrer was charged with 20 parts by mass of paraffin wax (HNP-9 (melting point: 75° C.), available from NIPPON SEIRO CO., LTD.), and 80 parts by mass of ethyl acetate, and the resultant mixture was sufficiently heated to 78° C. After cooling the mixture to 30° C. for 1 hour with stirring, wet pulverization was performed by means of ULTRA VISCOMILL (available from AIMEX CO., Ltd.) under conditions that a liquid feeding rate was 1.0 Kg/hr, a disk circumferential velocity was 10 m/sec, zirconia beads each having a diameter of 0.5 mm were packed in the amount of 80% by volume, and the number of passes was 6. To the resultant, ethyl acetate was added to adjust a solid content, to thereby produce [Wax Dispersion Liquid] having a solid content of 20%.

Production Example 15

<<<Production of Particle Size Controlling Agent [Resin Particles Emulsion]>>>

A reaction vessel equipped with a cooling tube, a thermometer, and a stirrer was charged with 683 parts of water, 11 parts of sodium salt of sulfuric acid ester of methacrylic acid-ethylene oxide adduct (ELEMINOL RS-30, available from Sanyo Chemical Industries, Ltd.), 83 parts of styrene, 83 parts of methacrylic acid, 110 parts of butyl acrylate, and 1 part of ammonium persulfate. The resultant mixture was stirred for 15 minutes at 400 rpm, followed by heated to 75° C. to react for 5 hours. To the resultant, moreover, 30 parts of a 1% ammonium persulfate aqueous solution was added, and the resultant mixture was heated at 75° C. for 5 hours, to thereby obtain a particle size controlling agent [Resin Particle Emulsion] formed of styrene-methacrylic acid-butyl acrylate-sodium salt of sulfuric acid ester of methacrylic acid ethylene oxide adduct copolymer. A volume average particle diameter of [Resin Particle Emulsion] as measured by LA-920 was 50 nm.

Production Example 16

<<<Production of Carrier>>>

As cores, 5,000 parts by mass of Mn ferrite particles (weight average particle diameter: 35 μm) was prepared. As a coating material, 300 parts by mass of toluene, 300 parts by mass of butyl cellosolve, 60 parts by mass of an acrylic resin solution (composition ratio: methacrylic acid:methyl methacrylate:2-hydroxyethyl acrylate=5:9:3, a toluene solution having a solid content of 50% by weight, Tg: 38° C.), 15 parts by weight of a N-tetramethoxymethylbenzoguanamine resin solution (degree of polymerization: 1.5, a toluene solution having a solid content of 77% by weight), and 15 parts by weight of alumina particles (average primary particle diameter: 0.30 μm) were dispersed by a stirrer for 10 minutes to prepare a coating liquid. The cores were coated with the prepared coating liquid by charging a coating device with the cores and the coating liquid where the coating device was equipped with a stirring blade and a rotatable bottom plate disk and was configured to form a swirl flow of the cores and the coating liquid in a fluidized bed. The obtained coated product was fired in an electric furnace at 220° C. for 2 hours to thereby obtain [Carrier].

<<Production of Toner 1>>

A vessel equipped with a stirrer and a thermoset was charged with 75 parts by mass of ion-exchanged water, 1 part by mass of sodium carboxy methyl cellulose, 16 parts by mass of a 48.5% sodium dodecyldiphenyl ether disulfonate aqueous solution (ELEMINOL MON-7, available from Sanyo Chemical Industries, Ltd.), and 5 parts by mass of ethyl acetate. The resultant mixture was mixed and stirred. To the resultant, an equivalent amount of [Resin Particle Emulsion] to 0.3 parts of the solid content of [Resin Particle Emulsion] was added to prepare an aqueous phase solution.

Next, another vessel equipped with a thermometer and a stirrer was charged with 82 parts by mass of [Polyester Resin (B1)], 50 parts by mass of [Crystalline Polyester Resin Dispersion Liquid], 25 parts by mass of [Wax Dispersion Liquid], and 16 parts by mass of [Colorant Master Batch (P1)]. To the resultant mixture, ethyl acetate was added to make a solid content 30% by mass. The resultant was stirred to sufficiently dissolve. Moreover, the resultant was stirred by means of TK Homomixer (available from PRIMIX Corporation) at 8,000 rpm to homogeneously dissolve and disperse. Subsequently, isophoronediamine (IPDA) in the amount with which a molar ratio ($NH_2$/NCO) of amino groups of IPDA and isocyanate groups of [Reactive Precursor (a1)] was to be 0.98 was added. The resultant was stirred by means of TK Homomixer for 15 seconds at the rotational speed of 8,000 rpm. Subsequently, 20 parts by mass of [Reactive Precursor (a1)] prepared into a 50% ethyl acetate solution was added. The resultant was stirred by means of TK Homomixer for 30 seconds at the rotational speed of 8,000 rpm, to thereby obtain [Oil Phase 1].

After preparing [Oil Phase 1], 50 parts by mass of [Oil Phase 1] was immediately added to the aqueous phase. The resultant mixture was mixed at the liquid temperature of from 30° C. through 40° C. by means of TK Homomixer (available from PRIMIX Corporation) for 1 minute at the rotational speed of 12,000 rpm, to thereby obtain an emulsified slurry.

Subsequently, another vessel equipped with a stirrer, a nitrogen-inlet tube, and a thermometer was charged with the obtained emulsified slurry. The emulsified slurry was heated to 50° C. with stirring to remove ethyl acetate in a nitrogen flow. To the resultant, a 10% by mass sodium hydroxide aqueous solution was added to adjust the pH of the slurry to 12. The resultant was heated for 10 hours in the environment of 45° C. to melt and remove the particle size controlling agent deposited on the surfaces of the droplets, and the resultant was subjected to vacuum filtration to thereby obtain solids.

The obtained solids were subjected to a washing treatment including the following (1) to (4) operations.

(1) To the solids, 100 parts by mass of ion-exchanged water was added, and the resultant was mixed by TK Homomixer (for 5 minutes at the rotational speed of 6,000 rpm), followed by filtration to thereby obtain solids.

(2) To the solids obtained in (1), 100 parts by mass of a 10% by mass sodium hydroxide aqueous solution was added. The resultant was mixed by TK Homomixer (for 10 minutes at the rotational speed of 6,000 rpm), followed by vacuum filtration to thereby obtain solids.

(3) To the solids obtained in (2), 100 parts by mass of 10% by mass hydrochloric acid was added. The resultant was mixed by TK Homomixer (for 5 minutes at the rotational speed of 6,000 rpm), followed by filtration to thereby obtain solids.

(4) To the solids obtained in (3), 300 parts by mass of ion-exchanged water was added, and the resultant was mixed by TK Homomixer (for 5 minutes at the rotational speed of 6,000 rpm), followed by filtration. The same operation was performed again to thereby obtain solids.

The solids subjected to the washing treatment were dried by an air-circulating drier for 48 hours at 45° C. Then, the dried solids were passed through a mesh having an opening size of 75 μm, to thereby produce [Toner Base Particles 1].

To 100 parts of [Toner Base Particles 1] obtained, 1.0 part by mass of hydrophobic silica (HDK-2000, available from Wacker Chemie AG) and 0.3 parts by mass of titanium oxide (MT-150AI, available from TAYCA CORPORATION) were mixed by means of HENSCHEL MIXER, to thereby prepare [Toner 1].

The components of Toner 1 obtained, and an amount (parts by mass) of each component relative to the entire toner are presented in Tables 4A and 4B. Moreover, physical property values of Toner 1 obtained are presented in Table 5.

<<Production of Toners 2 to 7>>

[Oil Phases 2 to 7] and [Toner Base Particles 2 to 7] were obtained in the same manner as in <Production of Toner 1>, except that [Reactive Precursor (a1)], [Polyester (B1)], and [Colorant Master Batch (P1)] were respectively replaced with [Reactive Precursors (a2 to a6)], [Polyester Resins (B2 to B3)], and [Colorant Master Batches (P2 to P3)] presented in Tables 4A and 4B. Moreover, [Toners 2 to 7] were produced in the same manner as in <Production of Toner 1>, except that [Toner Base Particles 1] were replaced with [Toner Base Particles 2 to 7].

The physical property values of Toners 2 to 7 obtained were presented in Table 5.

TABLE 4A

| | Polyester Resin (A) | | | Polyester Resin (B) | | |
|---|---|---|---|---|---|---|
| | Type of reaction precursor | Type of curing agent | Amount used (mass parts) | Type of resin | Amount used (mass parts) | Amount of crystalline resin used (mass parts) |
| Toner 1 | Reaction Precursor (a1) | IPDA | 10 | Polyester Resin (B1) | 90 | 5 |
| Toner 2 | Reaction Precursor (a2) | IPDA | 10 | Polyester Resin (B2) | 90 | 5 |
| Toner 3 | Reaction Precursor (a3) | IPDA | 12 | Polyester Resin (B3) | 88 | 5 |
| Toner 4 | Reaction Precursor (a4) | IPDA | 10 | Polyester Resin (BI) | 90 | 5 |
| Toner 5 | Reaction Precursor (a4) | IPDA | 10 | Polyester Resin (B2) | 90 | 5 |
| Toner 6 | Reaction Precursor (a5) | IPDA | 12 | Polyester Resin (B3) | 88 | 5 |
| Toner 7 | Reaction Precursor (a6) | IPDA | 10 | Polyester Resin (B2) | 90 | 5 |

TABLE 4B

| | Colorant master batch | | Amount of |
|---|---|---|---|
| | Type of master batch | Amount used (mass parts) | wax used (mass parts) |
| Toner 1 | Colorant Master Batch (P1) | 8 | 5 |
| Toner 2 | Colorant Master Batch (P2) | 8 | 5 |
| Toner 3 | Colorant Master Batch (P3) | 8 | 5 |
| Toner 4 | Colorant Master Batch (P1) | 8 | 5 |
| Toner 5 | Colorant Master Batch (P2) | 8 | 5 |
| Toner 6 | Colorant Master Batch (P3) | 8 | 5 |
| Toner 7 | Colorant Master Batch (P2) | 8 | 5 |

TABLE 5

| | Physical property values of THF-insoluble component | | | Physical property values of toner | |
|---|---|---|---|---|---|
| | Glass transition temperature (° C.) | Storage elastic modulus at 40° C. (Pa) | Storage elastic modulus at 120° C. (Pa) | Glass transition temperature (° C.) | Weight average particle diameter (μm) |
| Toner 1 | −45 | $2.6 \times 10^5$ | $8.8 \times 10^4$ | −45 | 5.2 |
| Toner 2 | 18 | $4.5 \times 10^6$ | $8.3 \times 10^4$ | 18 | 5.2 |
| Toner 3 | −60 | $1.2 \times 10^5$ | $8.7 \times 10^4$ | −60 | 5.3 |
| Toner 4 | −31 | $1.2 \times 10^6$ | $1.0 \times 10^6$ | −31 | 5.3 |
| Toner 5 | −33 | $1.1 \times 10^6$ | $9.7 \times 10^5$ | −33 | 5.3 |
| Toner 6 | −65 | $8.7 \times 10^4$ | $5.8 \times 10^4$ | −65 | 5.3 |
| Toner 7 | 54 | $8.6 \times 10^8$ | $3.4 \times 10^5$ | 54 | 5.2 |

<Production of Developer>

To 100 parts by mass of [Carrier], 7 parts by mass of [Toner] were added and the mixture was homogeneously mixed by means of TURBULA mixer (available from Willy A. Bachofen (WAB)), which was configured to roll a container thereof to stir, for 5 minutes at 48 rpm, to thereby obtain [Developer] that was a two-component developer.

<Assembly of Image Forming Apparatus>

The produced cleaning blade was mounted in a process cartridge of a color multifunction peripheral (IMAGIO MP C4500, available form Ricoh Company Limited) (a printer section of which had the identical structure to that of the image forming apparatus 500 illustrated in FIG. 5) to assemble each of Image Forming Apparatuses 1 to 12.

Note that, the cleaning blade was mounted in the manner that a linear pressure was to be 20 g/cm, and a cleaning angle was to be 79°. Moreover, the image forming apparatus included a lubricant coating device configured to apply a lubricant to a surface of a photoconductor. A coefficient of static friction of the surface of photoconductor was maintained to be 0.2 or less by applying the lubricant when image formation was not in progress. Note that, a measuring method of a coefficient of static friction of a surface of a photoconductor is disclosed, for example, as a method according to Euler's belt theory, in the paragraph [0046] disclosed in Unexamined Japanese Patent Application Publication No. 09-166919.

<Evaluation of Low-Temperature Fixability>

By means of each of Image Forming Apparatuses 1 to 12, a solid image (image size: 3 cm×8 cm) was performed on transfer paper (Photocopy sheet <70>, available from Ricoh Japan Corporation) with a monochrome mode in the manner that a deposition amount of the toner after transferring was to be 0.85±0.1 mg/cm$^2$, and fixing was performed with varying a temperature of a fixing belt.

The surface of the obtained fixed image was drawn with a ruby needle (tip radius: from 260 pmR through 320 pmR, tip angle: 60 degrees) at a load of 50 g by means of a drawing tester AD-401 (available from Ueshima Seisakusho Co., Ltd.), followed by strongly rubbing the drawn surface with fibers (HONECOTTO #440, available from Honylon Co., Ltd.) times. A temperature of the fixing belt at which any part of the image was hardly scraped was determined as the minimum fixing temperature. Moreover, the solid image was formed at the position of the transfer paper, which was 3.0 cm from the edge thereof relative to the feeding direction. Note that, the speed for passing through a nip of the fixing device was 280 mm/s. The lower the minimum fixing temperature is, the more excellent the low-temperature fixability is. The results are presented in Tables 6A and 6B.

[Evaluation Criteria]

Excellent: The minimum fixing temperature was 110° C. or lower.

Good: The minimum fixing temperature was 111° C. or higher but 120° C. or lower.

Satisfactory: The minimum fixing temperature was 121° C. or higher but 130° C. or lower.

Fair: The minimum fixing temperature was 131° C. or higher but 140° C. or lower.

Poor: The minimum fixing temperature was 141° C. or higher.

<Evaluation of Heat Resistant Storage Stability>

A 50 mL glass container was charged with 10 g of the toner, and the container was tapped until no change was observed in the apparent density of the toner powder. Then, a lid was placed on the container, and the container including the toner was left to stand in a constant-temperature chamber of 50° C. for 24 hours, followed by cooling to 24° C. Then, a penetration degree (mm) was measured by means of a penetration tester (JIS K2235-1991), and heat resistant storage stability was evaluated based on the following criteria. The larger the penetration degree is, more excellent heat resistant stability is. When the penetration degree is less than 15 mm (the result of "fair" or worse), it is more likely that a problem may occur on practical use. The results are presented in Tables 6A and 6B.

[Evaluation Criteria]

Excellent: The penetration degree was 25 mm or greater.

Good: The penetration degree was 20 mm or greater but less than 25 mm.

Satisfactory: The penetration degree was 15 mm or greater but less than 20 mm.

Fair: The penetration degree was 10 mm or greater but less than 15 mm.

Poor: The penetration degree was less than 10 mm.

<Durability Test>

By means of the image forming apparatus, a chart including 3 vertical bands pattern (relative to a traveling direction of a sheet) where each band having a width of 43 mm was output on 50,000 sheets (landscape orientation, A4 size) at 3 print/job in the experiment room environment of 28° C. and 80% RH. After printing the 50,000 sheets, an evaluation of a missing part of a cleaning blade and a noise evaluation were performed in the following manner.

<Evaluation of Missing Part of Cleaning Blade>

As an evaluation image, a chart including 3 vertical bands pattern (relative to a traveling direction of a sheet) where each band having a width of 43 mm was output on 20 sheets (landscape orientation, A4 size). Thereafter, the edge portion of the cleaning blade was observed under a microscope. Moreover, the obtained images were visually observed to evaluate the presence or absence of an image defect due to a cleaning failure. The evaluation of a missing part of the cleaning blade was evaluated from the results of the microscopic observation and visual observation based on the following evaluation criteria. The results are presented in Tables 6A and 6B.

[Evaluation Criteria]

Excellent: There was no missing part in the entire area of the cleaning blade.

Good: There was a toner adherence on an edge portion of the cleaning blade, but no missing part.

Poor: There was a missing part in the cleaning blade, and the toner passed through by a cleaning failure could be visually observed on printed paper.

<Noise Evaluation>

As an evaluation of noise, whether noise was generated or not at the time of image outputs of the evaluation of a missing part of the cleaning blade was confirmed with human ears, and the results were evaluated based on the following evaluation criteria. Even in the case where there were differences in the noise made, such as of high frequencies and of low frequencies, it was evaluated as the noise as long as it was noise generated from the blade. The results are presented in Tables 6A and 6B.

[Evaluation Criteria]

Good: No noise was generated.

Poor: Noise was generated.

TABLE 6A

| | | Example | | | | | | |
|---|---|---|---|---|---|---|---|---|
| | | 1 | 2 | 3 | 4 | 5 | 6 | 7 |
| | Cleaning blade | Blade 1 | Blade 2 | Blade 3 | Blade 4 | Blade 5 | Blade 6 | Blade 7 |
| | Toner | Toner 1 | Toner 2 | Toner 2 | Toner 3 | Toner 4 | Toner 4 | Toner 3 |
| Toner | Low temp. fixability | Excellent | Good | Good | Excellent | Excellent | Excellent | Excellent |
| | Heat resistant storage stability | Satisfactory | Satisfactory | Satisfactory | Satisfactory | Excellent | Excellent | Satisfactory |
| Durability test | Chipping of blade | Good | Excellent | Good | Good | Excellent | Good | Good |
| | Noise | Good | Good | Good | Good | Good | Good | Good |

TABLE 6B

| | | Comparative Example | | | | | |
|---|---|---|---|---|---|---|---|
| | | 1 | 2 | 3 | 4 | 5 | 6 |
| | Cleaning blade | Blade 8 | Blade 9 | Blade 10 | Blade 11 | Blade 12 | Blade 1 |
| | Toner | Toner 3 | Toner 3 | Toner 5 | Toner 5 | Toner 6 | Toner 7 |
| Toner | Low temp. fixability | Excellent | Excellent | Excellent | Excellent | Excellent | Poor |
| | Heat resistant storage stability | Satisfactory | Satisfactory | Satisfactory | Satisfactory | Poor | Excellent |
| Durability test | Chipping of blade | Poor | Poor | Poor | Poor | Good | Good |
| | Noise | Poor | Poor | Good | Poor | Good | Good |

Since the cleaning blades of Examples 1 to 7 had the appropriate range of the hardness and low coefficient of dynamic friction, the movement of the abutment of the elastic member could be suppressed, curling hardly occurred, edge portions thereof were not chipped when used with a toner having low-temperature fixability, excellent cleaning performance could be maintained even after usage of a long period, and generation of noise could be suppressed. Moreover, color shift did not occur in the tandem system image forming apparatus.

Since the surface layer was not formed at the abutment in Comparative Example 1, the movement of the abutment of the elastic member could not be suppressed, the base material was curled to cause friction, and therefore a cleaning failure and generation of noise occurred. Moreover, the toner entered the nip and many adherences of the deformed toner was observed.

Since sliding properties of the surface layer was high but the hardness thereof was too high in Comparative Example 2, the elastic member became brittle and chipping thereof was occurred. As a result, a defected image was formed due to the cleaning failure. Since the surface layer was too hard, moreover, squeaky noise of high-pitch tone was generated.

Since the coefficient of dynamic friction of the surface layer was high in Comparative Example 3, the edge of the elastic member curled, the toner entered the nip, and therefore the blade was chipped. Moreover, the adherence of the deformed toner on the edge portion was observed.

Since the coefficient of dynamic friction of the surface layer was low but the surface layer was not formed at the abutment and there was no hardness gradient in the depth direction of the abutment in Comparative Example 4, tracking to the image bearer was deteriorated as the edge portion was slightly abraded, and the toner passed through the nip and the adherence of the toner on the edge portion occurred. Moreover, the elastic member was exposed as abraded to increase the coefficient of dynamic friction and therefore noise was generated.

Since the glass transition temperature (Tg) of the THF-insoluble component of the toner determined from the DSC curve of the first heating in the differential scanning calorimetry (DSC) in Comparative Example 5, the heat resistant storage stability was deteriorated. Moreover, many adherences of the toner on the edge portion of the cleaning blade was observed.

Since the glass transition temperature (Tg) of the THF-insoluble component of the toner determined from the DSC curve of the first heating in differential scanning calorimetry (DSC) was high in Comparative Example 6, low-temperature fixability was deteriorated.

As described above, the image forming apparatus of the present disclosure include a developing unit configured to develop an electrostatic latent image formed on a surface of an image bearer with a toner to form a visible image, and a cleaning unit which includes an elastic member including a surface layer to be in contact with the surface of the image bearer, and is configured to remove the toner deposited on the surface of the image bearer with the elastic member. Moreover, Martens hardness A of the surface layer of the cleaning unit in the image forming apparatus of the present disclosure measured by applying a load of 1 μN to a predetermined position of the surface layer in a thickness direction of the surface layer using a nanoindenter and Martens hardness B of the surface layer measured by applying a load of 1,000 μN to the predetermined position of the surface layer in the thickness direction of the surface layer using the nanoindenter are both 2.5 $N/mm^2$ or greater but 32.5 $N/mm^2$ or less, and Martens hardness A and Martens hardness B satisfy an inequality [Martens hardness A>Martens hardness B]. Moreover, a coefficient of dynamic friction of the surface layer of the cleaning unit of the image forming apparatus of the present disclosure against polycarbonate is 0.5 or less. In addition, the toner in the image forming apparatus of the present disclosure includes a polyester resin insoluble to tetrahydrofuran (THF) and a glass transition temperature (Tg) of a THF-insoluble component of the toner determined from a DSC curve of first heating of differential scanning calorimetry (DSC) is −60° C. or higher but 20° C. or lower.

Therefore, the image forming apparatus of the present disclosure can suppress damages of the cleaning blade and maintain cleaning performance against an image bearer even when a toner having excellent low-temperature fixability and heat resistant storage stability is used.

For example, embodiments of the present disclosure are as follows.

<1> An Image Forming Apparatus, Including:

a developing unit configured to develop an electrostatic latent image formed on a surface of an image bearer with a toner to form a visible image; and a cleaning unit which includes an elastic member including a surface layer to be in contact with the surface of the image bearer, and is configured to remove the toner deposited on the surface of the image bearer with the elastic member, wherein Martens hardness A of the surface layer measured by applying a load of 1 μN to a position of the surface layer in a thickness direction of the surface layer using a nanoindenter and Martens hardness B of the surface layer measured by applying a load of 1,000 μN to the position of the surface layer in the thickness direction of the surface layer using the nanoindenter are both 2.5 $N/mm^2$ or greater but 32.5 $N/mm^2$ or less, and Martens hardness A and Martens hardness B satisfy an inequality below, Martens hardness A>Martens hardness B, wherein a coefficient of dynamic friction of the surface layer against polycarbonate is 0.5 or less, and wherein the toner includes a polyester resin insoluble to tetrahydrofuran (THF) and a glass transition temperature (Tg) of a THF-insoluble component of the toner determined from a DSC curve of first heating of differential scanning calorimetry (DSC) is −60° C. or higher but 20° C. or lower.

<2> The image forming apparatus according to <1>, wherein Marten hardness of the surface layer measured by applying a load of 50 μN to the position of the surface layer in the thickness direction of the surface layer using the nanoindenter is Martens hardness C, and Martens hardness C satisfies an inequality below, Martens hardness A>Martens hardness C>Martens hardness B.

<3> The image forming apparatus according to <1> or <2>, wherein the surface layer includes a siloxane-based compound, and an amount of the siloxane-based compound is 4 parts by mass or greater but parts by mass or less relative to 100 parts by mass of the surface layer.

<4> The image forming apparatus according to any one of <1> to <3>, wherein an average film thickness of the surface layer is 10 μm or greater but 500 μm or less.

<5> The image forming apparatus according to any one of <1> to <4>, wherein a storage elastic modulus (G') of the THF-insoluble component of the toner as determined by a dynamic viscoelasticity measurement at a temperature of 40° C. or higher but 120° C. or lower is $1\times10^5$ Pa or greater but $3\times10^7$ Pa or less.

<6> The image forming apparatus according to any one of <1> to <5>, wherein a glass transition temperature of the toner determined from a DSC curve of first heating in the differential scanning calorimetry is 40° C. or higher but 65° C. or lower.

<7> The image forming apparatus according to any one of <1> to <6>, wherein the polyester resin includes a urethane bond, or a urea bond, or both.

<8> The image forming apparatus according to any one of <1> to <7>, wherein the polyester resin includes an alcohol component including 50 mol % or more of aliphatic diol having from 3 through 10 carbon atoms, and a principal chain of the aliphatic diol has a structure represented by General Formula (1) below, $$HO\text{-}(CR_1R_2)_n\text{-}OH \qquad \text{General Formula (1)}$$

where, in General Formula (1), $R_1$ and $R_2$ are each independently a hydrogen atom or an alkyl group having from 1 through 3 carbon atoms, and n is an odd number of from 3 through 9, where $R_1$ and $R_2$ may be identical or different among units repeated "n" times.

<9> The image forming apparatus according to any one of <3> to <8>, wherein the surface layer further includes a polyurethane-based compound.

<10> The image forming apparatus according to any one of <3> to <9>, wherein the siloxane-based compound is modified silicone oil.

<11> The image forming apparatus according to any one of <1> to <10>, wherein creep A measured by applying a load of 1 μN to the position of the surface layer in the thickness direction of the surface layer using the nanoindenter and creep B measured by applying a load of 1,000 μN to the position of the surface layer in the thickness direction of the surface layer using the nanoindenter are both 3.0% or greater but 13.5% or less, and creep A and creep B satisfy an inequality below, creep A>creep B.

<12> The image forming apparatus according to any one of <1> to <11>, wherein a length of the surface layer is 1 mm or greater where the length is a length from an edge of the surface layer to be in contact with the image bearer towards a direction substantially perpendicular to a length direction of the edge.

<13> An image forming method, including: developing an electrostatic latent image formed on a surface of an image bearer with a toner to form a visible image; and removing the toner deposited on the surface of the image bearer with an elastic member including a surface layer to be in contact with the surface of the image bearer to clean the image bearer, wherein Martens hardness A of the surface layer measured by applying a load of 1 μN to a position of the surface layer in a thickness direction of the surface layer using a nanoindenter and Martens hardness B of the surface layer measured by applying a load of 1,000 μN to the position of the surface layer in the thickness direction of the surface layer using the nanoindenter are both 2.5 $N/mm^2$ or greater but 32.5 $N/mm^2$ or less, and Martens hardness A and Martens hardness B satisfy an inequality below, Martens hardness A>Martens hardness B, wherein a coefficient of dynamic friction of the surface layer against polycarbonate is 0.5 or less, and wherein the toner includes a polyester resin insoluble to tetrahydrofuran (THF) and a glass transition temperature (Tg) of a THF-insoluble component of the toner determined from a DSC curve of first heating of differential scanning calorimetry (DSC) is −60° C. or higher but 20° C. or lower.

The image forming apparatus according to any one of <1> to <12> and the image forming method according to <13> can solve the above-described various problems existing in the art, and can achieve the object of the present disclosure.

What is claimed is:

1. An image forming apparatus, comprising:

a developing unit configured to develop an electrostatic latent image formed on a surface of an image bearer with a toner to form a visible image; and a cleaning unit which includes an elastic member including a surface layer to be in contact with the surface of the image bearer, and is configured to remove the toner deposited on the surface of the image bearer with the elastic member, wherein Martens hardness A of the surface layer measured by applying a load of 1 μN to a position of the surface layer in a thickness direction of the surface layer using a nanoindenter and Martens hardness B of the surface layer measured by applying a load of 1,000 μN to the position of the surface layer in the thickness direction of the surface layer using the nanoindenter are both 2.5 $N/mm^2$ or greater but 32.5 $N/mm^2$ or less, and Martens hardness A and Martens hardness B satisfy an inequality below, Martens hardness A>Martens hardness B, wherein a coefficient of dynamic friction of the surface layer against polycarbonate is 0.5 or less, and wherein the toner includes a polyester resin insoluble to tetrahydrofuran (THF) and a glass transition temperature (Tg) of a THF-insoluble component of the toner determined from a DSC curve of first heating of differential scanning calorimetry (DSC) is −60° C. or higher but 20° C. or lower.

2. The image forming apparatus according to claim 1, wherein Marten hardness of the surface layer measured by applying a load of 50 μN to the position of the surface layer in the thickness direction of the surface layer using the nanoindenter is Martens hardness C, and Martens hardness C satisfies an inequality below, Martens hardness A>Martens hardness C>Martens hardness B.

3. The image forming apparatus according to claim 1, wherein the surface layer includes a siloxane-based compound, and an amount of the siloxane-based compound is 4 parts by mass or greater but parts by mass or less relative to 100 parts by mass of the surface layer.

4. The image forming apparatus according to claim 3, wherein the surface layer further includes a polyurethane-based compound.

5. The image forming apparatus according to claim 3, wherein the siloxane-based compound is modified silicone oil.

6. The image forming apparatus according to claim 1, wherein an average film thickness of the surface layer is 10 μm or greater but 500 μm or less.

7. The image forming apparatus according to claim 1, wherein a storage elastic modulus (G') of the THF-insoluble component of the toner as determined by a dynamic viscoelasticity measurement at a temperature of 40° C. or higher but 120° C. or lower is $1\times10^5$ Pa or greater but $3\times10^7$ Pa or less.

8. The image forming apparatus according to claim 1, wherein a glass transition temperature of the toner determined from a DSC curve of first heating in the differential scanning calorimetry is 40° C. or higher but 65° C. or lower.

9. The image forming apparatus according to claim 1, wherein the polyester resin includes a urethane bond, or a urea bond, or both.

10. The image forming apparatus according to claim 1, wherein the polyester resin includes an alcohol component including 50 mol % or more of aliphatic diol having from 3 through 10 carbon atoms, and a principal chain of the aliphatic diol has a structure represented by General Formula (1) below, $$HO\text{-}(CR_1R_2)_n\text{-}OH \qquad \text{General Formula (1)}$$

where, in General Formula (1), $R_1$ and $R_2$ are each independently a hydrogen atom or an alkyl group having from 1 through 3 carbon atoms, and n is an odd number of from 3 through 9, where $R_1$ and $R_2$ may be identical or different among units repeated "n" times.

11. The image forming apparatus according to claim 1, wherein creep A measured by applying a load of 1 μN to the position of the surface layer in the thickness direction of the surface layer using the nanoindenter and creep B measured by applying a load of 1,000 μN to the position of the surface layer in the thickness direction of the surface layer using the nanoindenter are both 3.0% or greater but 13.5% or less, and creep A and creep B satisfy an inequality below, creep A>creep B.

12. The image forming apparatus according to claim 1, wherein a length of the surface layer is 1 mm or greater where the length is a length from an edge of the surface layer to be in contact with the image bearer towards a direction substantially perpendicular to a length direction of the edge.

13. An image forming method, comprising:

developing an electrostatic latent image formed on a surface of an image bearer with a toner to form a visible image; and removing the toner deposited on the surface of the image bearer with an elastic member including a surface layer to be in contact with the surface of the image bearer to clean the image bearer, wherein Martens hardness A of the surface layer measured by applying a load of 1 μN to a position of the surface layer in a thickness direction of the surface layer using a nanoindenter and Martens hardness B of the surface layer measured by applying a load of 1,000 μN to the position of the surface layer in the thickness direction of the surface layer using the nanoindenter are both 2.5 $N/mm^2$ or greater but 32.5 $N/mm^2$ or less, and Martens hardness A and Martens hardness B satisfy an inequality below, Martens hardness A>Martens hardness B, wherein a coefficient of dynamic friction of the surface layer against polycarbonate is 0.5 or less, and wherein the toner includes a polyester resin insoluble to tetrahydrofuran (THF) and a glass transition temperature (Tg) of a THF-insoluble component of the toner determined from a DSC curve of first heating of differential scanning calorimetry (DSC) is −60° C. or higher but 20° C. or lower.

* * * * *